US006994952B2

(12) United States Patent
Saitou et al.

(10) Patent No.: US 6,994,952 B2
(45) Date of Patent: Feb. 7, 2006

(54) SILVER HALIDE EMULSION AND PRODUCTION PROCESS THEREOF

(75) Inventors: Mitsuo Saitou, Kanagawa (JP); Satoshi Aiba, Kanagawa (JP); Sumito Yamada, Kanagawa (JP); Eiichi Okutsu, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/391,642

(22) Filed: Mar. 20, 2003

(65) Prior Publication Data

US 2003/0224305 A1 Dec. 4, 2003

(30) Foreign Application Priority Data

Mar. 22, 2002 (JP) ..... P.2002-081020
Mar. 27, 2002 (JP) ..... P.2002-87955
Mar. 28, 2002 (JP) ..... P.2002-091756
May 14, 2002 (JP) ..... P.2002-138315

(51) Int. Cl.
*G03C 1/015* (2006.01)
*G03C 1/035* (2006.01)
*G03C 1/498* (2006.01)

(52) U.S. Cl. ..... 430/569; 430/567; 430/619

(58) Field of Classification Search ..... 430/567, 430/569, 619
See application file for complete search history.

(56) References Cited

U.S. PATENT DOCUMENTS 4,094,684 A 6/1978 Maskasky
4,184,878 A 1/1980 Maternaghan
4,332,889 A * 6/1982 Siga et al.
4,414,310 A 11/1983 Daubendiek et al.
4,459,353 A * 7/1984 Maskasky ..... 430/567
4,490,458 A * 12/1984 House ..... 430/567
4,672,026 A * 6/1987 Daubendiek ..... 430/567
4,927,745 A * 5/1990 Irving ..... 430/567
5,955,253 A * 9/1999 Kawakami ..... 430/567
2003/0232288 A1 * 12/2003 Oka et al.

FOREIGN PATENT DOCUMENTS

JP 59-119350 7/1984

* cited by examiner

*Primary Examiner*—Richard L. Schilling
(74) *Attorney, Agent, or Firm*—Sughrue Mion, PLLC

(57) ABSTRACT

A silver halide emulsion comprises at least a dispersion medium, water and a silver halide grain, wherein grains occupying from 40 to 100% of the total projected area of said gains have an AgI content of 85 to 100 mol %, a single kind of outer shape except for size and the equivalent-circle projected diameter of from 0.002 to 20 $\mu$m.

13 Claims, 14 Drawing Sheets

A UNIT LATTICE OF A β-TYPE AgI CRYSTAL

A UNIT LATTICE OF A β-TYPE AgI CRYSTAL

SILVER HALIDE EMULSION AND PRODUCTION PROCESS THEREOF

FIELD OF THE INVENTION

The present invention relates to a silver halide (hereinafter referred to as "AgX") emulsion useful in the photographic field and also relates to a production process thereof.

BACKGROUND OF THE INVENTION

1) Conventional techniques for the formation of AgI grain and properties of AgI are described in Publications 1 and 4 and item 5) below, but formation by sorting out monodisperse AgI grain or grain having a specific shape is not performed.

2) The blue light intrinsic absorption of AgI is based on the direct allowed transition between energy bands and therefore, the absorption coefficient of light at a wavelength of 400 to 430 nm is as large as about 100 times that of AgBr. This is advantageous in that the incident blue light is absorbed with good efficiency. However, since insufficiency arises later in the light-sensitive process and development process, a technique of forming an epitaxial AgX part (hereinafter simply referred to as an "epitaxial part") with a low AgI content on the AgI grain and forming a chemical sensitization nucleus in the epitaxial part to form a latent image has been proposed. Publication 2 can be referred to for this technique and Publication 3 can be referred to for the blue light absorption coefficient.

3) Use of AgI grain for the photographic material is described in many publications and Publication 4 can be referred to therefor. However, AgI grains having a β type and a γ type are present in the vicinity of room temperature, many grain shapes are included, or large hunting occurs in the silver potential by the CDJ (controlled double jet) addition for the silver potential control because the silver potential of a reaction solution greatly changes due to slight dispersion of the $I^-$ concentration. Therefore, it is difficult to selectively form grains having only one grain shape and having a monodisperse size. No paper is known reporting an experiment succeeded in realizing this formation. By realizing the monodisperse formation, its use for light-sensitive materials is expected.

4) Publication 1 reports that when AgI grain is formed under the condition of excess $Ag^+$ ($Ag^+$ concentration>$I^-$ concentration), an AgI grain having a high face-centered cubic structure (hereinafter referred to as a "γ structure") content is obtained, whereas when the grain is formed under the condition of excess $I^-$, an AgI grain having a high hexagonal structure (hereinafter referred to as a "β structure") content is obtained.

5) JP-A-59-119350 (the term "JP-A" as used herein means an "unexamined published Japanese patent application") can be referred to for the AgI tabular grain emulsion having an aspect ratio of 8 or more and JP-A-59-119344 can be referred to for the AgI tabular grain emulsion having a γ type content of 90 mol % or more and an aspect ratio of 8 or more.

6) A yellow AgI emulsion grain (high in the content of α-type structure which is a body-centered cubic crystal) having an intrinsic absorption end in the vicinity of 480 nm is described in Publication 1 and U.S. Pat. No. 4,672,026.

7) U.S. Pat. No. 2,327,764 can be referred to for use of AgI fine grain as the UV absorbent in the UV filter layer of a color photographic material.

8) U.S. Pat. No. 4,520,098 can be referred to for the technique of allowing a high AgI content fine grain to be present near the AgX tabular grain (AgCl, AgBr, AgBrI or a mixed crystal of two or more thereof) spectrally sensitized at a high coverage and thereby reducing the amount of dye stains generated at the development processing.

9) Publication 5 describes a technique of mixing a high refractive index fine grain and/or one or more atom, molecule, ion or complex in the dispersion medium layer of a light-sensitive material to increase the refractive index of the dispersion medium layer and thereby reducing the light scattering intensity of AgX grain.

10) A symmetric tetradecahedral AgI grain where hexagonal faces parallel with each other have the same area is described in JP-B-63-30616 (the term "JP-B" as used herein means an "examined Japanese patent publication") and U.S. Pat. No. 4,094,684.

SUMMARY OF THE INVENTION

An object of the present invention is to provide an AgX emulsion of giving higher sensitivity and higher image quality as compared with conventional AgX emulsions.

The object of the present invention can be attained by the following matters.

(I) Embodiments (1) A silver halide emulsion comprising at least a dispersion medium, water and a silver halide grain, wherein grains occupying from 40 to 100%, preferably from 60 to 100%, more preferably from 80 to 100%, still more preferably from 95 to 100%, of the total projected area of the gains have an AgI content of 85 to 100 mol %, preferably from 90 to 100 mol %, more preferably from 95 to 100 mol %, a single kind of grain shape (outer shape except for size) and the equivalent-circle projected diameter of from 0.002 to 20 μm, preferably from 0.02 to 10 μm.

(2) The silver halide emulsion as described in (1), wherein the coefficient of variation in the diameter distribution (standard deviation/average diameter) of the grains is from 0.01 to 0.5, preferably from 0.01 to 0.3, more preferably from 0.01 to 0.2, still more preferably from 0.01 to 0.1.

(3) The silver halide emulsion as described in (1) or (2), wherein at least one surface of the grain has a shape of a parallelogram or a parallelogram with the edges being rounded.

(4) The silver halide emulsion as described in (3), wherein the at least one surface is the (001) face or (002) face of a hexagonal AgI crystal structure (hereinafter referred to as a "β structure").

(5) The silver halide emulsion as described in (3) wherein the at least one surface is the (101) face of a structure.

(6) The silver halide emulsion as described in (3) wherein the at least one surface is the (1-10) face of a β structure.

(7) The silver halide emulsion as described in (3), wherein two pairs of apex angles of the parallelogram or a parallelogram formed by extending linear parts of the edges are about 60° and about 120°.

(8) The silver halide emulsion as described in (3), wherein two pairs of apex angles of the parallelogram or a parallelogram formed by extending linear parts of the edges are about 73° and about 107°.

(9) The silver halide emulsion as described in (1) to (3), wherein the grain has an outer shape of a dodecahedral grain composed of twelve parallelogrammic faces or the dodecahedral grain with the corners and/or edges being rounded.

(10) The silver halide emulsion as described in (1), wherein the grain has a shape of an octahedron having two parallel hexagonal faces and on the side surface, six right-angled parallelogrammic faces, or the octahedron with the corners and/or edges being rounded.

(11) The silver halide emulsion as described in (10), wherein the hexagonal face is the (001) face or (002) face of a β structure.

(12) The silver halide emulsion as described in (10), wherein the right-angled parallelogrammic face is the (100) face of a β structure or a face equivalent to the (100) face.

(13) The silver halide emulsion as described in (1), wherein the grain has a shape of a tetradecahedron having two parallel hexagonal faces and on the side surface, twelve trapezoidal faces, or the tetradecahedron with the corners and/or edges being rounded.

(14) The silver halide emulsion as described in (13), wherein the hexagonal face is the (001) face or (002) face of a β structure.

(15) The silver halide emulsion as described in (13), wherein the trapezoidal face is the (101) face or a face equivalent to the (101) face [called a (101)-like face].

(16) The silver halide emulsion as described in (1), wherein the equivalent-circle projected diameter of grains occupying from 60 to 100%, preferably from 80 to 100%, of the total projected area of the grains is from 0.002 to 0.15 μm, preferably from 0.002 to 0.1 μm, more preferably from 0.002 to 0.05 μm.

(17) The silver halide emulsion as described in (1) above, wherein grains in a molar amount of 40 to 100%, preferably from 70 to 100%, more preferably from 90 to 100%, of all grains in the emulsion have a β structure.

(18) The silver halide emulsion as described in (1) above, wherein grains in a molar amount of 0.1 to 90%, preferably from 1 to 80%, more preferably from 10 to 70%, of all grains in the emulsion have a face-centered cubic AgI crystal structure (hereinafter referred to as a "γ structure").

(19) The silver halide emulsion as described in (1), wherein the grain shape after further growing the grain under the conditions of not causing a new crystal defect (e.g., twin plane, dislocation line) is the grain shape described in any one of (3) to (15).

(20) The silver halide emulsion as described in any one of (1) to (18), wherein the grain has no twin plane within the grain.

(21) The silver halide emulsion as described in (1), wherein the gain has a silver halide epitaxial part having an AgI content of 0 to 40 mol %, preferably from 0 to 30 mol %, more preferably from 0 to 20 mol %, on the grain surface (this indicates one or more site of flat surfaces, corners and edges).

(22) The silver halide emulsion as described in (21), wherein the epitaxial part has an AgCl content of 0 to 100 mol %, preferably from 30 to 100 mol %, more preferably from 60 to 100 mol %.

(23) The silver halide emulsion as described in (21), wherein the epitaxial part has an AgBr content of 0 to 100 mol %, preferably from 30 to 100 mol %, more preferably from 60 to 100 mol %.

(24) The silver halide emulsion as described in (21), wherein the (AgX molar amount in the epitaxial part/AgX molar amount of host grain) is from $10^{-5}$ to 2, preferably from $10^{-5}$ to 0.5, more preferably from $10^{-3}$ to 0.3.

(25) The silver halide emulsion as described in (1) or (21), wherein the grain contains one or more elemental form or compound of an atom having an atomic number of 1 to 92 as the dopant in a total amount of $10^{-9}$ to $10^{-1}$ mol/mol-AgX, preferably from $10^{-8}$ to $10^{-2}$ mol/mol-AgX, other than silver and halogen within the grain and/or in the epitaxial phase.

(26) The silver halide emulsion as described in (25), wherein the dopant is an elemental form of a metal atom [an atom present in the left side from the line connecting boron B and At in the long periodic table of elements] or a neutral or ion form of a compound containing the metal atom, preferably an elemental form of a transition metal atom or a neutral or ion form of a compound containing the transition metal atom.

(27) The silver halide emulsion as described in (26), wherein the compound is a metal complex containing from 1 to 3 metal atom(s) and from 2 to 20 ligands and from one to all of the ligands is (are) an inorganic ligand and/or an organic ligand having from 1 to 30 carbon atoms.

(28) The silver halide emulsion as described in (27), wherein the metal complex is a tetra- or hexa-coordination complex.

(29) The silver halide emulsion as described in (27) or (28), wherein the metal complex contains 1 or 2 organic ligand(s) with the remaining ligand(s) being an inorganic ligand.

(30) The silver halide emulsion as described in (1), wherein the grain contains, within the grain, a chalcogen atom (one or more of S, Se and Te) in an amount of $10^{-2}$ to $10^{-8}$ mol/mol-AgX, preferably from $10^{-3}$ to $10^{-7}$ mol/mol-AgX, and/or a reduced silver in an amount of $10^{-2}$ to $10^{-6}$ mol/mol-AgX, preferably from $10^{-3}$ to $10^{-7}$ mol/mol-AgX.

(31) The silver halide emulsion as described in any one of (4) to (14), wherein in (001) faces of the grain, $A_2$ [=total area of faces comprising $Ag^+$/total area of (001) faces] is from 0.70 to 1.0, from 0.301 to 0.699 or from 0.0 to 0.30.

(32) The silver halide emulsion as described in any one of (5) to (15), wherein in (101)-like faces of the grain, $A_3$ [=total area of faces comprising $X^-$/total area of (101)-like faces] is from 0.0 to 0.30, from 0.301 to 0.699 or from 0.70 to 1.0.

(33) The silver halide emulsion as described in (1), wherein the grain has a shape of an elliptic sphere having no flat crystal face and $A_5$ (=length of longest axis/length of shortest axis) is from 1.02 to 1.6, preferably from 1.05 to 1.5.

(35) The silver halide emulsion as described in (10), wherein the right-angled parallelogrammic face is a flat face having no recession.

(36) The silver halide emulsion as described in (10), wherein the right-angled parallelogrammic face has a recession (non-flat part) in the face.

(37) The silver halide emulsion as described in any one of (13) to (15), wherein the two hexagonal faces are different in the size within one grain and $A_6$ (=area of smaller hexagon/area of larger hexagon) is from 0.01 to 0.92, preferably from 0.1 to 0.8, more preferably from 0.2 to 0.7, still more preferably from 0.3 to 0.6.

(38) The silver halide emulsion as described in (1), wherein the grain is formed in a reaction solution having $A_7$ [=concentration of $Ag^+$ (mol/liter)/concentration of $I^-$ (mol/liter)] of 3 to ∞, preferably from 10 to ∞, more preferably from 100 to ∞, and the β-structure content of the grain is from 77 to 100 mol %, preferably from 80 to 100 mol %, more preferably from 85 to 100 mol %.

(39) The silver halide emulsion as described in (37), wherein the coefficient of variation in the dispersion of the $A_6$ value is from 0.01 to 0.3, preferably from 0.01 to 0.2, more preferably from 0.01 to 0.1.

(40) The silver halide emulsion as described in any one of (1) to (17), wherein the grain has, within the grain, from 1 to 3 twin planes preferably in parallel to the (001) face.

(41) The silver halide emulsion as described in any one of (3) to (9), wherein the emulsion grain is formed by simultaneously mixing and adding an aqueous solution containing $Ag^+$ and an aqueous solution containing $X^-$ to an aqueous solution containing a dispersion medium and the temperature of the aqueous solution containing a dispersion medium is from 45 to 99° C., preferably from 50 to 90° C.

(42) A process for producing a silver halide emulsion, comprising simultaneously mixing and adding an aqueous solution containing $Ag^+$ and an aqueous solution containing $X^-$ to a hydrophilic aqueous solution to form the emulsion described in (1) or (16), wherein when $AgNO_3$ is added to consume from 1 to 90%, preferably from 1 to 70%, more preferably from 1 to 40%, of the total amount to be added, one or more adsorbent is added such that the critical growth rate of grain is reduced by the addition to $10^{-4}$ to 0.9, preferably from $10^{-4}$ to 0.7, more preferably from $10^{-4}$ to 0.3.

(43) The silver halide emulsion as described in (42), wherein the adsorbent is one or more of a cyanine dye, an antifoggant, the dopant described in (25) to (29) above, a crystal habit controlling agent and a water-soluble dispersion medium.

(44) The silver halide emulsion as described in (42), wherein new grains are generated by the addition and the (number of new grains generated/number of grains before addition) is from 0.05 to $10^5$, preferably from 0.2 to $10^5$.

(45) A process for producing the silver halide emulsion described in (1), comprising simultaneously mixing and adding a solution containing $Ag^+$ and a solution containing $X^-$ to an aqueous solution (reaction solution) containing from 0.1 to 20 mass %, preferably from 0.3 to 5 mass % of a dispersion medium to form the emulsion described in (1).

(46) The silver halide emulsion as described in (45), wherein from 30 to 100 mass %, preferably from 80 to 100 mass % of the dispersion medium is a gelatin where from 1 to 100%, preferably from 50 to 100%, more preferably from 70 to 100% of the total number of amino groups in a gelatin is chemically modified by an organic compound having from 1 to 50, preferably from 1 to 10, carbon atoms.

(47) The silver halide emulsion as described in (45), wherein from 30 to 100 mass %, preferably from 70 to 100 mass % of the dispersion medium is a phthalated gelatin having a phthalation ratio of 0.1 to 93%, preferably from 10 to 87%, and the produced emulsion grain is the grain described in (9).

(48) The silver halide emulsion as described in any one of (45) to (47), wherein the desalting of the silver halide emulsion produced in (46) or (47) is performed by adjusting the pH of the emulsion to 2 to 5, preferably from 3 to 4.5, and thereby floccing the emulsion.

(49) The silver halide emulsion as described in (1), wherein when the emulsion is coated on a support, when the emulsion is chemically ripened by adding a chemical sensitizer or when the emulsion is spectrally sensitized by adding a sensitizing dye, the pAg of the emulsion is from 3 to 8, preferably from 3.5 to 6.5.

(50) The silver halide emulsion as described in any one of (1) to (40), wherein an agent for reducing the interstitial silver ion ($Agi^+$) concentration of the grain is added to the emulsion and adsorbed to the grain to reduce the $Agi^+$ concentration of grain to 0.8 to 0.001 times, preferably from 0.5 to 0.01 times the concentration before addition.

(51) The silver halide emulsion as described in (1) above, wherein the emulsion is chemically sensitized by adding a chalcogen chemical sensitizer (this indicates one or more of a sulfur sensitizer, an Se sensitizer and a Te sensitizer) in a total amount of $10^{-2}$ to $10^{-8}$ mol/mol-AgX, preferably from $10^{-3}$ to $10^{-7}$ mol/mol-AgX and the emulsion grain contains a chalcogen atom (S, Se, Te) in a total amount of $10^{-2}$ to $10^{-8}$ mol/mol-AgX, preferably from $10^{-3}$ to $10^{-7}$ mol/mol-AgX, and/or the emulsion is chemically sensitized by adding a gold sensitizer in an amount of $10^{-2}$ to $10^{-8}$ mol/mol-AgX, preferably from $10^{-3}$ to $10^{-7}$ mol/mol-AgX and the emulsion grain contains a gold atom in an amount of $10^{-2}$ to $10^{-8}$ mol/mol-AgX, preferably from $10^{-3}$ to $10^{-7}$ mol/mol-AgX.

(52) The silver halide emulsion as described in (21), wherein the epitaxial part is chemically sensitized and contains a chalcogen atom (S, Se, Te) in a total amount of $10^{-2}$ to $10^{-8}$ mol/mol-AgX, preferably from $10^{-3}$ to $10^{-7}$ mol/mol-AgX and/or contains a gold atom in an amount of $10^{-2}$ to $10^{-8}$ mol/mol-AgX, preferably from $10^{-3}$ to $10^{-7}$ mol/mol-AgX.

(53) The silver halide emulsion as described in (1), wherein the emulsion is spectrally sensitized by adding one or more cyanine dye and the amount of the dye added is from 10 to 150%, preferably from 30 to 100% of the saturated adsorption amount.

(54) The silver halide emulsion as described in (1), wherein the amount of one or more cyanine dye added to the emulsion is from 0 to 9.9%, preferably from 0 to 3% of the saturated adsorption amount.

(55) A process for producing a silver halide emulsion, comprising simultaneously mixing and adding an aqueous solution containing $Ag^+$ and an aqueous solution containing $X^-$ to an aqueous solution containing a hydrophilic dispersion medium while keeping constant the silver potential of the solution to form the emulsion of (1), wherein the amplitude (mV) of the silver potential is from −50 to +50, preferably from −30 to +30, more preferably from −15 to +15 based on the designated value for a period of 30 to 100%, preferably from 60 to 100%, more preferably from 90 to 100% of the formation time.

(56) The process for producing a silver halide emulsion as described in (55), wherein the simultaneous addition method comprises adding an aqueous solution containing $Ag^+$ (Ag-1) and an aqueous solution containing $X^-$ (X-1) each at a designated flow rate and adding an aqueous solution containing $X^-$ (X-2) while controlling the flow rate to maintain the silver potential at a designated value, and $A_8$ [=addition rate (mol/sec) of Solution X-2/addition rate (mol/sec) of Solution Ag-1] is from $10^{-4}$ to 0.8, preferably from $10^{-3}$ to 0.4, more preferably from $10^{-3}$ to 0.2.

(57) The process for producing a silver halide emulsion as described in (55), wherein the simultaneous addition method comprises adding an aqueous solution containing $Ag^+$ (Ag-1) and an aqueous solution containing $X^-$ (X-1) each at a designated flow rate and adding an aqueous solution containing $Ag^+$ (Ag-2) while controlling the flow rate to maintain the silver potential at a designated value, and $A_9$ [=addition rate (mol/sec) of Solution Ag-2/addition rate (mol/sec) of Solution X-1] is from $10^{-4}$ to 0.8, preferably from $10^{-3}$ to 0.4, more preferably from $10^{-3}$ to 0.2.

(58) The process for producing a silver halide emulsion as described in any one of (55) to (57), wherein the response speed of the silver potential [cycle of hunting] is preferably from 1 to 300 sec, more preferably from 4 to 100 sec.

(59) The process for producing a silver halide emulsion as described in (55) or (58), wherein the simultaneous addition method comprises adding an aqueous solution containing $Ag^+$ (Ag-1) at a designated flow rate and adding an aqueous solution containing $X^-$ (X-1) while controlling the flow rate to maintain the silver potential at a designated potential.

(60) The process for producing a silver halide emulsion as described in (55) or (58), wherein the simultaneous addition method comprises adding an aqueous solution containing $X^-$ (X-1) at a designated flow rate and adding an aqueous solution containing $Ag^+$ (Ag-1) while controlling the flow rate to maintain the silver potential at a designated potential.

(61) The process for producing a silver halide emulsion as described in any one of (56), (58) and (59), wherein when the measured silver potential is higher than the designated potential, the addition rate of the aqueous solution containing $X^-$ is increased in proportion to the size of difference between those potentials, and when the measured silver potential is lower than the designated potential, the addition rate of the aqueous solution containing $X^-$ is decreased in proportion to the size of difference between those potentials.

(62) The process for producing a silver halide emulsion as described in any one of (55), (57) and (60), wherein when the measured silver potential is higher than the designated potential, the addition rate of the aqueous solution containing $Ag^+$ is decreased in proportion to the size of difference between those potentials, and when the measured silver potential is lower than the designated potential, the addition rate of the aqueous solution containing $Ag^+$ is increased in proportion to the size of difference between those potentials.

(63) The process for producing a silver halide emulsion as described in (61), wherein $A_{10}$ [=control width (mol/sec) of the addition rate of the aqueous solution containing $X^-$/addition rate (mol/sec) of (Ag-1)] is from $10^{-4}$ to 0.3, preferably from $10^{-4}$ to 0.1.

(64) The process for producing a silver halide emulsion as described in (62), wherein $A_{11}$ [=control width (mol/sec) of the addition rate of the aqueous solution containing $Ag^+$/addition rate (mol/sec) of (X-1)] is from $10^{-4}$ to 0.3, preferably from $10^{-4}$ to 0.1.

(65) The process for producing a silver halide emulsion as described in (56), wherein $A_{12}$ [=concentration (mol/liter) of Solution (X-2)/concentration (mol/liter) of Solution (Ag-1)] is from $10^{-5}$ to 0.8, preferably from $10^{-4}$ to 0.4, more preferably from $10^{-4}$ to 0.2.

(66) The process for producing a silver halide emulsion as described in (57), wherein $A_{13}$ [=concentration (mol/liter) of Solution (Ag-2)/concentration (mol/liter) of Solution (X-1)] is from $10^{-5}$ to 0.8, preferably from $10^{-4}$ to 0.4, more preferably from $10^{-4}$ to 0.2.

(67) The process for producing a silver halide emulsion as described in any one of (55) to (66), wherein one or more, preferably two or more of Solutions Ag-1, Ag-2, X-1 and X-2 are added directly to the reaction solution (under the liquid level) from multiple addition pores in a number of 2 to $10^{10}$, preferably from 5 to $10^{10}$, more preferably from 30 to $10^8$.

(68) The process for producing a silver halide emulsion as described in (1) or (45), wherein the nucleation of the grain is performed by simultaneously mixing and adding an aqueous solution containing $Ag^+$ and an aqueous solution containing $X^-$ and based on $A_{14}$ [=addition rate (mol/sec) of $Ag^+$ at the start of addition], $A_{15}$ [=addition rate (mol/sec) of $Ag^+$ in subsequent 10 minutes, preferably 5 minutes] is accelerated to 1.5 times to ∞, preferably from 2 to $10^5$ times.

(69) The process for producing a silver halide emulsion as described in any one of (1), (45), (55) and (68), wherein the grain formation is performed under vigorous stirring by a stirring blade and the rotation number of the stirring blade is from 30 to $10^5$ rpm, preferably from 300 to $10^5$ rpm, more preferably from 1,000 to $10^5$ rpm.

(70) The process for producing a silver halide emulsion as described in (19), wherein the conditions of not causing a crystal defect are a temperature of 60 to 95° C., a pH of 5 to 9 and an $I^-$ concentration of preferably from $10^{-2}$ to $10^{-6}$ mol/liter, more preferably from $10^{-3}$ to $10^{-4}$ mol/liter.

(71) The process for producing a silver halide emulsion as described in (69), wherein the solution containing $Ag^+$ and/or the solution containing $X^-$ added at the grain formation are(is) added in the vicinity of the stirring blade and the vicinity is a site where the flow velocity of the solution generated by the stirring blade is from 1 to 0.1 times, preferably from 1 to 0.3 times, more preferably from 1 to 0.7 times the maximum flow velocity.

(72) The process for producing a silver halide emulsion as described in (1) or (55), wherein the condition of the reaction solution has one or more following difference between at the formation of seed crystal of the grain and at the growth of grain, and $A_{16}$ (=added silver amount at the growth of grain/added silver amount at the formation of seed crystal) is from 2 to $10^{10}$, preferably from 3 to $10^7$:

a) the temperature (° C.) is different by 5 to 95, preferably from 10 to 95, more preferably from 15 to 95;

b) the pH is different by 0.3 to 12, preferably from 1 to 11;

c) the pAg or pI is different by 0.2 to 12, preferably from 0.5 to 6.

(73) The process for producing a silver halide emulsion as described in (67), wherein the pore of the multiple addition pores or the multipore addition system having multiple addition pores is composed of a rubber elastic body, the rubber elastic body is a material undergoing a reversible elastic deformation to a length of 1.05 to 20 times, preferably from 1.1 to 20 times, more preferably from 1.3 to 10 times the original length in the temperature region on use, and the rubber elastic modulus [Young's modulus ($N/m^2$)] thereof is from $10^4$ to $10^9$ preferably from $10^5$ to $10^8$.

(74) The process for producing a silver halide emulsion as described in (67) or (73), wherein when the addition is stopped, the addition pore is closed and the solution added and the reaction solution are in a non-contacted state.

(75) The process for producing a silver halide emulsion as described in any one of (1), (45) and (55), wherein the emulsion is ultrafiltered during and/or after the grain formation to reduce the $NO_3^-$ content (mol/mol-AgX) of the emulsion to from 0 to 90%, preferably from 0.01 to 40%, more preferably from 0.01 to 10% of the content before the ultrafiltration.

(76) The process for producing a silver halide emulsion as described in (75), wherein the ultrafiltration is performed by a cross-flow method of feeding the solution toward the direction parallel to the filtration membrane surface.

(77) The process for producing a silver halide emulsion as described in any one of (45) and (55) to (74), wherein $Ag^+$ and $X^-$ are added by a plunger pump having a syringe and a piston and employing a system that the piston is driven by a pulse motor previously fixed to the (amount of solution added (ml)/pulse), a pulse of ($A_{17}$ pulse/sec) is received from the control system and the solution is added at a flow rate of (amount added of $A_{17}$ pulse/sec).

(78) The process for producing a silver halide emulsion as described in (77), wherein the addition is performed using two or more reciprocating plunger pumps for the addition of one solution by a system that during the addition using one pump, a new solution is sucked into the cylinder using another pump and the solution is alternately added.

(79) The process for producing a silver halide emulsion as described in (77) or (78), wherein the piston is extruded by a thing which proceeds while rotating like a screw, and the thing rotates and proceeds according to the previously set (rotation angle/pulse).

(80) A photographic light-sensitive material comprising a support having coated thereon one or more layer of the emulsion described in (1) above.

(81) A photographic light-sensitive material comprising a support having thereon one or more AgX emulsion layer, wherein the fine grain emulsion described in (16) above is used as a filter material for removing UV light and absorbs from 10 to 100%, preferably from 30 to 100%, more preferably from 60 to 100% of light at a wavelength of 350 to 370 nm entered into the light-sensitive material.

(82) The photographic light-sensitive material as described in (80) or (81), which is a color light-sensitive material having at least a blue-sensitive layer of being exposed to blue light and forming a yellow dye, a green-sensitive layer of being exposed to green light and forming a magenta dye, and a red-sensitive layer of being exposed to red light and forming a cyan dye.

(83) The photographic light-sensitive material as described in (81), wherein the layer containing the grain is a light-insensitive layer and is provided in the side closer to the object than the light-sensitive layer.

(84) A photographic light-sensitive material comprising a support having thereon one or more light-sensitive layer and light-insensitive layer, wherein the fine grain emulsion described in (16) above is mixed in at least one layer and the layer is increased in the refractive index to light of 520 nm by 0.05 to 1.0, preferably from 0.1 to 0.9, more preferably from 0.2 to 0.9 from the refractive index before mixing.

(85) The photographic light-sensitive material as described in (84), wherein by the mixing of the fine grain emulsion, the light scattering density to light at a wavelength of 520 nm of the light-sensitive material is decreased to 0.01 to 0.95, preferably from 0.01 to 0.6, more preferably from 0.01 to 0.3 based on the density before mixing.

(86) A photographic light-sensitive material, wherein the fine grain described in (16) is present in the vicinity of [a light-sensitive tabular grain (having an aspect ratio of 2 to 500, preferably from 4 to 500) spectrally sensitized by adsorbing a dye in an amount of 20 to 100%, preferably from 60 to 100% of the saturated adsorption amount and having a composition of AgCl, AgBr, AgBrI or a mixed crystal of two or more thereof] in a proportion of 0.01 to 10 mol %, preferably from 0.1 to 10 mol % of the presence molar amount of the tabular grain.

(87) A process for producing a silver halide emulsion, comprising adding the fine grain emulsion described in (16) to another AgX emulsion $A_{19}$ (containing water, a dispersion medium and an AgX grain $A_{18}$) and dissolving the grain in $A_{19}$ to deposit on $A_{18}$, wherein grains occupying from 60 to 100%, preferably from 90 to 100% of the total projected area of $A_{18}$ have an average AgI content of 0 to 35 mol %, preferably from 0 to 20 mol %, and an equivalent-circle projected diameter of 0.05 to 20.

(88) The process for producing a silver halide emulsion as described in (87), wherein grains occupying from 60 to 100%, preferably from 90 to 100% of the total projected area of $A_{18}$ have an aspect ratio (equivalent-circle projected diameter/thickness) of 2 to 500 and a thickness of 0.01 to 0.5 $\mu$m, preferably from 0.01 to 0.3 $\mu$m.

(89) The silver halide emulsion as described in (10) to (15), wherein the average aspect ratio is 1.2 or more. (90) The silver halide emulsion as described in any one of (13) to (15), (37) and (40), wherein the grain has, on the grain surface, from 1 to 3 sheets, preferably 1 sheet, of recession in parallel to the (001) face.

(91) The silver halide emulsion as described in any one of (10) to (17), wherein the grain is a grain obtained by forming the grain described in (9) and then growing the grain while changing the grain shape.

(92) The silver halide emulsion as described in (10) or (11), wherein the grain is a grain obtained by forming the tabular grain shown in FIGS. 5A to 5D and then growing the grain while changing the grain shape.

(93) The silver halide emulsion as described in (13), wherein the grain is a grain obtained by forming a seed crystal of the grain and then growing the seed crystal to a molar amount of 1.3 to $10^{10}$ times, preferably from 2 to $10^6$ times the original molar amount under the conditions for growing the grain described in (9) or under the conditions described in (19) or (70).

(94) The silver halide emulsion as described in (13), wherein the seed crystal is formed in an aqueous solution of a dispersion medium at 0 to 60° C. and then grown at a temperature higher by 3 to 98° C., preferably from 10 to 90° C., than the temperature at the formation of the seed crystal.

(95) The silver halide emulsion as described in (87), wherein an $AgX_3$ fine grain having an AgI content of 0 to 30 mol %, preferably from 0 to 15 mol %, and a diameter of 0.01 to 0.15 $\mu$m, preferably 0.02 to 0.1 $\mu$m, is added in addition to the fine grain emulsion and is dissolved in $A_{19}$ to deposit on $A_{18}$, and the AgI content of the AgX layer deposited on $A_{18}$ is from 0.1 to 30 mol %, preferably from 0.5 to 20 mol %.

(96) The silver halide emulsion as described in (87), wherein an aqueous solution containing $Ag^+$ and an aqueous solution containing $X^-$ are added in addition to the fine grain emulsion and deposit on $A_{18}$, and the AgI content of the AgX layer deposited on $A_{18}$ is from 0.1 to 30 mol %, preferably from 0.5 to 20 mol %.

(97) The silver halide emulsion as described in (1), wherein the grain is a tabular grain having a main plane of {001} face and having an aspect ratio [projected diameter of grain/thickness of grain] of 1.7 to 100, preferably from 2 to 100.

(98) The silver halide emulsion as described in (97), wherein at least one side face of the grain is the {101} face or a face equivalent to the {101} face.

(99) The silver halide emulsion as described in (97), wherein the γ structure content of the grain is from 1 to 70 mol %, preferably from 5 to 60 mol %, more preferably from 10 to 55 mol %.

(100) The process for producing a silver halide emulsion as described in (45), wherein the grain formation is performed in the order of a nucleation step, a ripening step and a growth step, and the nucleation and growth steps each is performed by the simultaneous mixing and addition to the reaction solution.

(101) The process for producing a silver halide emulsion as described in (45), wherein the grain formation is performed in the order of a nucleation step and a growth step, and each step is performed by the simultaneous mixing and addition to the reaction solution.

(102) The process for producing a silver halide emulsion as described in (100), wherein in the ripening step, a grain which is not an objective grain is dissolved to deposit on an objective grain and thereby the projected area ratio (%) of the objective grain is increased to 2 to $10^6$ times, preferably from 5 to $10^6$ times.

(103) The process for producing a silver halide emulsion as described in (100) or (101), wherein in the nucleation step and growth step, $Ag^+$ and $X^-$ are simultaneously mixed and added each at a rate of $10^{-5}$ to 1.0 mol/min, preferably from $10^{-4}$ to 0.5 mol/min, per 1 liter of the reaction solution.

(104) The process for producing a silver halide emulsion as described in (100) or (101), wherein at the start of the grain formation, $Ag^+$ and $X^-$ are simultaneously mixed and added each at a rate of $10^{-2}$ to 0.7 mol/min, preferably from 0.03 to 0.5 mol/min, per 1 liter of the reaction solution.

(105) The process for producing a silver halide emulsion as described in (100) or (101), wherein at the start of the grain formation, $Ag^+$ and $X^-$ are simultaneously mixed and added each at a rate of $10^{-5}$ to $9.9\times10^{-3}$ mol/min, preferably from $10^{-5}$ to $3\times10^{-3}$ mol/min, per 1 liter of the reaction solution.

(106) The process for producing a silver halide emulsion as described in any one of (45) and (100) to (105), wherein at least one or both of the $Ag^+$ solution and $X^-$ solution contain a dispersion medium in an amount of 0.01 to 10 wt %, preferably from 0.1 to 5 wt %.

(107) The process for producing a silver halide emulsion as described in (45) or (106), wherein from 30 to 100 mass % of the dispersion medium is a gelatin where from 0 to 1% of the total number of amino groups in a gelatin is chemically modified by an organic compound having from 1 to 50 carbon atoms.

(108) The process for producing a silver halide emulsion as described in (45) or (106), wherein from 30 to 100 mass % of the dispersion medium is a gelatin having a hydroxyproline (Hyp) content (a number of Hyp groups per 100 residues of an amino acid) of 0 to 100, preferably from 0.1 to 60, more preferably from 1 to 30.

(109) The process for producing a silver halide emulsion as described in any one of (45), (106) and (108), wherein from 30 to 100 wt % of the dispersion medium is a gelatin extracted from one or more of bone, skin or scale of an animal living in a cold zone or a cold sea, preferably a fish living in a cold sea, at a temperature of −50 to 25° C., preferably from −50 to 15° C.

(110) The process for producing a silver halide emulsion as described in any one of (45), (100) and (101), wherein the time period from the start to finish of the grain formation is from 0.2 to 3,000 min, preferably from 1 to 1,000 min, more preferably from 2 to 100 min.

(111) The process for producing a silver halide emulsion as described in (45), wherein at least one, preferably both of the $Ag^+$ solution and the $X^-$ solution is (are) directly added to the reaction solution through a hollow tube and the length of the hollow tube in the reaction solution is from 0.5 to 50 times, preferably from 0.8 to 20 times, more preferably from 1.5 to 20 times of the diameter of the reactor.

(112) The process for producing a silver halide emulsion as described in (111), wherein the difference between the temperature of the solution added through the hollow tube in the reaction solution and the temperature of the reaction solution is from 0 to 30° C., preferably 0 to 20° C., more preferably from 0 to 10° C.

(113) The process for producing a silver halide emulsion as described in (45), wherein the reaction solution has a pAg of 2 or more, preferably 2.4 or more, and a pI of 2 or more, preferably 2.4 or more.

(114) The process for producing a silver halide emulsion as described in (45), wherein the temperature of the reaction solution is from 0.1 to 99° C., preferably from 1 to 90° C., and the pH thereof is from 1 to 12° C.

(115) The silver halide emulsion as described in (10) or (13), wherein the maximum adjacent edge ratio $C_2$ of the hexagon or the hexagon formed by extending linear parts of edges [(the maximum edge length/the minimum edge length) of one hexagon] is from 1.0 to 3.0, preferably from 1.0 to 2.0, more preferably 1.0 to 1.4.

(116) The silver halide emulsion as described in (97), wherein the shape of the main plane is a hexagon or a hexagon with the corners being rounded, and the maximum adjacent edge ratio $C_2$ of the hexagon or the hexagon formed by extending linear parts of edges [(the maximum edge length/the minimum edge length) of one hexagon] is from 1.0 to 3.0, preferably from 1.0 to 2.0, more preferably 1.0 to 1.4.

(117) The silver halide emulsion as described in any one of (10), (13) and (116), wherein each apex angle of the hexagon is about 120°.

(118) The silver halide emulsion as described in (97), wherein the shape of the main plane is a trigon, trigon with the corners being rounded, a hexagon or a hexagon with the corners being rounded, and the maximum adjacent edge ratio $C_2$ of the hexagon or the hexagon formed by extending linear parts of edges [(the maximum edge length/the minimum edge length) of one hexagon] is from 3.1 to ∞, preferably from 4 to ∞.

(119) The silver halide emulsion as described in (97), wherein the side surface of the tabular grain has one to five trough(s) (concave portion(s)) parallel to the main plane, which can be clearly discriminated.

(120) The silver halide emulsion as described in (97), wherein the side surface of the tabular grain has no trough parallel to the main plane at all, which can be clearly discriminated.

(121) The silver halide emulsion as described in (97), wherein the content of a γ type crystal structure of the tabular grain is from 5 to 60 mol %, preferably from 10 to 60 mol %, more preferably from 20 to 55 mol %.

BRIEF DESCRIPTION OF DRAWINGS

FIG. 1A shows a top view of the grain; FIG. 1B shows a side view of the grain viewed from the right side; FIG. 1C shows a top view when the (101) face is disposed as the top face; FIG. 1D shows the grain structure when the grain of FIG. 1A is viewed from the obliquely upper side; and FIG. 1E shows a top view of the elliptic spherical grain.

FIG. 2A shows a top view; FIG. 2B shows a side view of the grain viewed from the arrow direction in FIG. 2A; FIG. 2C shows the grain structure when the grain is viewed from the obliquely upper side; and FIG. 2D shows a structural example when a grain having a different structure from FIG. 2C is viewed from the obliquely upper side.

FIG. 3A shows a top view; FIG. 3B shows a side view of the grain viewed from the arrow direction in FIG. 3A; and FIG. 3C shows the grain structure when the grain is viewed from the obliquely upper side.

FIG. 4A shows the grain structure when the grain is viewed from the obliquely upper side; FIG. 4B shows a side view thereof; FIG. 4C shows a grain structure when a grain of another example is viewed from the obliquely upper side; and FIG. 4D shows an example of the tetradecahedral grain having a recession.

FIGS. 6F and 6G each shows a more detailed grain structure example of the grain of FIG. 4A.

FIGS. 8A, 8B and 8C show the patterns of dodecahedral grain, hexagonal columnar grain and tetradecahedral grain, respectively.

In the Figures, $a_1$, $a_2$ and $a_3$ indicate three crystal axes showing a crystal structure;

θ indicates an angle between the incident X-ray beam and the substrate surface;

41 indicates a recession;

6-1 indicates a reaction solution;

6-2 indicates a hollow liquid transfer tube;

6-3 indicates a constant-temperature jacket;

6-4 indicates a constant-temperature water circulating unit; and

6-5 indicates mixing box.

DETAILED DESCRIPTION OF THE INVENTION

The present invention is described in detail below.

(II-1) Description of Grain Structure of Emulsion Grain

The grain described in (1) (hereinafter referred to as "Grain 1") may contain AgCl and AgBr to the content described in (1) above other than AgI. In this case, the molar ratio of (AgCl/AgBr) contained can be any ratio (0 to ∞).

Examples of the grain structure described in (3) to (9) include a dodecahedral grain shown in FIGS. 1A to 1E and FIGS. 6A and 6B. Examples of the grain structure described in (10) to (12) include a hexagonal columnar grain shown in FIGS. 2A to 2D and FIGS. 6D and 6E. Examples of the grain structure described in (13) to (15) include a tetradecahedral grain shown in FIGS. 3A to 3C and 4A to 4D. The crystal plane index on the grain surface is considered to include the forms shown in FIGS. 1A to 1E, 2A to 2D, 3A to 3C, 4A to 4D and 5A to 5D. These are determined from known AgI crystal structural views and X-ray diffraction data by utilizing a phenomenon that when grains are orientated and precipitated on a flat glass substrate surface and after drying, measured by X-ray diffraction, $B_1$ (=ratio of diffraction intensity on face parallel to substrate surface/diffraction intensity on face non-parallel to substrate surface) increases to about 100 times or more.

The grain having a clear crystal habit is shaped like a die. When an emulsion is centrifuged and after removing the supernatant and the dispersion medium, redispersed by adding water and the grains are allowed to spontaneously precipitate, the grains land in such a state that the flat substrate surface and the crystal face are tightly contacted in parallel, and this may be utilized because in the case of a powder particle, a very small number of grains satisfy the Bragg requirement and contribute to the diffraction intensity, however, crystal faces parallel to the substrate surface all contribute to the diffraction intensity.

Other than this, it is also effective to use in combination a method where grains are placed on an electrically conducting substrate and cooled to −120° C. or less, SEM electrophotographic pictures thereof are taken from the upper side and from the obliquely upper side, the outer shape of the grain is exactly determined by comparing it with a model grain formed of a carton, and the outer shape is compared with a unit cell structure.

Figure 1A:
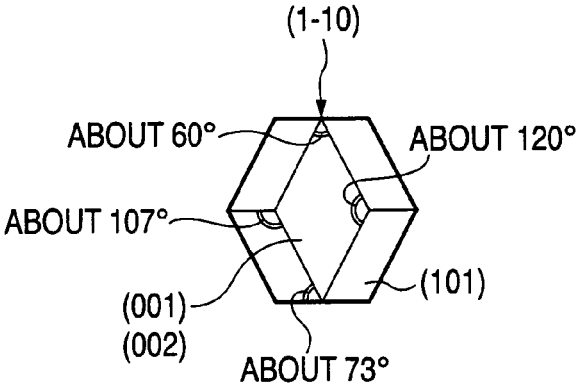
FIGS. 1A to 1E each shows a schematic view of a grain structure.
Figure 1B:
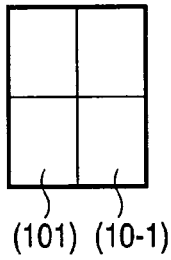
Figure 1C:
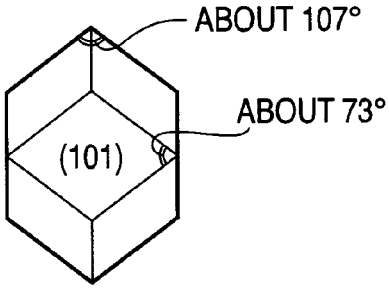
Figure 1D:
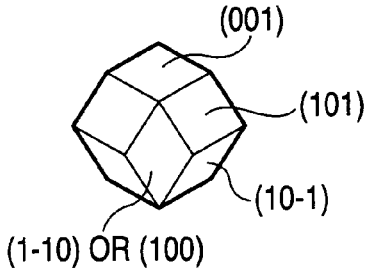
Figure 1E:
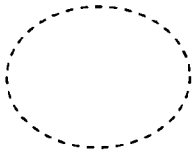

FIG. 1E shows a grain after the dodecahedral grain is rounded at corners and shaped into an elliptic sphere. When this grain is further grown under the conditions of (19) and (70), the dodecahedral grain is obtained. Therefore, this grain comes under the grain of (3) to (9).

Figure 3A:
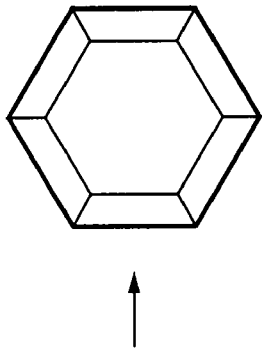
FIGS. 3A to 3C each shows a schematic view of a grain structure.
Figure 3B:
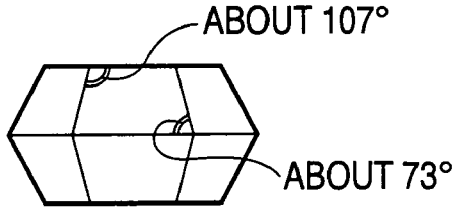
Figure 3C:
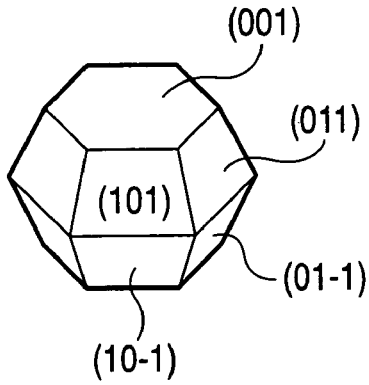

The tetradecahedral grain includes a grain where the upper seven faces part and the lower seven faces part are symmetrically reflected as shown in FIGS. 3A to 3C, and a grain where these parts are asymmetric as shown in FIGS. 4A to 4D. The grain where these face parts are asymmetric is specified in (37) and (39) and can be preferably used.

Grain 1 has an α-type crystal structure at a temperature of about 147° C. or more but at about 146° C. or less, is present as a grain of (β type, γ type or a mixture thereof). Accordingly, in a normal environment at room temperature, this grain is present in the form at 146° C. or less. In the case of a mixture of two types, the ratio in molar amount of these two type grains present can be determined from the powder X-ray diffraction data of the mixture. The method therefor is described in *Physical Review*, Vol. 161, pp. 848–851 (1967). As for the powder X-ray diffraction data of β type and γ type, the data of JCPDS (stored and searchable in CD-ROM available, for example, from Rigaku Denki Sha in Japan) can be used.

Other than this, the following method is effective. An AgI emulsion grain which is 100% β type can be prepared and the powder X-ray diffraction thereof is measured. Assuming that the intensity at a diffraction angle 2θ of 20.14° is β(20.14) and the intensity at 2θ of 21.39° is β(21.39), $B_2$ [=β(21.39)/β(20.14)] is about 0.758.

Next, the sample is heated as it is at about 250° C. and thereafter rapidly cooled to room temperature and its X-ray diffraction is measured. Then, the γ type content is increased and the diffraction intensity at 20.14° peculiar to the β type is decreased. It is found, for example, from the decrement in percentage that the β type content is about 37% and the γ type content is about 63%. At this time, the diffraction intensity at 21.39° is increased. The component therefor includes the portion contributed by the β type in that content [this portion is determined from the $B_2$ value] and the portion contributed by the γ type in that content. From these, the diffraction intensity at 21.39° [γ(21.39)] when the γ type content is 100% can be determined and $B_3$ [=γ(21.39)/β(31.39)] becomes about 4. By utilizing these $B_3$ and $B_3$ values, the β and γ type contents in the sample can be roughly determined. This method is preferably performed using a sample where the grains are precipitated and orientated on a glass substrate. The orientation of grains is fixed and the measurement is reduced in the dispersion.

Incidentally, when the cooling rate is decreased, the β type content is increased and at last, a β type content of 100% results. Accordingly, by selecting a preferred combination of a heating temperature in the range from 200 to 400° C. and a cooling rate in the range from 0.1 to $10^{3°}$ C./sec, Grain 1 having a γ type content of 0.1 to 68 mol %, preferably from 1 to 66 mol %, more preferably from 10 to 65 mol % can be formed. However, even if the heating temperature was changed in the range from 260 to 400° C., the γ type content did not exceed 70%.

In addition, the ratio in molar amount between two types can also be determined by comparing the diffraction area at 2θ=50.795° or 55.703° peculiar to the γ type with the diffraction area at 2θ=38.356° or 53.113° peculiar to the β type. The β and γ contents in Table 1 are shown by a simple area ratio therebetween.

The γ content is dependent not only on the pAg at the grain formation but also on the pH, temperature and grain formation time. For example, even when γ type is formed in a large proportion at the initial stage of the grain formation, this type grain may be dissolved in the subsequent step or deposited as a β type on a large β-type grain and the γ type content is changed by the grain formation time.

In the grains shown in FIGS. 2A to 2D, 3A to 3C, 4A to 4D, 5A to 5D, and 6D to 6H, the opposing sides of the hexagon on the hexagonal face are in parallel with each other and the apexes thereof all are about 120°. This reflects the shape of the (001) face in the hexagonal columnar unit lattice of the β-type AgI crystal shown in FIG. 7. The rhombic (001) face of FIG. 1A reflects the shape of the (001) face in the rhombic columnar unit lattice shown in FIG. 7. The hexagonal shapes of (10) and (13) are also considered to reflect the hexagonal shape on the upper face of the unit cell.

Figure 7:
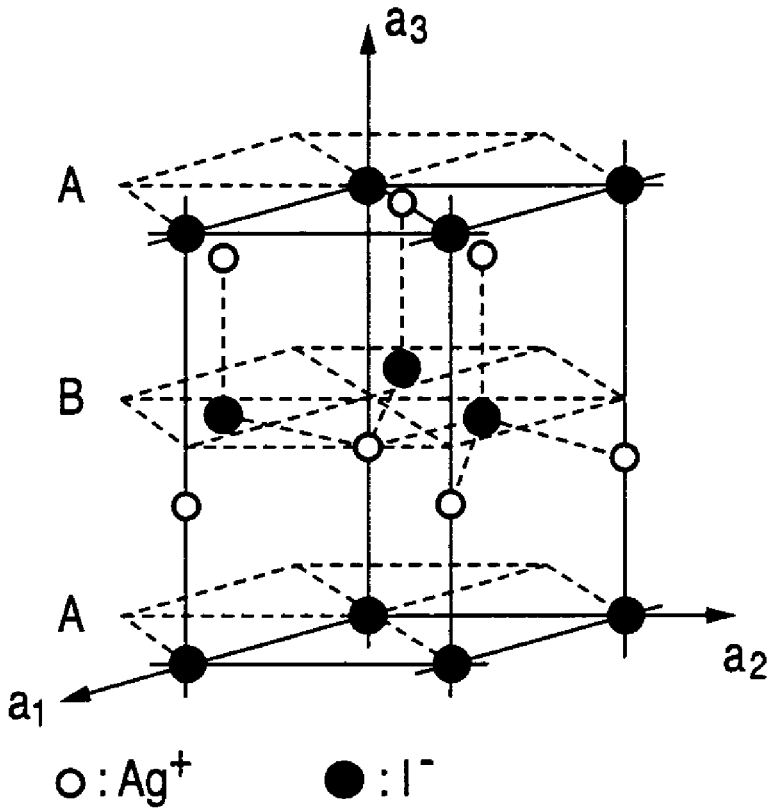
FIG. 7 shows a unit lattice model of a β-type AgI crystal.

Here, for example, the (001) face does not indicate only the face composed of $I^-$ alone on the uppermost face of the unit lattice shown in FIG. 7. An $I^-$ face and an $Ag^+$ face are alternately stacked and thereby the grain grows. Therefore, when the grain growth is terminated after stacking $I^-$, the (001) face is composed of $I^-$, whereas when the grain growth is terminated after stacking $Ag^+$, the (001) face is composed of $Ag^+$. Furthermore, when $AgNO_3$ is added after the grain growth to stack $Ag^+$ layer on the (001) face composed of $I^{31}$, it changes to (001) face composed of $Ag^+$. Accordingly, the (001) face in FIGS. 1A to 1E, 2A to 2D, 3A to 3C, 4A to 4D, and 5A to 5D shows the face parallel to the (001) face of FIG. 7. In other words, the (001) face is an expression including also the (002) face. The same applies to other faces and this is an expression including all faces parallel to that face. The term "face" as referred to in the present invention means the crystal surface.

In (7) and (8) above, the term "about" means that the error is preferably within 5°, more preferably within 3°, still more preferably within 1.5°. Crystallographically, each apex of the face is fixed but a measurement error may occur or edges may be dissolved and become unclear to increase the measurement error. The same applies to the right angle in the "right-angled parallelogrammic" of (12). The angles of the trapezoidal face of the tetradecahedral grain described in (13) and shown in FIGS. 3A to 3C and 4A to 4D are about 73° and about 107°, and the "about" used here has the same meaning as above.

The outer shape as referred to in (1) indicates a shape where the shape of crystal face, the number of crystal faces, the area ratio between crystal faces within one grain and the angles of a face are specified as in (3) to (15). In the case of a grain with the corners being rounded, the shape of a face formed by extending linear parts of sides is specified. Also, the radius of curvature in the rounded portion is specified. In the embodiments, the term "rounded" in the "rounded grain" means that the radius of curvature in the rounded portion is preferably from 0.1 to 30 times, more preferably from 0.2 to 10 times the projected diameter of the grain. The coefficient of variation in the dispersion is preferably from 0.01 to 0.3, more preferably from 0.01 to 0.2.

The single species AgX emulsion described in (1) may also be used by mixing 2 to 5 kinds thereof at any ratio.

(II-2) Preparation Method of the Emulsion (II-2-1) Dependency on pH, pAg and Temperature During Grain Formation An aqueous solution containing $Ag^+$ and an aqueous solution containing $I^-$ are simultaneously mixed and added to an aqueous solution containing a dispersion medium to prepare Grain 1. At this time, when the pH (1 to 12), the $Ag^+$ concentration (pAg: from 1 to 17) and the $I^-$ concentration (pI: from 1 to 17) of the aqueous solutions are variously changed, grains having various shapes are produced. For example, seed crystals are formed using Solution Ag-1 (0.2N aqueous solution of $AgNO_3$) and Solution KI-1 (0.2 N aqueous solution of KI) in 1,200 ml of a 3 mass % aqueous solution of a normal alkali-treated cow bone gelatin at 60 to 90° C. by adding Solution Ag-1 at 4 ml/min for 10 minutes while keeping the pAg constant. Then, the seed crystals are grown using Solution Ag-2 (1N aqueous solution of $AgNO_3$) and Solution X-2 (1N aqueous solution of KI) by adding Solution Ag-2 at an initial flow rate of 2.4 ml/min with an accelerated flow rate of 0.16 ml/min for 100 minutes while keeping the pAg constant. In this case, the relationship shown in Table 1 is present between the grain formation conditions ($C_1$ to $C_9$) and the properties of the produced grain. The β type approximate content and the γ type approximate content are in the unit of mol %. Accordingly, Table 1 can be referred to for the above-described embodiments.

TABLE 1

Figure 2A:
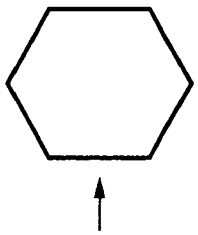
FIGS. 2A to 2D each shows a schematic view of a grain structure.
Figure 2B:
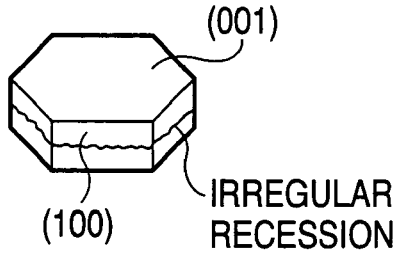
Figure 2C:
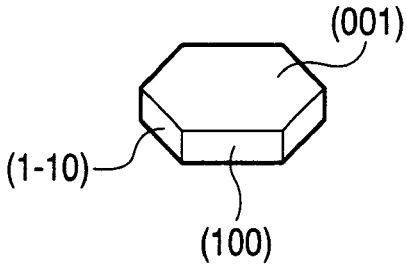
Figures 6A, 6B:
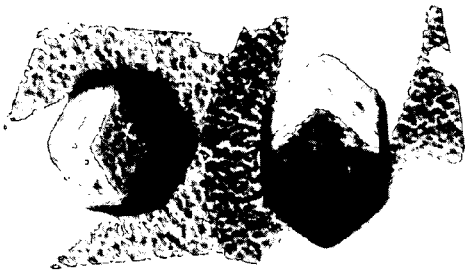
FIG. 6A shows a more detailed grain structure example of the grain of FIG. 1A.
FIG. 6B shows a more detailed grain structure example of the grain of FIG. 1C.

| | pH 1 to 3 | pH 4 to 8 | pH 9 to 11 | pAg (PI) |
|---|---|---|---|---|
| Shape of grain | FIGS. 2B and 2C | FIGS. 2B and 2C | FIG. 1E | <2.3 (≧3) |
| Crystal structure | β: 100 | γ: 60, β: 40 | β: 100 | |
| Average diameter, μm | 0.65 $C_1$ | 0.72 $C_2$ | 0.35 $C_3$ | |
| Shape of grain | FIG. 1D, FIGS. 6A, 6B | FIG. 1D, FIGS. 6A, 6B | FIG. 1D, FIGS. 6A, 6B | ≧2.4 (≧2.4) |

TABLE 1-continued

Figure 4A:
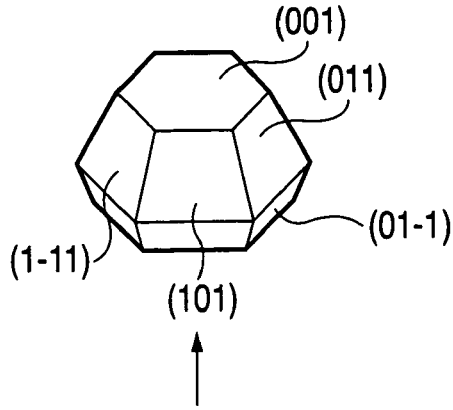
FIGS. 4A to 4D each shows a schematic view of a grain structure.
Figure 4B:
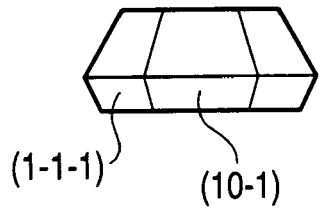
Figure 4C:
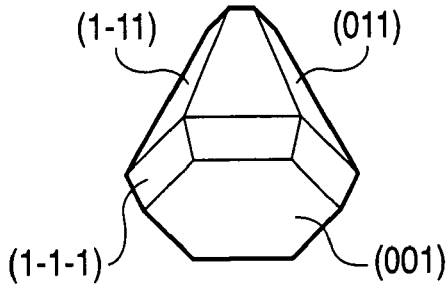
Figure 6C:
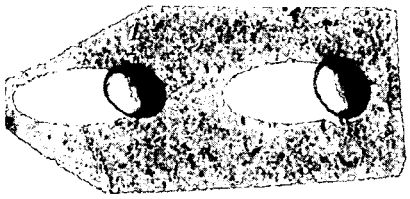
FIG. 6C shows a more detailed grain structure example of the grain of FIG. 1E.
Figure 6D:
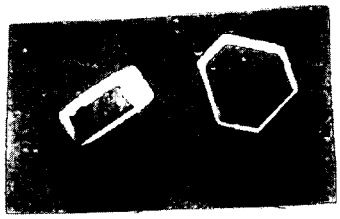
FIG. 6D shows a more detailed grain structure example of the grain of FIG. 2C.
Figure 6E:
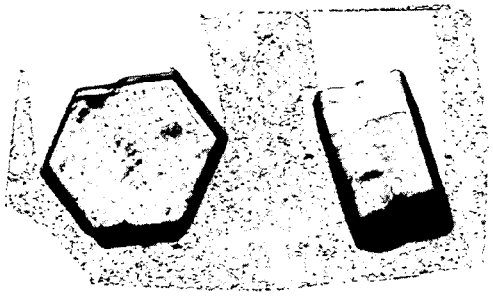
FIG. 6E shows a more detailed grain structure example of the grain of FIG. 2B.
Figure 6F:
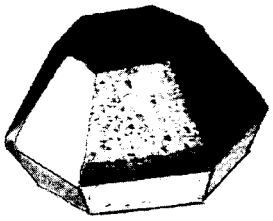
FIG. 6F shows a more detailed grain structure example of the grain of FIG. 4A.
Figure 6G:
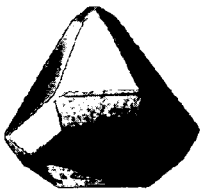
Figure 6H:
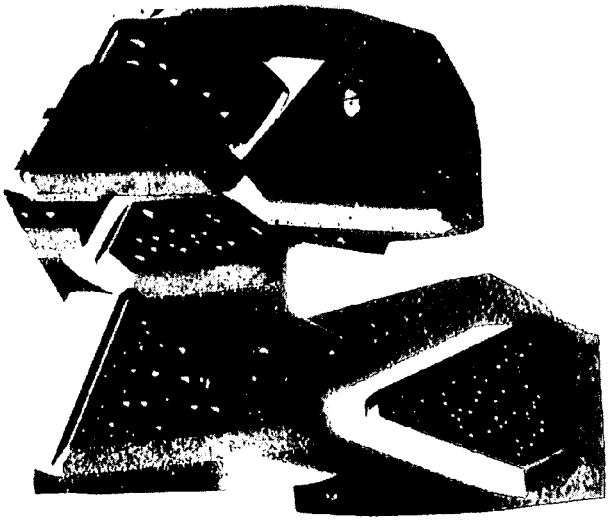
FIG. 6H shows a more detailed grain structure example of the grains of FIGS. 5B and 5D.

| | pH 1 to 3 | pH 4 to 8 | pH 9 to 11 | pAg (PI) |
|---|---|---|---|---|
| Crystal structure | β: 83, γ: 17 | β: 100 | β: 80, γ: 20 | |
| Average diameter, μm | 0.23 $C_4$ | 0.24 $C_5$ | 0.28 $C_6$ | |
| Shape of grain | FIGS. 4A and 4C | FIGS. 4A to 4D | FIGS. 5A to 5D, | ≧3 (<2.3) |
| Crystal structure | β: 100 | β: 100 | FIG. 6H | |
| Average diameter, μm | 1.0 $C_7$ | 1.6 $C_8$ | β: 56, γ: 44 | |
| | | | 2.0 $C_9$ | |

On more particularly reviewing the results when the pH and pAg are changed, the production region of the dodecahedral grain is preferably (pAg≧2.4 and at the same time, PI≧2.4), more preferably (pAg≧2.7 and at the same time, PI≧2.7). The pH is preferably from 1 to 12, more preferably from 3 to 9, still more preferably from 4 to 8. If the pH is less than 3, the grain shown in FIG. 2C is readily mixed in a ratio of 0.1 to 10% by number. Here, pI=−log[$I^-$ mol/liter] and pAg=−log[$Ag^+$ mol/liter].

The production region of the grain in the form of FIG. 1E and FIG. 6C where the grain is rounded is preferably (pAg=1 to 2.7), more preferably (pAg=1 to 2.4). The pH is preferably from 7 to 12, more preferably from 8 to 11.

The production region of the hexagonal columnar grain shown in FIGS. 2B and 2C is preferably pH of 1 to 9, more preferably from 1 to 7, still more preferably from 1 to 5. The pAg is preferably from 1 to 2.7, more preferably from 1 to 2.4.

Figure 2D:
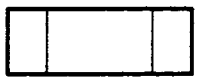

The grain shown in FIG. 2C or 2D or FIG. 6D where the right-angled parallelogrammic face is flat is readily generated at a pH of 1 to 3.9, and the grain shown in FIG. 2B or FIG. 6E where the face is not flat is readily generated at a pH of 4 to 8.5. On the other hand, the grain can be prepared by selecting the number ratio of 60 to 100%, preferably from 80 to 100%, more preferably from 90 to 100%.

The production region of the tetradecahedral grain described in (13) and (14) and shown in FIGS. 3A to 3C and 4A to 4D is preferably a pH of 1 to 9, preferably from 1 to 6, and a pI of 1 to 2.7, preferably from 1.5 to 2.5. Also, when the above-described dodecahedral grain is grown in this region, the dodecahedral grain is changed into the tetradecahedral grain and the emulsion described in (13) and (14) can be obtained.

When the grain is formed at a pH of 5 to 12, preferably from 9 to 11 (condition $C_9$ in Table 1), a tabular grain is produced. FIGS. 5A to 5D and 6H show a structure example of the grain. A tabular grain emulsion where grains occupying from 50 to 100%, preferably from 70 to 100%, more preferably from 90 to 100% of the total projected area of all AgX grains have an aspect ratio (equivalent-circle projected diameter of grain/thickness of grain) of 1.6 to 100, preferably from 2 to 100, and a thickness of 0.02 to 0.5 μm, preferably from 0.02 to 0.3 μm, is obtained.

When the seed crystal is formed at a temperature of 5 to 50° C. under the pH and pAg conditions for the production of the dodecahedral grain and grown at 60 to 95° C., namely, when the temperature at the formation of seed crystal is lowered, the probability of producing a tetradecahedral grain increases.

When a tetradecahedral grain is once formed, even if the seed crystal is grown under the condition for the production of the dodecahedral grain, the seed crystal grows as the tetradecahedral grain and the grown tetradecahedral grain is considered to have a crystal defect peculiar to the grain. Namely, a twin plane or a dislocation line (e.g., sword-like dislocation line, spiral dislocation line) is considered to enter in the grain in a specific number of sheets or lines or in a specific form.

Presuming from these properties, the grains in descending order of the crystal defect content are [dodecahedral grain>symmetric tetradecahedral grain, asymmetric tetradecahedral grain>tabular grain]. The dodecahedral grain described in (2) to (9) can be said to readily grow in a high-temperature region of 50° C. or more, preferably 60° C. or more. The crystal defect as used herein indicates a twin plane, a sword-like dislocation line or a spiral dislocation line.

In the normal grain formation, an AgI grain having a β content of almost 100 mol % can be produced. This is verified from the fact that in the X-ray diffraction measurement, the peak strength peculiar to the γ type at 2θ=50.796° or 55.703° is 1% or less of the peak strength at 2θ=53.113° or 42.449° of the β type. Furthermore, a crystal having a β content of 100% (having a most stable structure) is obtained when gradually cooled from 250° C., a grain having a γ content of 70 mol % or more is not obtained under normal grain formation conditions, and the γ content is increased by a special method such as rapidly cooling from the above-described high temperature. From these, the β type is considered to be most stable in the vicinity of room temperature. However, the blue light absorption end wavelength is in the order of (α>γ>β) and the γ type can advantageously absorb light including light at a longer wavelength. In this point, a grain having a higher γ content is preferred.

The grain having a high γ content is obtained in the regions $C_2$, $C_4$, $C_6$ and $C_9$ in Table 1.

This grain is preferably formed by selecting a most preferred combination of a pH in the range from 1 to 12, a pAg from 1 to 10 or a pI from 1 to 10, and a temperature from 0 to 100° C., preferably from 2 to 90° C.

The elliptic spherical grain can be obtained by growing grain under the condition $C_3$ in Table 1. Therefore, the grain can be obtained also by forming a dodecahedral seed crystal, changing the condition to $C_3$ by adding $AgNO_3$ and an alkali, and growing the seed crystal under this condition, and this is more preferred.

With respect to the dispersion medium for the grain formation, conventionally known water-soluble dispersion mediums having a mass average molecular weight of 3,000 to $10^6$, preferably from $10^4$ to $3\times10^5$, all can be used in the range from 0.1 to 15 mass %, preferably from 0.3 to 10 mass %. Specific examples of the dispersion medium are described in Publications 4 and 6 and Japanese Patent Application No. 2002-269954. Examples of the gelatin which can be used include an alkali-treated or acid-treated gelatin or a gelatin having a methionine content of 0 to 60 μmol/g with a low Met content gelatin having a methionine content of 0 to 20 μmol/g or the low Met content gelatin acid-treated with $H_2O_2$; the gelatin having a mass average molecular weight of 3,000 to 70,000, preferably from 5,000 to 40,000; and a gelatin where from 0.1 to 100%, preferably from 10 to 100% of one to six kinds of groups, namely, an amino group, a carboxyl group, an imidazole group, an alcohol group, an amidino group and a thioether group, is chemically modified. For the chemical modification, an organic compound having from 1 to 50, preferably from 1 to 20, carbon atoms is preferably used.

Examples of the chemically modified gelatin include phthalated gelatin, benzoylated gelatin, acetylated gelatin, trimellitated gelatin, succinated gelatin and methyl esterified gelatin.

For example, when an AgI grain is formed under the condition $C_5$ of Table 1, the dispersion species used is a phthalated gelatin. With a phthalation ratio of 95 to 100%, the grain described in (37) is formed, and with a phthalation ratio of 1 to 90%, the grain described in (9) is obtained. However, in any of cases using a gelatin where the amino group is acetylated, benzoylated or trimellitated or the acid group is esterified, the grain described in (9) is obtained with a modification ratio of 0.1 to 100%.

Other than these, a gelatin described later is preferred.

In Table 1, for example, "<2.3, (≧3)" at the right end means that pAg<2.3 and pI≧3.

Figure 4D:
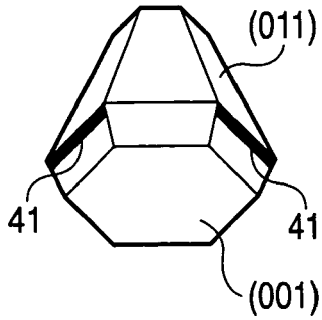
Figure 5A:
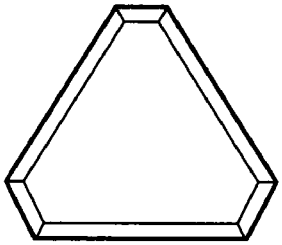
FIGS. 5A and 5C each shows a top view of a tabular grain.
Figure 5C:
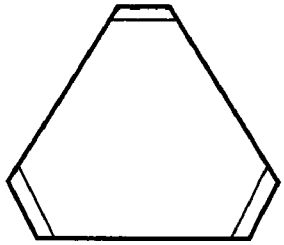
Figure 5B:
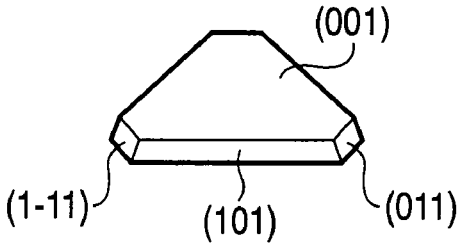
FIG. 5B shows the grain structure when the grain of FIG. 5A is viewed from the obliquely upper side.
Figure 5D:
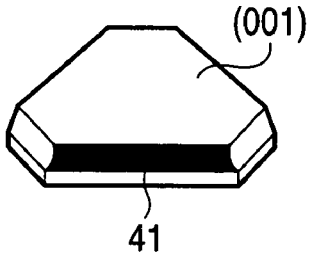
FIG. 5D shows the grain structure when the grain of FIG. 5C is viewed from the obliquely upper side.

The tetradecahedral group described in (13) to (15) and (37) includes a form having a recession (also called trough or groove) on the grain surface, and a form having no recession. FIG. 4D shows an example of the form having a recession. The recession enters in parallel to the (001) face. This is considered to occur because a twin plane is generated in parallel to the (001) face. In FIG. 7, by taking notice of only one part atom, a γ-type layer which is ABC stacking is stacked on the stacking order of ABAB due to a stacking error. As shown in FIG. 4D, a linear recession appears every other outer surface parallel to the (001) face. This is called one sheet of recession. In the grain having two sheets of recession, the two sheets are contained in different positions parallel to each other.

The tabular grain $C_9$ in the embodiment shown in FIGS. 5A to 5D and 6H has a growth accelerating crystal defect on the edge face and therefore, grows to a tabular grain. This defect includes a spiral dislocation defect and a recession formed by a twin plane. The actual presence of a tabular grain where the recession is observed has been confirmed. In the grain, the recession accelerates the growth. It is considered that the grain where the recession is not observed is a grain having a too small recession to be observed or a group having a spiral dislocation defect.

As seen in Table 1, the γ type content of the tabular grain is high. This is considered because the tabular grain has many twin planes.

When the grains are examined on the way of formation of the tabular grain described in (97) to (99) or the grain described in (10) to (12), various kinds of grains are formed at the nucleation and in the subsequent step, the ripening described in (102) takes place. This is because the grain described in (10) to (12) or (97) to (99) rapidly grows and becomes large. The ripening can also be performed in the state where the simultaneous addition is stopped or in the addition state (addition of $Ag^+$ and/or $X^-$ solution) at a low rate of causing ripening.

The grain described in (10) and (11) can also be formed by forming a tabular seed crystal $C_{91}$ in the condition $C_9$ and growing the seed crystal in the condition $C_2$ of Table 1. In this case, when $C_{91}$ is formed to have a high aspect ratio, the finally obtained tabular grain described in (10) and (11) also has a high aspect ratio.

The tabular grain $C_2$ described in (10) and (11) and the tabular grain $C_{91}$ each preferably has an aspect ratio (equivalent-circle projected diameter/thickness) of 1.5 to 300, more preferably from 2 to 300, and a thickness of 0.01 to 0.5 μm, more preferably from 0.02 to 0.3 μm.

(II-3) Grain Surface Structure

Judging from the above-described results, the equilibrium crystal habit produced in the excess $Ag^+$ region is the (100)-like face {(100), (010) or (1-10) face} seen in the grain of FIGS. 2A to 2D. As shown in FIG. 7, this face is a face where $Ag^+$ and $X^-$ are alternately disposed and comes under the (100) face of AgBr system. The hexagonal surface of the grain having a shape of FIGS. 2A to 2D grown under the condition $C_1$ or $C_2$ of Table 1 is considered to have an $A_2$ value of 0.6 to 1.0, preferably from 0.9 to 1.0.

On the other hand, the hexagonal (001) face of a tetradecahedral grain prepared in the excess $X^-$ region is considered to have an $A_4$ value [=total area of surfaces composed of $X^-$/total area of (001) surfaces] of 0.6 to 1.0, preferably from 0.70 to 1.0. The (101)-like face [(101), (011) or (01-1) face] of the tetradecahedral grain is considered to have an $A_3$ value of 0.6 to 1.0, preferably from 0.70 to 1.0. Therefore, the face where only $X^-$ is disposed occupies the majority of the outer surface of the tetradecahedral grain and this outer surface comes under the (111) face of AgBr system.

The outer surface of a dodecahedral grain includes (100) face, (001) face and (101) face. This grain comes under a tetradecahedral grain composed of (100) face and (111) face of AgBr system. In the (001) faces, a face comprising only $Ag^+$ and a face comprising only $X^-$ are present and the $A_2$ value of the face depends on the growth conditions of the grain.

Within the production conditions of the grain, as the $B_4$ [=$Ag^+$ concentration (mol/liter)/$X^-$ concentration (mol/liter)] value is larger, the $A_2$ value is larger. Accordingly, for the grain described in (3) to (9), a grain having an $A_2$ value of 0.70 to 1.0, a grain of 0.301 to 0.699 and a grain of 0.0 to 0.30 can be prepared. The $B_4$ value is preferably from 0.01 to 100.

These $A_2$ to $A_4$ value of the grain can be varied by adding $Ag^+$ or $X^-$ to the emulsion after the grain formation to change the pAg or pI value of the emulsion and thereby changing the $B_4$ value. Accordingly, for the grain described in (3) to (15), a grain having an $A_2$ to $A_4$ value of 0.70 to 1.0, a grain of 0.301 to 0.699 and a grain of 0.0 to 0.30 can be prepared. At the grain formation, $B_4$ cannot be varied because if this is greatly varied, the shape of the produced grain is changed. The $B_4$ is preferably varied by adding $Ag^+$ or $I^-$ after the grain formation because $A_2$ to $A_4$ can be greatly varied while scarcely causing deformation of the grain.

Here, $X^-$ stacked on the grain means a halogen ion (e.g., $Cl^-$, $Br^-$, $I^-$) having an $I^-$ content of 0 to 100 mol %, preferably from 50 to 100 mol %, more preferably from 80 to 100 mol %.

These grains can be preferably used according to respective purposes. For example, a chemical sensitization nucleus may be preferentially formed on a face highly reactive with a chemical sensitizer so as to prevent the dispersion of a latent image. The "preferentially" means that the [amount of chemical sensitization nucleus produced=molar amount of chalcogen atom/$cm^2$] is as large as 1.5 to $10^6$ times, preferably from 3 to $10^6$ times, more preferably from 10 to $10^6$ times that on other faces.

The chemical sensitization nucleus is preferably formed selectively on crystal faces different from each other. In the case of the grain described in (3) to (9), the chemical sensitization nucleus is more preferably formed preferentially on the (−110) face. The size of reactivity with the chemical sensitizer is usually in the order of (face where only $Ag^+$ is disposed >face where $Ag^+$ and $X^-$ are disposed>face where $X^-$ is disposed).

The adsorption property of the sensitizing dye depends on the $A_2$ to $A_4$ value and therefore, the sensitizing dye may be added and adsorbed after these are adjusted to a preferred value. Also, it is preferred that a sensitizing dye is added and adsorbed to the grain and after the adsorption reaches from 10 to 100%, preferably from 40 to 100%, more preferably from 70 to 100% of the saturated adsorption amount, a chemical sensitizer is added to form a chemical sensitization nucleus preferentially on the site where the sensitizing dye is not adsorbed. The "preferentially" complies with the prescription described above.

Furthermore, a chemical sensitization nucleus can be formed preferentially on a crystal face having a low coverage of a sensitizing dye by utilizing the difference in the adsorption property of the dye on different crystal faces. More specifically, a sensitizing dye is adsorbed in the state that $B_5$ [=adsorbed amount (mol/cm$^2$) ratio of dye=amount adsorbed on $B_6$ crystal face/amount adsorbed on $B_7$ crystal face] is from 0.0 to 0.9, preferably from 0.0 to 0.4, more preferably from 0.0 to 0.2, and thereafter a chemical sensitizer is added to form a chemical sensitization nucleus preferentially on $B_6$ face.

(II-4) Method for Controlling $Ag^+$ and $I^-$ Concentrations During Grain Formation In forming Grain 1, the $Ag^+$ and $I^-$ concentration of the reaction solution during the grain formation must be precisely controlled. For this purpose, the methods described in (55) to (79) are preferably used. Generally, when an ion selective electrode is placed in a solution and the potential difference from the comparison electrode is measured, a specific ion concentration is correlates with the potential difference. A method of detecting the ion concentration in a solution as an electric signal utilizing the correlation is often used in the chemical field. In the case of formation of AgX grain, an electrode selectively sensitive to $Ag^+$ and/or $X^-$ is used. Specific examples thereof include a metal silver, an AgX electrode (for example, AgI, AgBr, AgCl and a mixed crystal of two or more thereof), a metal silver having laminated thereon the AgX electrode and a chalcogen silver electrode (for example, $Ag_2S$, $Ag_2Se$, $Ag_2Te$ and a mixed crystal of two or more thereof). Among these, a metal silver and AgI and $Ag_2S$ electrodes are preferred. The silver potential as used in the present invention means an electrode potential thereof to a comparison electrode.

For the comparison electrode, an electrode showing a stable potential in the range from 10 to 60° C. is used. Specific examples thereof include a calomel electrode, an (Ag/silver halide) electrode [for example, (Ag/AgCl), (Ag/AgBr) and (Ag/AgI) electrodes]. Among these, an (Ag/AgCl) electrode is preferred. This is described in detail in Publication 9, Chap. 12.

The potential difference between two electrodes can be measured by connecting a comparison electrode with a reaction solution through a salt bridge and thereby attaining their electrical conduction. The measurement method includes a method of placing a comparison electrode in a reaction solution and measuring the potential difference, and a method of placing a comparison electrode outside a reaction solution and measuring the potential difference. The latter method is preferred. The comparison electrode is preferably kept at a constant temperature and preferably kept at 20 to 30° C., more preferably from 23 to 27° C. In this temperature range, the comparison electrode always shows a stable potential. In this state, the potential difference for various temperatures is previously determined while changing the $Ag^+$ and $I^-$ concentrations in the reaction solution. By utilizing the obtained relationship, the silver potential of the reaction solution during the grain formation is measured and for maintaining it at a designated value, the flow rate of the solution containing $Ag^+$ or $X^-$ added is controlled according to the method described in (55) to (78).

The silver potential of the reaction solution is measured, the (potential—designated potential) difference $S_1$ is determined, a signal ($k_1S_1$) proportional to the difference is sent to the addition system, and thereby the flow rate is controlled. This comes under the conventionally known Method P for PID control. In this case, the solution under control is preferably added at a rate such that the increment or decrement from the equilibrium addition rate $S_{10}$ [for example, when $Ag^+$ is added at a designated addition rate $S_{11}$ (mol/sec), the equilibrium addition rate of $X^-$ becomes $S_{11}$] corresponds to the above-described signal. The signal is sent every 0.01 to 100 seconds, preferably every 0.03 to 30 seconds, more preferably every 0.03 to 5 seconds. However, if the flow rate of the $X^-$ solution is increased in proportion to the difference, due to excessive increase in the flow rate, the potential passes over the designated potential and greatly decreases, if the flow rate is decreased in order to alter the great decrease of the potential, the potential passes over the designated potential and greatly increases, and this sometimes repeatedly occurs (this phenomenon is called "potential hunting"). The following methods are effective for the prevention thereof.

1) This phenomenon increases in proportion to the equilibrium addition rate of $Ag^+$ or $X^-$ added and decreases in proportion to the concentration $S_{12}$ (mol/liter) of the ion species in the reaction solution to be controlled and also in proportion to the amount $S_{13}$ (liter) of the reaction solution. Other than these, the phenomenon depends on the temperature and pH of the reaction solution. The preferred value of the signal amount ($k_1k_2S_1$) under the CDJ control is previously determined by changing those fundamental factors. The relationship of grain formation time vs $k_2$ is stored in the memory of a controller before the initiation of grain formation and the flow rate is increased or decreased by the signal ($k_1k_2S_1$). Accordingly, in the case of the grain formation condition where hunting occurs by the signal $k_1S_1$, $|k_2|$ is selected from $10^{-6}$ to 0.98, preferably from $10^{-6}$ to 0.7, more preferably from $10^{-4}$ to 0.3. As the hunting is larger, a smaller value is selected for $|k_2|$. Other than this, the kind and amount added of a dispersion medium, additives and the AgX solvent have an effect on the hunting but the effect thereof can also be covered by $|k_2|$.

2) The size of hunting is proportional to the absolute value $S_2$ of the integrated value of (potential difference vs time elapsed), therefore, $S_2$ is determined and then ($k_3=1.0+k_4S_2$) is determined. Thereafter, the signal ($k_1k_2S_1/k_3$) is sent as the CDJ signal.

3) The cycle $S_3$ (sec) of the hunting is determined, [$k_5=1+k_6/S_3$] is determined and then the signal $k_1k_2S_1/(k_3k_5)$ is sent as the CDJ signal. As the cycle is shorter, $k_5$ is larger and the flow rate is more reduced in the width of increase or decrease. Other than this, for example, when ($S_3>S_4$) (sec) is intended but the actual value is conversely ($S_3<S_4$), a signal [$k_5=1-k_6\ (S_4-S_3)/S_4$] is formed and a signal $k_1k_2S_1/(k_3k_5)$ is sent as the CDJ signal. The cycle as used here means one cycle period of the above-described repetition. The signal value is determined every 1 to 1,000 seconds, preferably every 3 to 100 seconds, and is fed back to the control system.

4) Conventionally known functions I and D of the PID control method can also be used. More specifically, I is a method of increasing the increment or decrement of the addition rate in proportion to the integrated value of ($S_1$ vs time elapsed) so as not to cause a phenomenon that $S_1$ is delayed to decrease for the time elapsed. D is a method of decreasing the increment or decrement of the addition rate when the change ($dS_1/dt$) of the $S_1$ value for the time elapsed is excessively large, or increasing it when the change proceeds too slowly.

5) Addition of Two Solutions at Designated Flow Rates

When Solution Ag-1 and Solution X-1 are added with good precision, Solution Ag-1 and Solution X-1 may be simultaneously mixed and added at designated flow rates and the concentrations of $Ag^+$ and $I^-$ in the solution can be precisely controlled.

6) Addition of Three Solutions

This is a method of adding, for example, Solution Ag-1 and Solution X-1 at designated flow rates and adding another Solution X-2 under CDJ control. When the addition rate (mol/sec) of Solution X-2 is in the embodiment of (56), the addition rate of Solution X-2 becomes small and the control precision is more increased. When Solution (X-2) is a diluted solution described in (65), the control precision is still more increased.

Publication 8 can be referred to for the details of PID control and pulse motor and for the above-described control.

(II-5) Epitaxial Grain

The high AgI content grain has the following drawbacks. 1) Even if chemical sensitization is applied, an effective chemical sensitization nucleus is difficult to form. This is related to the fact that AgI is more sparingly soluble than AgBr and small in the difference of solubility from chalcogen silver and therefore, is unsusceptible to halogen conversion action. 2) The chemical sensitization nucleus has a small electron capturing efficiency. 3) The latent image is small in the development accelerating activity. 4) the development rate and the fixing rate are low. This is considered because the properties (for example, solubility in water or ion bonding ratio) of AgI are closer to the properties of $Ag_2S$ as compared with AgBr.

When Grain 1 is used in the epitaxial type embodiment described in (21) to (25) and (52), the above-described drawbacks are suppressed, because a chemical sensitization nucleus is formed in the epitaxial part with a low AgI content and this nucleus captures an electron to form a latent image and act as a development starting point. The time until the completion of development and fixing processing can be shortened by elevating the processing temperature in the range from 20 to 60° C., preferably from 30 to 60° C.

The epitaxial grain may be formed by adding $Ag^+$ and $Xa^-$ solutions to the emulsion described in (1) (hereinafter referred to as Emulsion 1) and depositing the epitaxial layer AgXb on a part of the surface of Grain 1. At this time, a method of adding these solutions in the state where a specific adsorbent is adsorbed to Grain 1, and a method of addition without the adsorption may be used. Examples of the adsorbent include a cyanine dye, an antifoggant, an onium salt compound and a surfactant. As for compound examples and details thereof, Publications 4, 6 and 11 can be referred to. The amount adsorbed is preferably from 10 to 100%, more preferably from 30 to 100% of the saturated adsorption amount. Publication 2 can be referred to for the epitaxial formation. An adsorbent is preferably adsorbed, because the epitaxial formation site is limited.

In Grain 1, a dopant may be doped within the grain and/or within the epitaxial phase according to the embodiment described in (25) to (30). When $Ag^+$ and $X^-$ are added in the presence of the dopant and the grain or epitaxial phase is grown, the dopant is doped. Publications 4 and 6 can be referred to for the dopant. The presence of the dopant is preferably from $10^{-1}$ to $10^{-8}$ mol/liter, more preferably from $10^{-2}$ to $10^{-7}$ mol/liter.

In order to dope the dopant with good efficiency, the dopant must be strongly adsorbed preferentially on the grain surface and not desorbed from the surface. This may be attained when the dopant itself has strong adsorption property or by using a dopant having a strong adsorbing group (for example, in the case of a metal complex, an embodiment where the ligand has this property). When AgX is deposited on the grain where the dopant is strongly adsorbed, the dopant is doped. For efficiently integrating the dopant in the AgI crystal lattice, a dopant having the same 4-coordination structure as AgI is preferably used.

At the epitaxial formation or doping, the $pX=-\log[X^-$ mol/liter] is from 0.5 to 10, preferably from 1 to 7, the pH is from 1 to 12, preferably from 2 to 10, the temperature is from 5 to 95° C., preferably from 10 to 85° C., and the dispersion medium concentration is from 1 to 100 g/liter, preferably from 5 to 40 g/liter. Within these ranges, a most preferred combination can be selected.

(II-6) Chemical Sensitization, Spectral Sensitization, etc.

The emulsion of the present invention can be chemically sensitized by adding a chemical sensitizer. As the chemical sensitizer, a chalcogen sensitizer (e.g., sulfur sensitizer, selenium sensitizer, tellurium sensitizer), a noble metal sensitizer (e.g., gold, metal compound of Group 8) or a reduction sensitizer may be used alone, or two or more thereof may be used in combination at any ratio. As the $Agi^+$ concentration reducing agent of (50), an antifoggant is effective. The antifoggant is bound to $Ag^+$ on the grain surface, shifts left the chemical equilibrium of [$Ag^+$ (surface) $\rightleftharpoons Agi^+$] and reduces the $Agi^+$ concentration. Publications 4, 6 and 11 can be referred to for the details thereof, such as compound and use method.

Grain 1 exhibits a large blue light absorption coefficient for light at a wavelength shorter than 430 nm, but is small in the blue light absorption coefficient for light at a wavelength longer than that. Accordingly, in the case of using Emulsion 1 for the blue-sensitive layer of a light-sensitive material, the grain is preferably spectrally sensitized by adding one or more sensitizing dye for blue-sensitive layer and adsorbing the sensitizing dye to the grain. The spectral sensitization is performed by adding one or more sensitizing dye for green-sensitive layer in the case of use for the green-sensitive layer, and adding one or more sensitizing dyes for red-sensitive layer in the case of use for the red-sensitive layer. Each sensitizing dye is used in the embodiment of (53) and the dye is adsorbed to the grain in an amount of 10 to 100%, preferably from 30 to 100% of the saturated adsorption amount.

Other than this, the sensitizing dye may also be used in the embodiment of (54). The grain may also be used for a light-sensitive material which is exposed by irradiating light in the wavelength region from 360 to 440 nm. For the light, any light can be used, such as natural light, LED light, laser light, fluorescent light, discharge light and high-temperature substance light. Publication 7 can be referred to for the light source and Publications 4, 6 and 11 can be referred to for compound examples of the cyanine dye and details of use method. As for the dye species, from 1 to 10 kinds of dyes can be preferably used and it is preferred to use in combination two or more dyes different from each other in the absorption spectrum waveform or two or more dyes different in the adsorption orientation and form a desired absorption spectrum waveform or adsorption orientation.

In addition, a compound (fragmentable electron donating sensitizer) which absorbs one photon and gives from 2 to 4 electrons to the AgX grain when the compound is adsorbed to an emulsion grain and light is irradiated thereon, is preferably added in an amount of $10^{-8}$ to $10^{-1}$ mol/mol-AgX, preferably $10^{-6}$ to $10^{-3}$ mol/mol-AgX. Publication 12 can be referred to for the details of this compound.

(II-7) Other Uses of Grain 1

Grain 1 has low solubility in water and therefore, an ultrafine particle having high transparency to visible light can be formed. By virtue of this, Grain 1 can be used in the following embodiments for photographic light-sensitive materials. 1) An ultrafine grain emulsion of Gain 1 is added to a dispersion medium layer of a light-sensitive layer and/or a light-insensitive layer and dispersed to increase the refractive index of the dispersion medium layer for visible light. The difference in the refractive index between the light-sensitive AgX grain and the peripheral dispersion medium layer is reduced, the light scattering intensity of AgX grain is decreased and the photographic image obtained after the development processing is increased in the sharpness. The grain can also be used in combination with other refractive index increasing agent such as titanium oxide at any ratio [molar amount ratio of (Grain 1/refractive index increasing agent other than Grain 1)=$10^{-5}$ to $10^{5}$, preferably $10^{-3}$ to $10^{3}$]. Publication 5 can be referred to for details and practical embodiments thereof.

2) The above-described ultrafine grain is dispersed as an ultraviolet absorbent in the dispersion medium layer of a light-sensitive layer and/or a light-insensitive layer. The intrinsic absorption end of Grain 1 is direct allowed transition and the absorption coefficient is large, therefore, the grain is effective as an ultraviolet absorbing material for light at a wavelength of about 420 nm or less. In this case, the grain can also be used in combination with other ultraviolet absorbent at any ratio [molar amount ratio of (Grain 1/ultraviolet absorbent other than Grain 1)=$10^{-5}$ to $10^{5}$, preferably $10^{-3}$ to $10^{3}$] Publications 4 and 5 can be referred to for other ultraviolet absorbents.

In order to form the fine grain described in (16), Grain 1 is preferably formed under the low solubility condition. For this purpose, an AgX solvent (compound of forming a soluble complex with $Ag^{+}$) is preferably substantially absent, namely, the concentration thereof is preferably from 0 to $10^{-1}$ mol/liter, more preferably from 0 to $10^{-3}$ mol/liter, still more preferably from 0 to $10^{-6}$ mol/liter. Furthermore, a pAg condition such that in the solubility curve of Grain 1 [a curve showing the relationship of silver dissolved concentration (mol/liter) vs pAg], the solubility is from 1.0 to 6 times, preferably from 1.0 to 3 times the minimum solubility is preferred. In this condition, the $Ag_nX_m$ complex concentration is also low and therefore, crystal defects are difficult to enter into the grain, as a result, a smaller fine grain is formed. More specifically, the condition described in (113) is preferably used.

The fine grain may also be formed by increasing the double jet addition rates of $Ag^{+}$ and $X^{-}$ at the nucleation to form many nuclei and completing the grain formation within a short period of time. Namely, the method described in (104) may be used. However, when added at a high speed, the percentage of grains having uncontrolled defects increases. In this case, the method described in (106) is preferably used to increase the protective colloid property of nuclei.

Furthermore, the fine grain may be also formed by performing the nucleation at a low temperature and the following condition may be used.

For forming a nucleus or seed crystal reduced in defects as much as possible, this may be attained by decreasing the addition rates (mol/min) of $Ag^{+}$ and $X^{-}$ at the nucleation and the condition of (105) may be used. More preferably, the method of (106) is used in combination. However, the number of produced nuclei decreases. The emulsion is preferably concentrated using, if desired, the method of (74) or (75).

Figure 14:
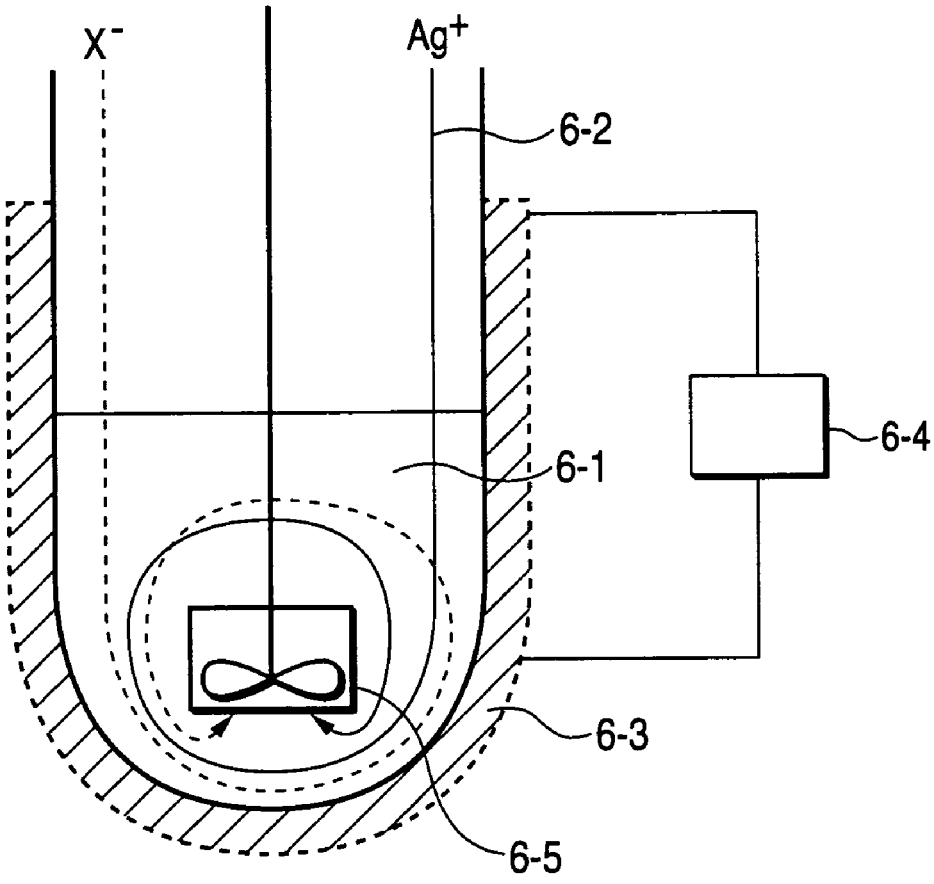
FIG. 14 shows a lateral cross-sectional view of a reaction apparatus.

When the addition is performed in the embodiment of (111) or (112), the added solution and the reaction solution are added at the equal temperature, therefore, selective formation of a specific grain successfully proceeds and monodisperse grains more uniform in the performance are advantageously formed. FIG. 14 shows an example of the apparatus therefor.

The temperature is preferably lower because the solubility is low, and is preferably from 0 to 70° C., more preferably from 1 to 40° C., still more preferably from 1 to 30° C. In this case, the dispersion medium is preferably a dispersion medium which does not gel at such a low temperature, and is preferably a dispersion medium such that when a 2.0 mass % solution is kept still at 1 to 20° C. for 15 minutes, the viscosity (Pa•sec) is from $10^{-4}$ to 0.2, preferably from $10^{-4}$ to 0.1, more preferably from $10^{-4}$ to 0.05. In the case of the above-described gelatin, the mass average molecular weight is preferably from 3,000 to 50,000, more preferably from 3,000 to 30,000. The dispersion mediums described in (105) and (106) are also preferred.

(II-8) Others

Figure 8A:
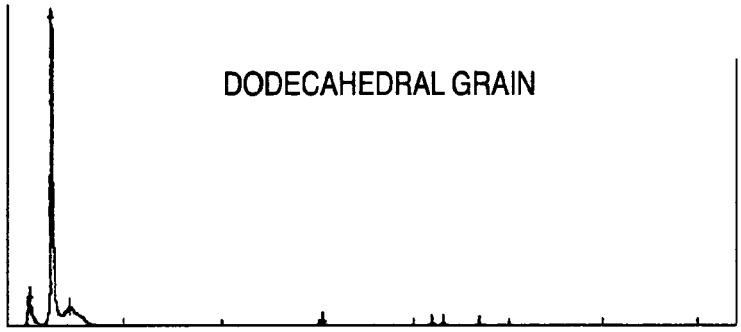
FIGS. 8A to 8C each shows an X-ray diffraction pattern view (relational view between X-ray diffraction intensity and 2θ) of an AgI grain, using CuKβ line.
Figure 8B:
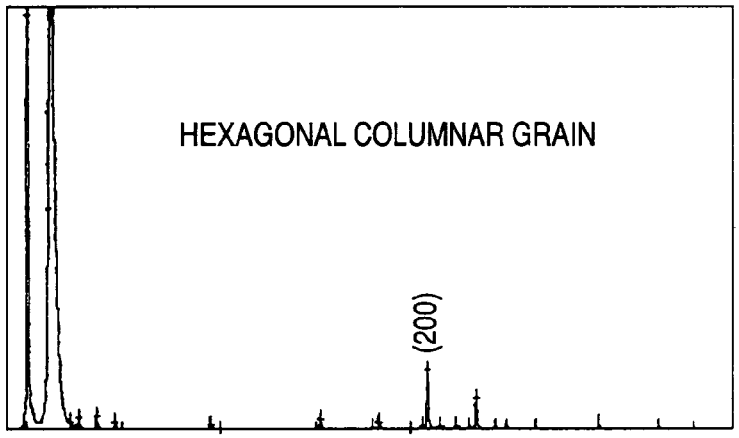
Figure 8C:
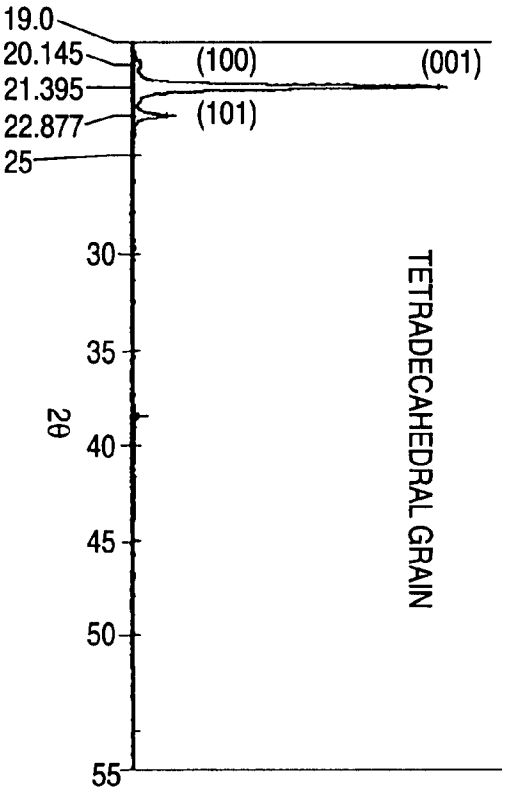

When the dodecahedral AgI grain is precipitated and oriented on a flat glass substrate and after drying, measured on the X-ray diffraction using a CuKβ line, a diffraction pattern shown in FIG. 8A is obtained and diffraction peaks of (001) face, (100) face and (101) face remain. Accordingly, the crystal faces oriented in parallel to the substrate are (001) face, (100) face and (101) face. When the hexagonal grain is similarly oriented and measured on the X-ray diffraction, a diffraction pattern shown in FIG. 8B is obtained and diffraction peaks of (100) and (001) faces remain. Accordingly, the crystal faces oriented in parallel to the substrate are (100) face and (001) face. When the tetradecahedral grain shown in FIGS. 4A to 4D is similarly oriented and measured on the X-ray diffraction, a diffraction pattern shown in FIG. 8C is obtained and diffraction peaks of (001) face and (101) face remain. Accordingly, the crystal faces oriented in parallel to the substrate are (001) face and (101) face.

When a grain has a flat crystal face, the probability that the crystal face is closely contacted on the substrate surface in parallel with the surface is proportional to the area of the flat crystal face, therefore, a diffraction peak of a crystal face having a strength in proportion to the area remains.

TABLE 2

| X-Ray Diffraction Peak Strength | | | |
|---|---|---|---|
| 2θ, Crystal Plane Index | 20.145 β (100) | 21.395 β (001) | 22.877 β (101) |
| Dodecahedral grain | 874 | 9096 | 591 |
| Hexagonal columnar grain | 32603 | 197636 | 503 |
| Tetradecahedral grain | — | 2822 | 298 |

Figure 9:
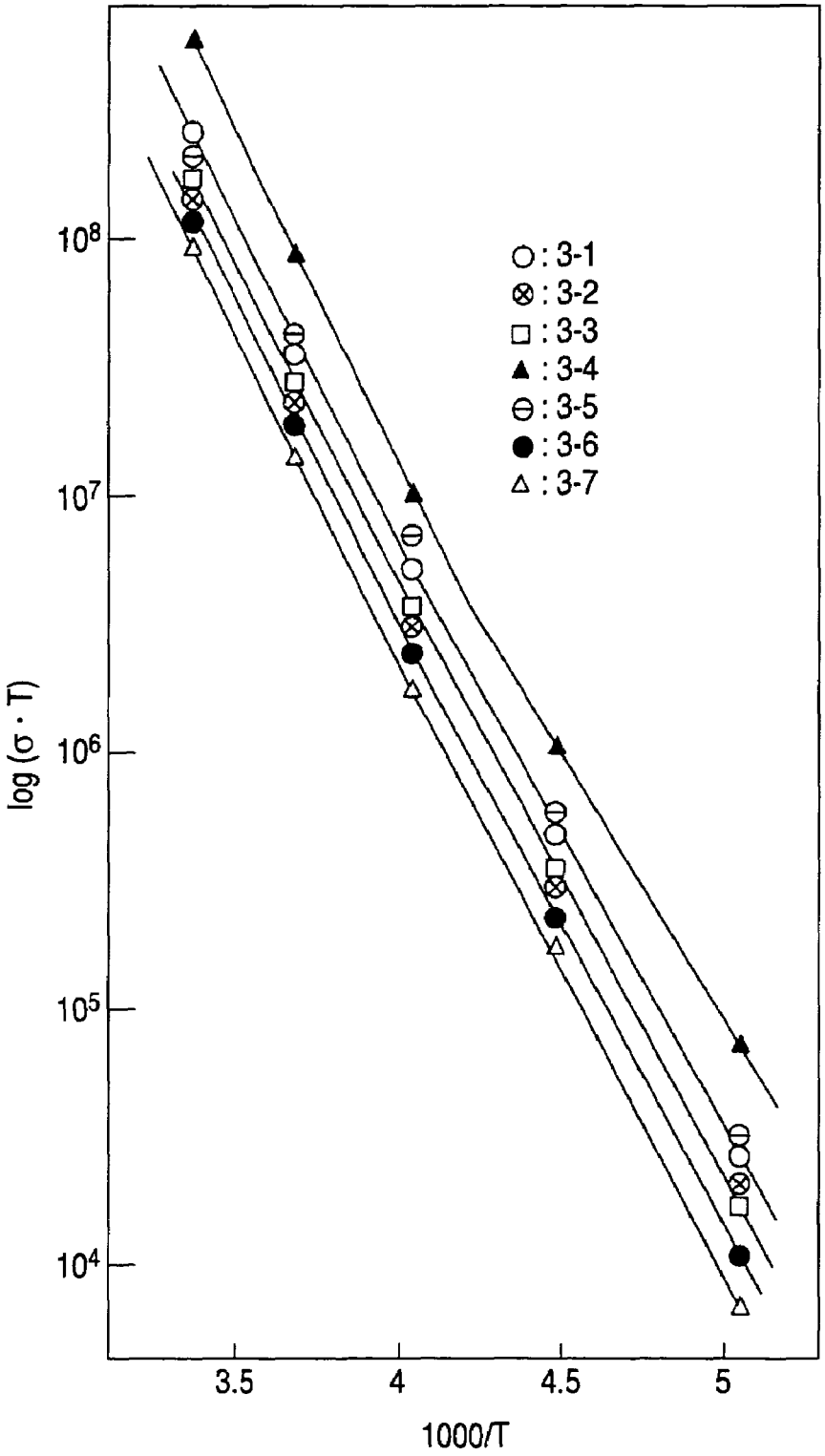
FIG. 9 is a view showing the change in fL of dodecahedral grain by temperature (T°K).

The dry film of a gelatin dispersion of each emulsion grain described in (9) to (15) is measured on the dielectric loss and examined on the dark electrical conductivity (σ) properties, as a result, the followings are known. The dodecahedral grain $C_5$ having a diameter of about 0.2 μm gives two loss peaks at 25° C. It is presumed that the larger peak (fL) in the low frequency side is present at about $10^6$ Hz and the smaller peak (fH) in the high frequency side is present at about $10^8$ Hz. This behavior is close to the properties of an octahedral AgBr grain in the same size. When Antifoggants 1 to 3 are adsorbed on the above-described grain, fL and fH shift to the low frequency side. From this and the results of the grain size dependency described later, the dark electrical conductivity component responsible for fL is considered to be interstitial silver ion $Agi^+$ generated after $Ag^+$ on the grain surface site enters inside the grain. Dodecahedral grains described in (3-1) to (3-7) of Table 3 are measured on the change of fL by the temperature (T° K.) and the log(σT) vs. 1000/T is plotted in FIG. 9. From the gradient of the straight line, ΔE of $\sigma T = A\exp(-\Delta E/kT)$ is determined. The results are shown in Table 3. Here, the value is approximated to [peak frequency of $fL = 10^{11}\sigma$]. The gradient is slightly different between the region of 250° K. or more and the region of 250° K. or less, and therefore ΔE values in both regions are shown. The decrease of fL due to the addition of antifoggants is small as compared with AgBr system. This phenomenon is considered to reflect the fact that AgI is a bonding between a soft acid atom and a soft base atom and is a soft bonding as compared with the bonding between a hard acid atom and a hard base atom, the bonding free energy ΔG is smaller than AgBr and therefore, Agi is readily produced and transfers within the crystal. For coping with the small decrease, the technique of (26) to (36) is preferably used in combination to reduce the fL value to $10^{-3}$ to 0.9 times. Here, [$\Delta E = \Delta G_i$ (energy for producing $Agi^+$)+U (energy for activating transfer of $Agi^+$)] and in the case of AgI, U=0, therefore, ΔE is nearly $\Delta G_i$.

As the grain size becomes larger, fL and fH are shifted to the lower frequency side. For example, in the case of a grain having a diameter of about 1.1 μm, fL is about $10^{5.24}$. In the case of the hexagonal columnar grain $C_1$ (average diameter: 0.65 μm, average thickness: 0.26 μm) of Example 6, fL is $10^{4.5}$ and fH is $10^{6.05}$. When Antifoggant 2 is adsorbed to the grain, fL decreases and disappears and fH of $10^{5.1}$ remains as sole peak. This behavior is similar to the behavior of the tabular grain $C_9$ (average thickness: 0.25 μm, average diameter: 2 μm) obtained under the condition $C_9$ of Table 1. The fL of the grain $C_9$ is $10^{4.8}$ and the fH thereof is $10^{5.8}$. When Antifoggant 2 is adsorbed to the grain, those two peaks are present at mostly the same frequency and the peak strength ratio of (fL/fH) is reversed (1/0.95→0.94/1).

In these two grains, a twin plane is present in parallel to the main plane and this is considered to disturb the transfer of $Agi^+$ and decrease the frequency of fL. When the main plane of the grain $C_1$ or $C_9$ is oriented in parallel to the electrode face, the surface conductivity on the main plane does not contribute to the dielectric loss. Only the surface conductivity on the side face or on a part of main planes, which is oriented not in parallel, contributes to the dielectric loss and this is considered to decrease the frequency of fH.

The above-described antifoggants each is added in an amount of about $3\times10^{-3}$ mol/mol-Ag (see, Table 3).

Antifoggant 1

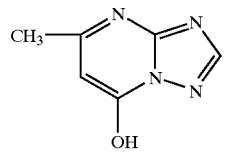

Antifoggant 2

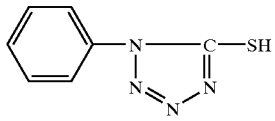

Antifoggant 3

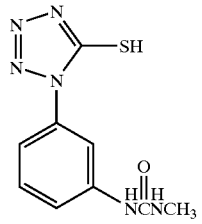

The change in fL of the emulsion $C_5$ when the pH and pAg are changed is shown in Tale 3 while comparing with the case of AgBr grain (X value in $10^X$ of fL value is shown) In Table 3, the results of a type emulsion and those where an $HNO_3$ solution was added to the type emulsion to adjust the pH to 3, an NaOH solution was added to adjust the pH to 10.4, an $AgNO_3$ solution was added to adjust the pAg to 2.2, a $Br^-$ solution was added for AgBr or an $I^-$ solution was added for AgI to adjust the pX to 2.0, or Antifoggant 1 or 2 was added in an amount of $3\times10^{-3}$ mol/mol-AgX, are shown. In the case of cubic AgBr, $B_6$ and octahedral AgBr, and $B_7$ and dodecahedral AgI, the pH was higher than the type emulsion and the $Agi^+$ concentration was decreased. This is considered to occur because —$NH_3^+$ of Gel, which renders $Ags^+$ ($Ag^+$ on the grain surface) unstable, is changed into —$NH_2$ by the elevation of pH and coordination-bonded to $Ags^+$, as a result, $Ags^+$ is stabilized and the equilibrium of $Ags^+$ $Agi^+$ is shifted left. In the case of $B_6$ and $B_7$, the pH was lower than the type emulsion and a phenomenon reversed to the above was generated, as a result, the $Agi^+$ concentration was increased. This is considered to occur because —$COO^-$ of Gel, which stabilizes $Ags^+$, is changed into —COOH by the lowering of pH and reduced in the activity of stabilizing $Ags^+$ and the equilibrium is shifted right. However, in the case of $C_5$, the concentration was decreased. This is considered to occur because AgI is high in the hydrophobicity and close to an organic compound and the stabilization effect by the intermolecular force with —COOH is larger than the stabilization effect by —$COO^-$. In the case of elevation of pH, the stabilization effect by the intermolecular force of nonionic —$NH_2$ is considered to be the cause. The mechanism of the dispersion medium stabilizing an atom on the grain surface includes the followings: 1) Coulomb interaction, 2) stabilization activity by the coordination bonding between an S, N or O atom having an electron pair and $Ag^+$ (including coordination bonding of $H_2O$), and 3) interaction by the intermolecular force between an organic compound having —COOH or a π conjugated bond and surface AgX. The contribution ratio of each activity differs between the AgBr system and the AgI system and this is considered to be ascribable to those results. *Kagaku Jiten, "Bunshikan Ryoku"* (*Dictionary of Chemistry, "Intermolecular Force"*), Tokyo Kagaku Dojin (1994) can be referred to for the intermolecular force.

In the case of $B_6$ and $B_7$, the $Ag^+$ concentration was higher and the $Agi^+$ concentration was decreased. This is considered to occur because $Ag^+$ is adsorbed to the grain surface and the grain as a whole is positively charged, as a result, the energy level (eV) of $Agi^+$ within the grain becomes high and the $Agi^+$ concentration is decreased. According to the Gauss law, the potential within the grain due to the surface charging is almost equipotential and the $Agi^+$ concentration decreases in all sites within the grain. The decrease in $Agi^+$ concentration is generally proportional to $\exp(-\Delta E/KT)$, wherein K represents the Boltzman's constant, T represents an absolute temperature, and the unit is KT eV. On the other hand, in the case of $C_5$, the $Agi^+$ concentration was conversely increased. The reasons therefor are as follows. The ionic interaction between AgI grain and $Ag^+$ is small and the level of increase is small. Therefore, the adsorbed $Ag^+$ becomes $Ags^+$, the equilibrium ($Ags^+ \rightleftharpoons Agi^+$) is shifted right and the concentration increases. In addition, because the AgI has a large lattice spacing, such an embodiment that the $Ag^+$ is directly got into the gap is considered. Because the AgI has a large covalent binding property in case of 4-coordination bond (the localization of bond electron is large), the AgI can be considered a kind of organic macromolecule. Accordingly, the above embodiment is such an embodiment that $Ag^+$ in the solution is soaked into intermolecular gap of the macromolecules. However, because the activity of $Agi^+$ is bound by interaction with the $I^-$, the activity shows the dielectric loss characteristics. When the $Br^-$ concentration was higher in $B_6$ and $B_7$, the $Agi^+$ concentration was increased. This seems to be ascribable to an effect reversed to the above.

In $C_5$, the $I^-$ concentration was higher and the $Agi^+$ concentration was slightly decreased. This is considered to result because $I^-$ is adsorbed to $Ags^+$ on the grain surface and the effect of decreasing the $Ags^+$ concentration is slightly surpassing.

Because the AgI has characteristics close to those of the organic macromelecule, the localization of electron is high and the electric conductivity property is low. Accordingly, the AgI is characterized in that the photoconductivity in the crystal is low as compared with those of AgCl and AgBr.

Therefore, the sensitivity of the AgI system differs from that of the AgBr system and an optimal combination of pH, pAg and pI of the emulsion must be selected. In Table 3, the pH of the type emulsion is 6.4 and the pAg thereof is neutral (pAg=pX).

TABLE 3

| | | fL Value (Value of x in $10^x$) and ΔE Value | | | | | | | |
|---|---|---|---|---|---|---|---|---|---|
| | | Diameter | Type, | $NHO_3$, | NaOH, | $AgNO_3$, | $X^-$, | Antifoggant ($3 \times 10^{-3}$ mol/mol AgX) | |
| | | (μm) | pH 6.4 | pH 3 | pH 10.4 | pAg 2.2 | pX 2.0 | 1 | 2 |
| AgBr | cubic | 0.5 | 5.0 | 5.48 | 4.77 | 4.3 | 5.18 | 4.5 | 3.81 |
| | octahedral | 0.5 | 5.65 | 5.90 | 5.74 | 4.66 | 5.88 | 3.8 | 3.74 |
| AgI | dodecahedral | 0.24 | 5.9 | 5.66 | 5.74 | 6.28 | 5.84 | 5.60 | 5.50 |
| ΔEeV | | — | 3-1 | 3-2 | 3-3 | 3-4 | 3-5 | 3-6 | 3-7 |
| 250° K or more | | | 0.496 | 0.457 | 0.478 | 0.509 | 0.447 | 0.489 | 0.501 |
| 250° K or less | | | 0.454 | 0.4317 | 0.459 | 0.422 | 0.447 | 0.462 | 0.472 |

An AgI dodecahedral grain having a β type content of about 100% is oriented on a glass plate and measured on the X-ray diffraction. Thereafter, the sample is annealed as it is at 250 to 300° C., rapidly cooled to form the grain into a γ type and measured on the X-ray diffraction. Then, the maximum diffraction peak at 21.3° is increased. From this, it is seen that the β-type (001) face is changed to the γ-type (111) face, in other words, the β-type [001] vector direction is changed to the γ-type [111] direction. This reveals that the β type and the γ type can be present together as a stacking defect for each other within one crystal. An actual example thereof is seen in ZnS crystal and is described, for example, in *Philosophical Magazine B,* 279–297 (2001). When the $Ag^+$ layer stacked position in the [001] direction of FIG. 7 is (ABABAB/CBABA) or (ABABAB/CBACBA), the portion of "/" is a twin plane.

As for the AgX emulsion of the present invention and the application thereof, in addition to those described above, the contents of JP-A-2000-201810 (paragraphs (0067) to (0087)) and JP-A-2001-255611 (item (1-8)) can be employed.

Furthermore, Publication 13 can be referred to for the application of the emulsion of the present invention to a heat-developable light-sensitive material and is incorporated herein by reference. As for the application to other light-sensitive materials, Publication 14 can be referred to.

PUBLICATIONS

1. B. L. J. Byerley et al., *Journal of Photographic Science*, Vol. 18, 53–59 (1970), U.S. Pat. Nos. 4,672,026, 4,414,310 and 4,184,878, and J. E. Maskasky, *Physical Review,* Vol. B43, 5769–5772 (1991).

2. J. E. Maskasky, *Phot. Sci. Eng.*, Vol. 25, 96–101 (1981), and U.S. Pat. Nos. 4,094,684, 4,142,900 and 4,459,353.

3. G. C. Farnell, *Journal of Photographic Science*, Vol. 22, 228–237 (1974).

4. *Research Disclosure*, Item 17643 (December, 1978), ibid., Item 38957 (September, 1996).

5. EP-A-930532 and JP-A-2000-347336.

6. Japanese Patent Application No. 2001-297023, JP-A-2001-201810, JP-A-2001-255611, JP-A-2000-347336, JP-A-8-69069 and U.S. Pat. No. 5,360,712.

7. Hiroshi Kubota et al. (compilers), *Kogaku Gijutsu Handbook* (*Handbook of Optical Technology*), Asakura Shoten (1975), and Shigeo Minami et al. (compilers), *Bunko Gijutsu Handbook* (*Handbook of Spectroscopical Technology*), Asakura Shoten (1990).

8. Kagaku Kogyo Kyokai (compiler), *Kagaku Sochi Binran* (*Handbook of Chemical Apparatus*), Chap. 21, Maruzen (1989).

9. Nippon Kagaku Kai (compiler), *Kagaku Binran, Kisohen* (*Handbook of Chemistry, Fundamental*), Maruzen (1984).

10. T. H. James and W. Vanslow, *Photo. Sci. Eng.,* Vol. 5, 21–29 (1961).

11. T. H. James (compiler), *The Theory of the Photographic Process,* 4th ed., Macmillan (1977).

12. Japanese Patent Application No. 2001-800 and JP-A-2000-221628.

13. Japanese Patent Application Nos. 2001-349031, 2001-342983 and 2001-335613, JP-A-2001-33911 and EP 1276007A1.

14. JP-A-59-119350, JP-A-59-119344 and U.S. Pat. No. 4,672,026.

EXAMPLE 1

Dispersion Medium Solution 1 (containing 25 g of Gelatin 1, 1,200 ml of water and 0.1 g of KI and having a pH of 6.0) was charged into a reaction vessel and while keeping the temperature at 75° C. and stirring, Solution Ag-1 (containing 3.4 g of $AgNO_3$ in 100 ml) and Solution X-1 (containing 3.36 g of KI in 100 ml) were simultaneously mixed and added at a flow rate of 4 ml/min for 10 minutes to form a seed crystal. After ripening for 2 minutes, Solution Ag-2 (containing 17 g of $AgNO_3$ in 100 ml) and Solution X-2 (containing 16.7 g of KI in 100 ml) were added at 75° C. by the CDJ method of keeping the silver potential (electric potential of metal silver electrode vs saturated calomel comparison electrode of 25° C.; two electrodes were connected by an agar bridge containing $KNO_3$) at −40 mV. Solution Ag-2 was added at a start flow rate of 2.4 ml/min with an accelerated flow rate of 0.16 ml/min for 98 minutes.

At this time, 1 ml of the emulsion was sampled and after Sensitizing Dye 1 was saturation-adsorbed thereto, centrifuged to remove gelatin. The emulsion was re-dispersed by adding water and one drop was placed on a mesh plate covered with a collodion film and dried. Thereafter, carbon vapor deposition, Au—Pd shadowing and fixing were performed and a transmission electron microphotograph (TEM image) of a replica film was taken. In the grains, the coefficient of variation in the dispersion of the diameter was 0.065 and the average diameter was 0.24 μm. As for the grain shape, the dodecahedral grain shown in (9) and FIGS. 2A to 2D occupied 99% or more of the total projected area of grains.

Solution X-2 was added by the CDJ method where on the basis that the addition rate (mol/sec) is equal to the addition rate (mol/sec) of Solution Ag-2, the addition rate thereof was increased in proportion to the potential difference when the silver potential becomes higher than −40 my, or decreased in proportion to the potential difference when the silver potential becomes lower than that. Due to the CDJ addition covering $k_2$ determined by a preliminary experiment as described in 1) of (II-4), the amplitude of electric potential during CDJ was from −14 to +14 mV based on −40 mV. Each solution was added directly into the solution through a hollow tube-type rubber perforated film having a pore number of 800. This film was produced by sticking a 0.5 mm-diameter needle to open pores. The pores were closed when those solutions were not added.

The solutions were added by an alternate addition method described in (78) where one solution is added alternately using two plunger pumps.

EXAMPLE 2

An emulsion grain was produced in the same manner as in Example 1 except for changing the CDJ addition and growth as follows. The addition form of Solution Ag-2 was the same but Solution X-2 was added at a start flow rate of 2.2 ml/min with an accelerated flow rate of 0.147 ml/min for 98 minutes in the simultaneous mixing and addition with Ag-2. At this time, Solution X-21 (containing 4.15 g of KI in 100 ml) was simultaneously mixed and added while controlling the addition rate and thereby the silver potential was controlled to −40 mV. The start flow rate was 0.8 ml/min and the control was begun from 10 seconds after the start of addition. The amplitude of the potential in this control method was from −14 to +14 mV based on −40 mV.

Figure 10:
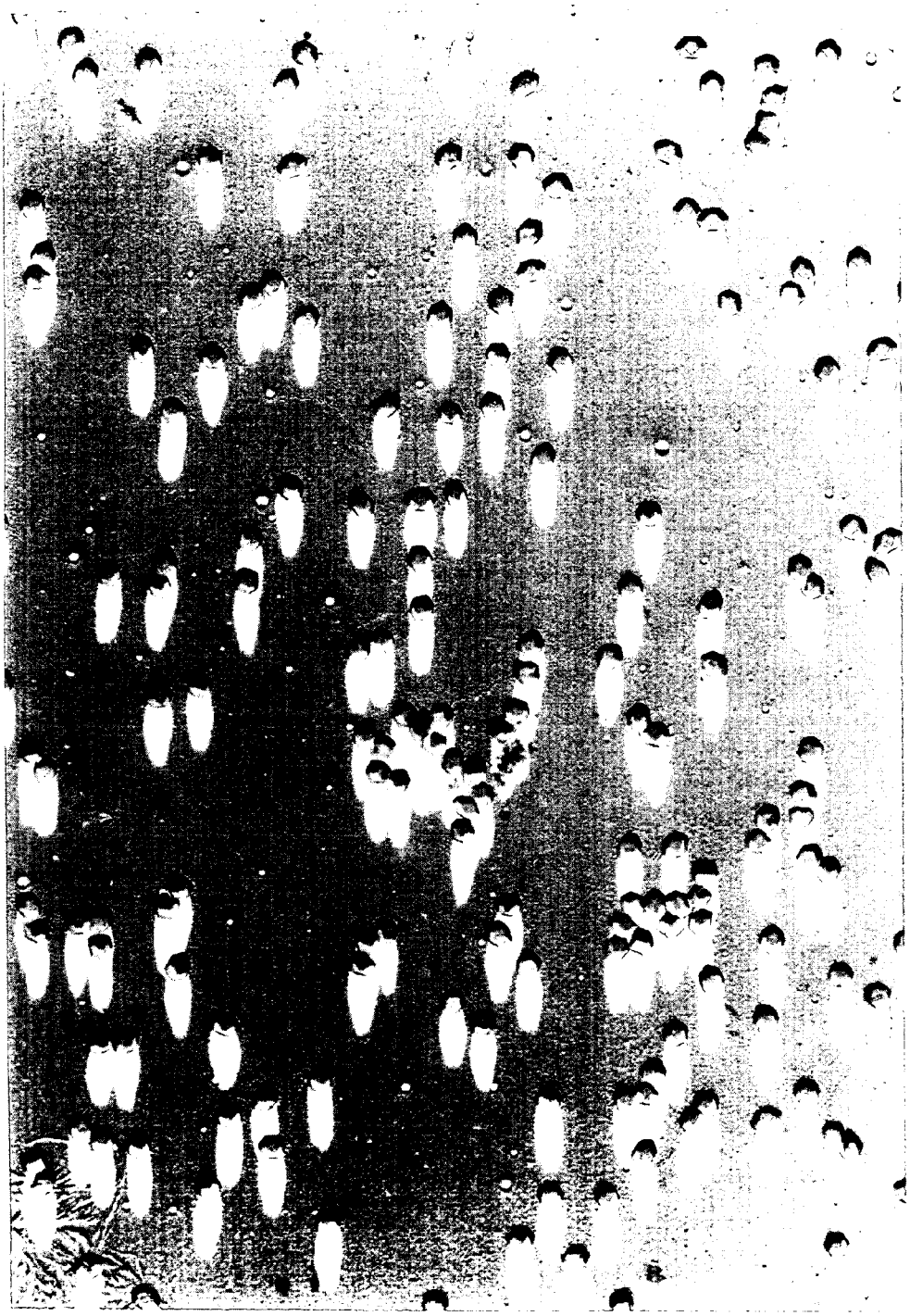
FIG. 10 is a TEM image of grains, showing a grain structure of an emulsion grain.

A TEM image of the obtained emulsion grains was taken as above and shown in FIG. 10. The average diameter was 0.24 μm and the coefficient of variation was 0.058. The dodecahedral grain occupied 99% or more of the total projected area of grains.

EXAMPLE 3

Dispersion Medium Solution 3 (containing 35 g of Gelatin 1, 1,500 ml of water and 0.05 g of KI and having a pH of 6.0) was charged into a reaction vessel and while keeping the temperature at 62° C. and stirring, Solution Ag-31 (containing 30 g of $AgNO_3$ in 100 ml) and Solution X-31 (containing 29.4 g of KI and 1 g of Gelatin 2 in 100 ml) were simultaneously mixed and added directly into the dispersion solution through the perforated film at 25 ml/min for 8 minutes.

Thereafter, these solutions were simultaneously mixed and added at a start flow rate of 25 ml/min with an accelerated flow rate of 3 ml/min for 4 minutes. Each solution was added by the alternate addition method.

A TEM image of the obtained emulsion grains was taken as above. The average diameter was 0.04 μm and the coefficient of variation in the diameter distribution was 0.10. Then, 80 ml of the emulsion was sampled and added to Dispersion Medium Solution 3 and thereto, Solution Ag-2 and Solution X-2 were added at 75° C. at a start flow rate of 3.4 ml/min with an accelerated flow rate of 0.24 ml/min for 50 minutes by the CDJ addition of −40 mV in the same manner as in Example 1. A TEM image of the obtained emulsion was taken as above, as a result, 98% or more of the projected area was occupied by the dodecahedral grain.

EXAMPLE 4

An emulsion grain was produced in the same manner as in Example 3 except for the followings. Solution Ag-31 and Solution X-31 were simultaneously mixed and added at an addition rate of 12 ml/min for 8 minutes. Thereafter, these solutions were simultaneously mixed and added at a start flow rate of 12 ml/min with an accelerated flow rate of 1.2 ml/min for 1.2 minutes. The average diameter of the obtained emulsion grains was 0.06 μm and the coefficient of variation in the diameter distribution was 0.09. These grains were grown in the same manner as in Example 3, as a result, 99% or more of the projected area was occupied by the dodecahedral grain.

EXAMPLE 5

Dispersion Medium Solution 5 (a solution obtained by dissolving 1.2 g of $AgNO_3$ in a solution containing 25 g of Gelatin 1 and 1,200 ml of water and being adjusted to a pH of 10.0 with NaOH) was charged into a reaction vessel and while keeping the temperature at 75° C. and stirring, Solution Ag-1 and Solution X-41 (containing 3.3 g of KI in 100 ml) were simultaneously mixed and added at 4 ml/min for 10 minutes. Thereafter, Solution Ag-2 and Solution X-42 (containing 16.56 g of KI in 100 ml) were added in the same manner as in Example 1 by the CDJ addition of keeping the silver potential at 360 mV. Solution Ag-2 was added at a start flow rate of 2.4 ml/min with an accelerated flow rate of 0.16 ml/min for 98 minutes.

Figure 11:
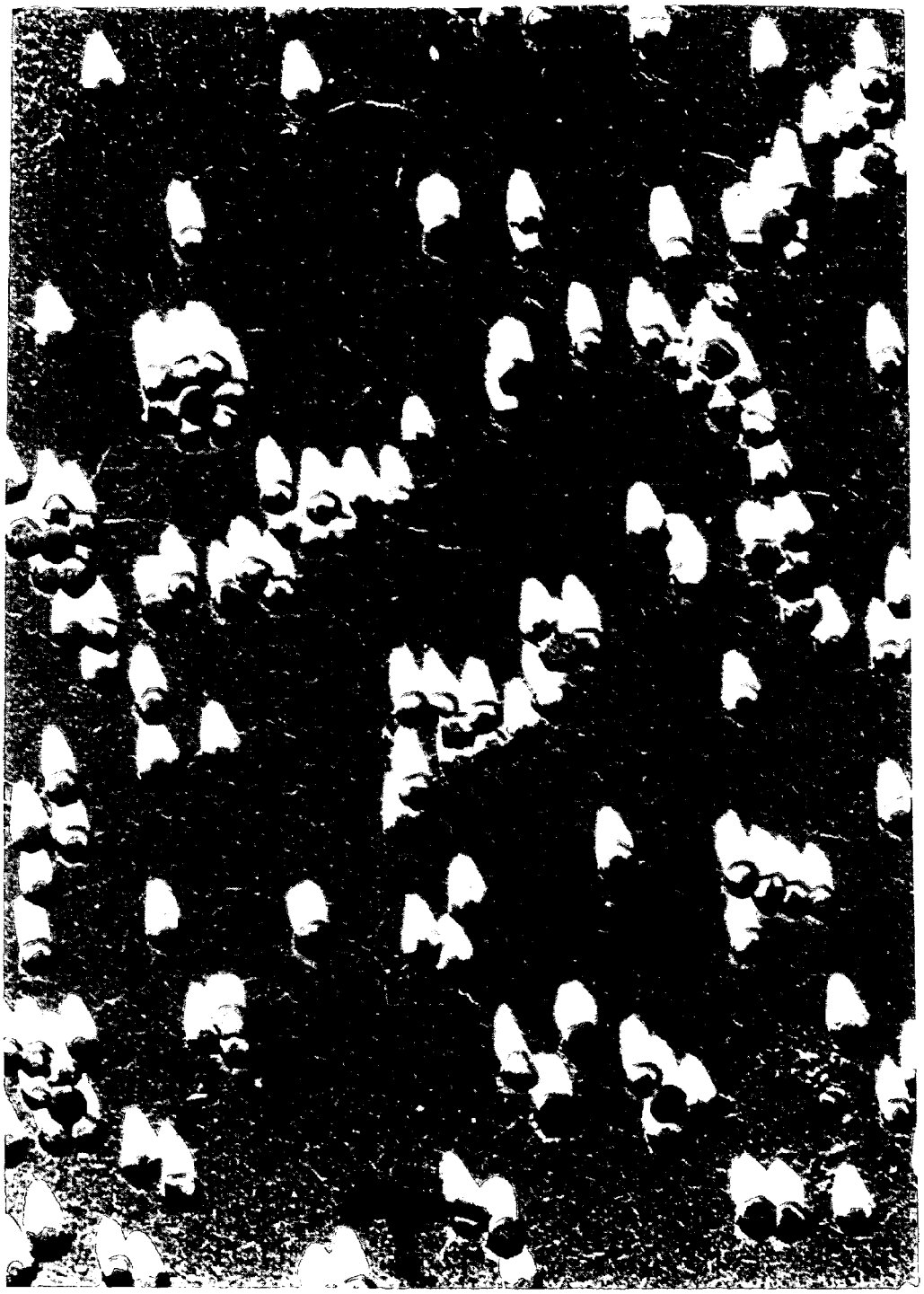
FIG. 11 is a TEM image of grains, showing a grain structure of an emulsion grain.

A TEM image of the obtained emulsion grains was taken as above and shown in FIG. 11. The grain structure was the elliptic sphere of (33) where the average $A_5$ value was about 1.16. The average diameter was 0.34 μm and the coefficient of variation in the diameter distribution was 0.08. The grain of (33) occupied 97% or more of the total projected area of grains.

These grains were grown under the condition $C_5$ of Table 1 by CDJ of −40 mV in the same manner as in Example 3, as a result, 96% or more of the total projected area was occupied by the dodecahedral grain.

EXAMPLE 6

Dispersion Medium Solution 6 (a solution obtained by dissolving 1.2 g of $AgNO_3$ in a solution containing 25 g of Gelatin 1 and 1,200 ml of water and being adjusted to a pH of 2.0 with $HNO_3$) was charged into a reaction vessel and while keeping the temperature at 75° C. and stirring, Solution Ag-1 and Solution X-41 were simultaneously mixed and added at 4 ml/min for 10 minutes. Thereafter, Solution Ag-2 and Solution X-42 were added in the same manner as in Example 1 by the CDJ addition of keeping the silver potential at 391 mV. Solution Ag-2 was added at a start flow rate of 2.4 ml/min with an accelerated flow rate of 0.16 ml/min for 98 minutes.

A TEM image of the obtained emulsion grains was taken as above. The grain shape was the hexagonal columnar grain shown in FIG. 6D. The average diameter was 0.65 μm, the average thickness was 0.26 μm and the coefficient of variation in the diameter distribution was 0.14. This grain occupied 96% or more of the total projected area of all grains.

EXAMPLE 7

Figure 12:
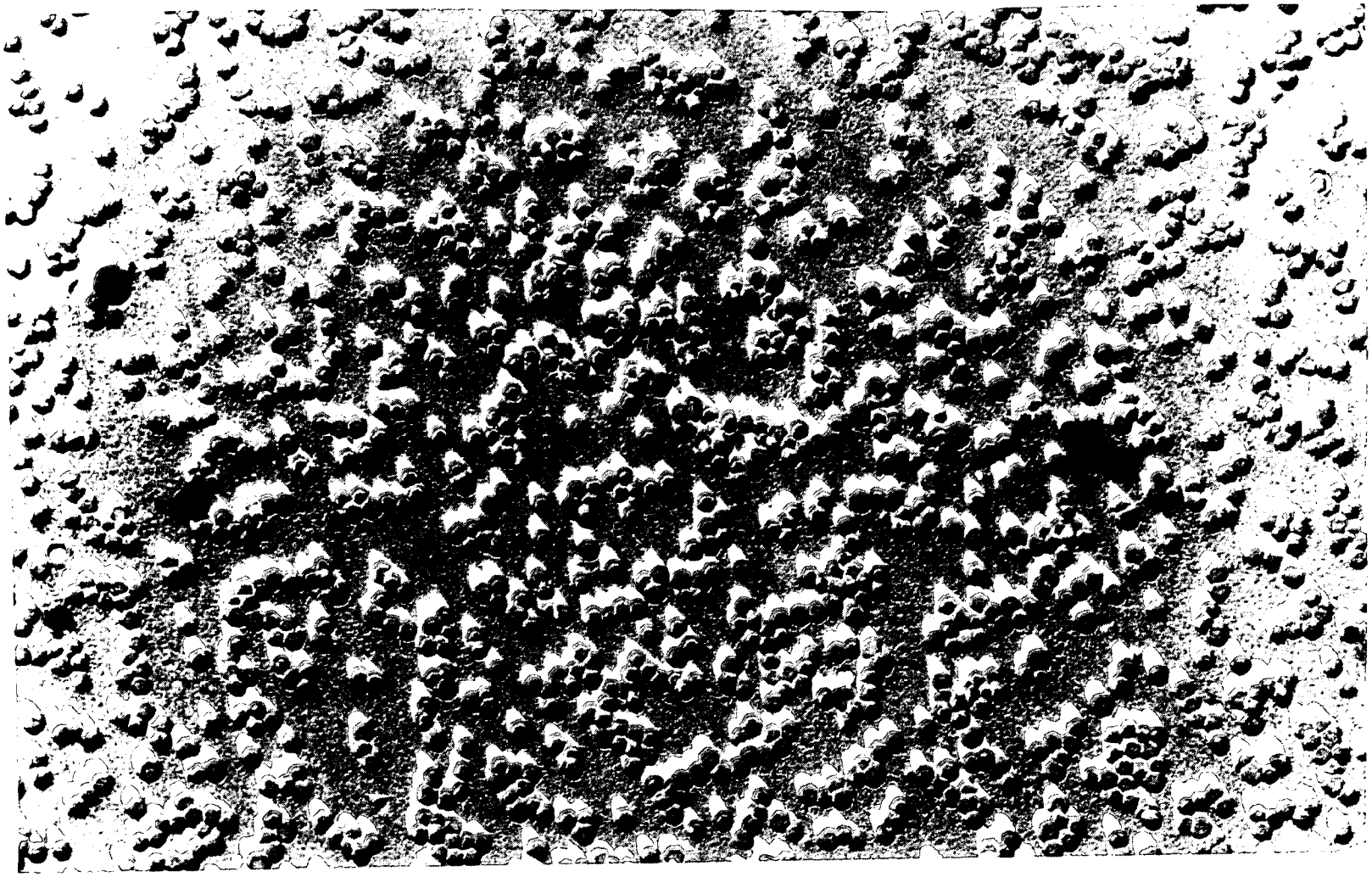
FIG. 12 is a TEM image of grains, showing a grain structure of an emulsion grain.

Dispersion Medium Solution 1 was charged into a reaction vessel and while keeping the temperature at 40° C. and stirring throughout, Solution Ag-1 and Solution X-1 were simultaneously mixed and added at 4 ml/min for 8 minutes. Thereafter, the temperature was elevated to 75° C. and Ag-2 and X-2 were added in the same manner as in Example 1 by the CDJ addition of −40 mV for 90 minutes. Ag-2 was added at a start flow rate of 2.4 ml/min with a linearly accelerated flow rate of 0.24 ml/min. Subsequently, 1 ml of the emulsion was sampled and a TEM image of the replica film of grains was taken and shown in FIG. 12. The coefficient of variation in the dispersion of the grain diameter was 0.06, the average diameter was 0.21 pm and the grain shape was an asymmetric tetradecahedral grain shown in FIGS. 4A to 4D. The coefficient of variation in the diameter distribution was 0.087, the average value of $A_6$ described in (37) was about 0.27 and the coefficient of variation in the distribution of the dispersion of $A_6$ was 0.12.

Thereafter, the emulsion was subjected to water washing, re-dispersion, chemical sensitization, spectral sensitization and addition of additives in the same manner as in Example 1 and coated on a PET base to obtain a sample.

EXAMPLE 8

Dispersion Medium Solution 8 (containing 30 g of Gelatin 1, 1,300 ml of water and 0.05 g of KI and having a pH of 6.0) was charged into a reaction vessel and while keeping the temperature at 40° C. and stirring, Solution Ag-2 and Solution X-2 were simultaneously mixed and added at 8 ml/min for 8 minutes. Thereafter, the temperature was elevated to 75° C. and Solution Ag-2 and Solution X-2 were added in the same manner as in Example 1 by the CDJ addition of −40 mV for 18 minutes. The start flow rate was 24 ml/min and the linearly accelerated flow rate was 2.4 ml/min.

Figure 13:
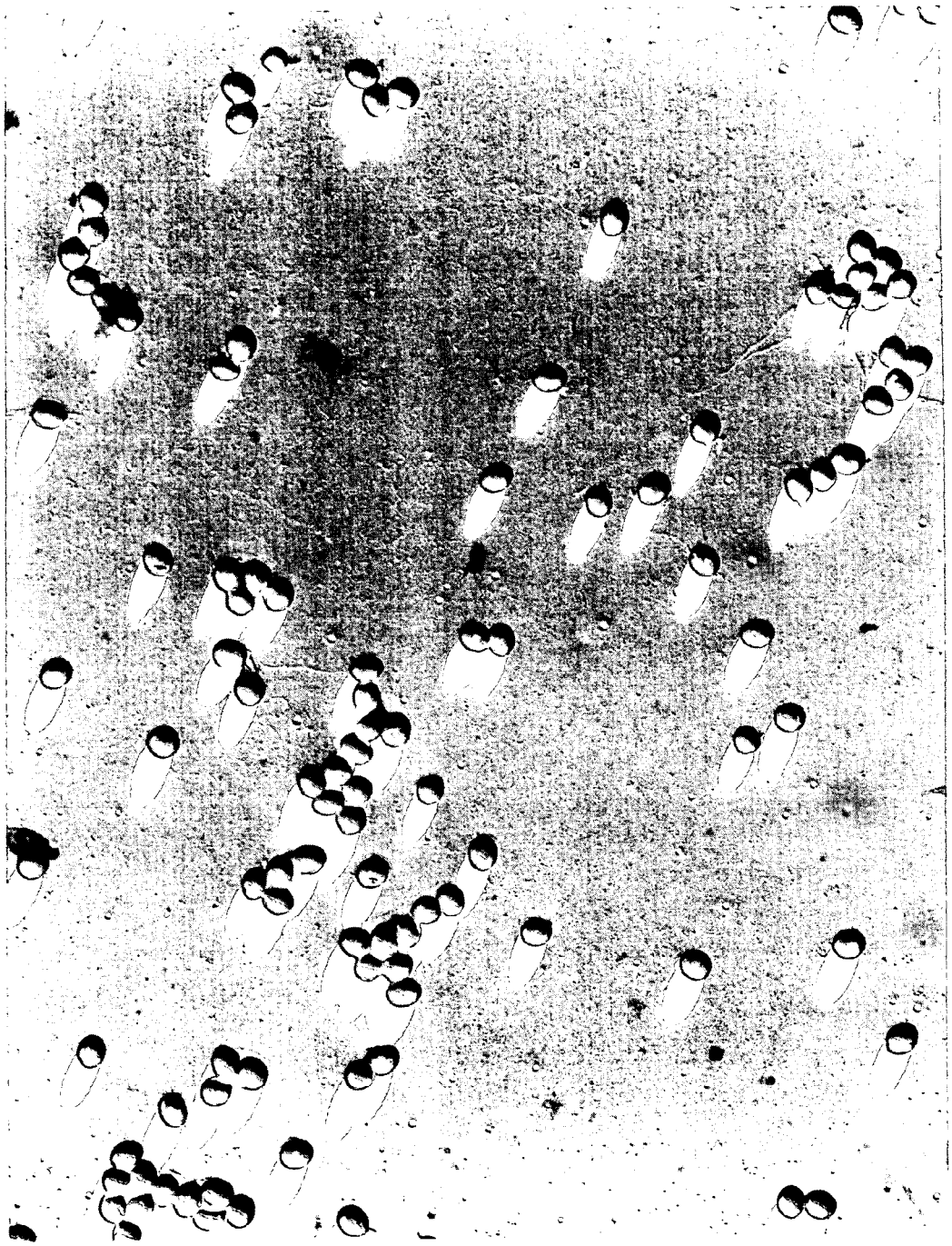
FIG. 13 is a TEM image of grains, showing a grain structure of an emulsion grain.

Subsequently, 1 ml of the emulsion was sampled and a TEM image of the replica film of grains was taken and shown in FIG. 13. The grain was an asymmetric tetradecahedral grain. The average diameter was 0.12 μm, the coefficient of variation in the diameter distribution was 0.11, the average $A_6$ value was about 0.32 and the coefficient of variation in the distribution of the dispersion of $A_6$ was 0.14.

EXAMPLE 9

Dispersion Medium Solution 9 (containing 25 g of Gelatin 2 and 0.05 g of KI and having a pH of 6.0) was charged into a reaction vessel and while keeping the temperature at 18° C. and stirring, Solution Ag-2 and Solution X-2 were added at 5 ml/min for 5 minutes. Thereafter, Solution Ag-2 and Solution X-2 were added in the same manner as in Example 1 by the CDJ addition at a silver potential of −40 mV. Solution Ag-2 was added at a start flow rate of 5 ml/min with an accelerated flow rate of 0.7 ml/min for 28 minutes.

At this time, 1 ml of the emulsion was sampled, gelatin was removed in the same manner as in Example 1, the grain was placed on a collodion film-covered and carbon-deposited mesh, dried and cooled to about −130° C., and then a TEM image was taken. The average diameter of grains was 0.026 μm and the coefficient of variation in the diameter distribution was 0.11.

EXAMPLE 10

Dispersion Medium Solution 9 was charged into a reaction vessel and while keeping the temperature at 18° C. and stirring, Solution Ag-1 and Solution X-3 (containing 3.36 g of KI and 1 g of Gelatin 2 in 100 ml and having a pH of 6.0) were added at a start flow rate of 1 ml/min with an accelerated flow rate of 12 ml/min for 2 minutes. Subsequently, these solutions were simultaneously mixed and added at 25 ml/min for 5 minutes. Thereafter, Solution Ag-2 and Solution X-2 were added in the same manner as in Example 1 by the CDJ addition at a silver potential of −40 mV. Solution Ag-2 was added at a start flow rate of 5 ml/min with an accelerated flow rate of 0.7 ml/min for 28 minutes.

A TEM image of the produced grains was taken in the same manner as in Example 9. The average diameter of grains was 0.024 μm and the coefficient of variation in the diameter distribution was 0.09.

Here, Gelatin 1=an empty gelatin resulting from desalting by passing an alkali-treated cow bone gelatin through an ion exchange resin, and Gelatin 2=[$HNO_3$ was added to an aqueous solution containing Gelatin 1 to adjust the pH to 0.7, the solution was hydrolyzed at 90° C. to a mass average molecular weight of 15,000, desalted by ultra-filtration to remove 95% of the acid added, and neutralized to a pH of 6.0 with NaOH, $H_2O_2$ was added and mixed, and the solution was left standing at 40° C. for 15 hours, as a result, 100% of Met was changed into a sulfinyl group].

COMPARATIVE EXAMPLE 1

Dispersion Medium Solution 11 (containing 25 g of Gelatin 1, 1,200 ml of water and 2 g of KI and having a pH of 6.0) was charged into a reaction vessel and while keeping the temperature at 75° C., Solution Ag-1 and Solution X-1 were simultaneously mixed and added at 4 ml/min for 10 minutes. Thereafter, Solution Ag-2 and Solution X-2 were added according to a conventional method by the CDJ addition of keeping the silver potential at −40 mV. Solution Ag-2 was added at a start flow rate of 2.4 ml/min with an accelerated flow rate of 0.16 ml/min for 98 minutes. The amplitude of the silver potential during CDJ was always 70 mV or more (140 mV or more in total) based on the set value.

A TEM image of the replica film of produced grains was taken, as a result, this was a polydisperse grain containing grains having three or more kinds of shapes, where the average diameter was 0.6 μm and the coefficient of variation in the diameter distribution was 0.4.

Coagulation Precipitant 1 was added to each of the emulsions obtained in Examples 1 to 10 and Comparative Example 1, the temperature was lowered to 30° C. and the pH was also lowered to near 4.0, thereby floccing and precipitating the emulsion. The supernatant was removed and the emulsion was washed with water three times and then re-dispersed by elevating the pH to 6.4 and the temperature to 40° C. The pAg of the emulsion was adjusted to 5.5 using an $AgNO_3$ solution and a KI solution. Sensitizing Dye 1 was added at 40° C. in an amount of 85% of the saturated adsorption amount to bring about adsorption equilibrium. Thereafter, the temperature was elevated to 60° C., Chemical Sensitizer 1 was added in an amount of $3.5\times10^{-4}$ mol/mol-AgX and the emulsion was ripened for 50 minutes. The temperature was lowered to 40° C., Antifoggant 3 was added in an amount of $3\times10^{-3}$ mol/mol-AgX, and the emulsion was adjusted to a pH of 6.4 and a pAg of 5.5 in the same manner as above and then stirred for 30 minutes.

The resulting emulsion was coated on a PET base together with a protective layer containing Hardening Agent 1 (0.01 g/g-gelatin) and dried. The coating was placed in a closed container and held at 40° C. for 15 hours, thereby accelerating the film hardening reaction. The coated materials of respective emulsions of Examples 1 to 10 are designated as Samples 1 to 10 and the coated material of the emulsion of Comparative Example 1 was designated as Comparison 1.

COMPARATIVE EXAMPLE 11

AgI Emulsions $B_{11}$ and $B_{12}$ were prepared in the same manner as in Examples 3 and 4 except for replacing the gelatin used by Gelatin 3. In the produced grains of B11, the average diameter was 0.05 μm and the coefficient of variation in the diameter distribution was 0.10. In the produced grains of $B_{12}$, the average diameter was 0.08 μm and the coefficient of variation was 0.09. Then, 80 ml of each emulsion was added to Dispersion Medium Solution 3 and the grains were grown in the same manner as in Example 3, as a result, in both emulsions, 99% or more of the projected area was occupied by the dodecahedral grain.

Gelatin 3=a gelatin obtained by allowing a phthalic anhydride to act on Gelatin 1 to a phthalation degree of 83%.

$B_{11}$ and $B_{12}$ each was adjusted to a pH of 4 by adding $HNO_3$, thereby floccing and precipitating the emulsion. The supernatant was removed and the emulsions each was washed with water three times. After the water washing, the emulsions each was subjected to treatments such as re-dispersion in the same manner as above to obtain Coated Samples $B_{11}$ and $B_{12}$.

Each coated sample was exposed through an optical wedge to obtain a sample exposed to blue light (light at a wavelength of 450 nm or less) for $10^{-2}$ seconds and a sample exposed to minus blue light (light at a wavelength of 500 nm or more). These samples each was developed at 40° C. for 50 minutes with a pyrogallol developer described in Publication 10, dipped in a stopping solution for 1 minute, fixed by dipping the sample in a fixing solution (Super Fuji Fix) for 30 minutes, washed with water, dried and then subjected to sensitometry. The results of (sensitivity/granularity) ratio are shown in Table 4. It is verified that the samples of the present invention are excellent in (sensitivity/granularity) as compared with the comparative sample.

The sensitivity is shown by a reciprocal of the exposure amount (lux•sec) necessary for giving a density of (fog+0.2). As for the granularity, each sample was exposed uniformly for $10^{-2}$ second at an light intensity necessary for giving a density of (fog+0.2) and developed. The dispersion of density was measured by a micro-densitometer using a circular aperture having a diameter of 48 μm and the rms granularity σ was determined. This is described in detail in Publication 11, Chap. 21, Par. E.

Coagulation Precipitant 1

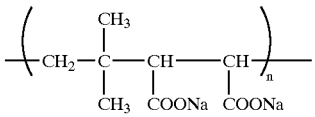

average molecular weight: $1.2\times10^5$

Sensitizing Dye 1

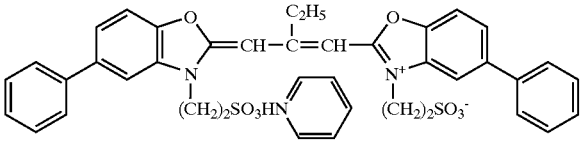

Chemical Sensitizer 1

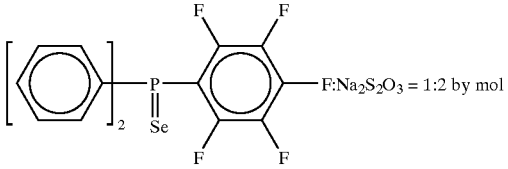

F:$Na_2S_2O_3$ = 1:2 by mol

Hardening Agent 1

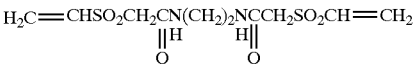

TABLE 4

| | Blue Light Exposure (sensitivity/granularity) | Minus Blue Light Exposure (sensitivity/granularity) |
|---|---|---|
| Sample 1 | 210 | 208 |
| 2 | 220 | 218 |
| 3 | 195 | 192 |
| 4 | 200 | 197 |
| 5 | 190 | 188 |
| 6 | 180 | 177 |
| 7 | 160 | 158 |
| 8 | 150 | 148 |
| 9 | 130 | 127 |
| 10 | 143 | 141 |
| $B_{11}$ | 202 | 200 |
| $B_{12}$ | 207 | 205 |
| Comparative Example 1 | 100 | 100 |

By using the AgX emulsion of the present invention or a photographic light-sensitive material containing the emulsion, an AgX photographic light-sensitive material excellent in the (sensitivity/granularity) ratio can be obtained.

EXAMPLE 12

(Preparation of PET Support)

PET having an intrinsic viscosity IV of 0.66 (measured at 25° C. in phenol/tetrachloroethane=6/4 (by weight)) was obtained in a usual manner using terephthalic acid and ethylene glycol. This PET was pelletized and the pellets obtained were dried at 130° C. for 4 hours, melted at 300° C., extruded from a T-die and then rapidly cooled to prepare an unstretched film having a thickness large enough to give a film thickness of 175 μm after the heat setting.

This film was stretched to 3.3 times in the machine direction using rollers different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was taken up at 4 kg/cm$^2$ to obtain a roll having a thickness of 175 μm.

(Surface Corona Treatment)

Both surfaces of the support were treated at room temperature at 20 m/min using a solid state corona treating machine Model 6KVA manufactured by Pillar Technologies. From the current and voltage read at this time, it was known that a treatment of 0.375 kV·A·min/m$^2$ was applied to the support. The frequency at this treatment was 9.6 kHz and the gap clearance between the electrode and the dielectric roller was 1.6 mm.

(Preparation of Undercoated Support)

(1) Preparation of Coating Solution for Undercoat Layer

Formulation (1) (for Undercoat Layer in the Light-sensitive Layer Side):

| | |
|---|---|
| PESRESIN A-520 (30 mass % solution) produced by Takamatsu Yushi K.K. | 59 g |
| Polyethylene glycol monononylphenyl ether (average ethylene oxide number: 8.5), 10 mass % solution | 5.4 g |

-continued

| | |
|---|---|
| MP-1000 (polymer fine particles, average particle size: 0.4 μm) produced by Soken Kagaku K.K. | 0.91 g |
| Distilled water | 935 ml |

Formulation (2) (for First Layer on the Back Surface):

| | |
|---|---|
| Styrene-butadiene copolymer latex (solid content: 40 mass %, styrene/butadiene ratio by mass: 68/32) | 158 g |
| 2,4-Dichloro-6-hydroxy-S-triazine sodium salt, 8 mass % aqueous solution | 20 g |
| Sodium laurylbenzenesulfonate (1 mass % aqueous solution) | 10 ml |
| Distilled water | 854 ml |

Formulation (3) (for Second Layer on the Back Surface):

| | |
|---|---|
| $SnO_2$/SbO (9/1 by mass, average particle size: 0.038 μm, 17 mass % dispersion) | 84 g |
| Gelatin (10 mass % aqueous solution) | 89.2 g |
| METROSE TC-5 produced by Shin-Etsu Chemical Co., Ltd. (2 mass % aqueous solution) | 8.6 g |
| MP-1000 produced by Soken Kagaku K.K. | 0.01 g |
| Sodium dodecylbenzenesulfonate (1 mass % aqueous solution) | 10 ml |
| NaOH (1 mass %) | 6 ml |
| PROXEL (produced by ICI) | 1 ml |
| Distilled water | 805 ml |

Both surfaces of the 175 μm-thick biaxially stretched polyethylene terephthalate support obtained above each was subjected to the above-described corona discharge treatment and on one surface (light-sensitive layer surface), the undercoating solution of formulation (1) was applied by a wire bar to have a wet coated amount of 6.6 ml/m$^2$ (per one surface) and dried at 180° C. for 5 minutes. Thereafter, on the opposite surface thereof (back surface), the undercoating solution of formulation (2) was applied by a wire bar to have a wet coated amount of 5.7 ml/m$^2$ and dried at 180° C. for 5 minutes. On this opposite surface (back surface), the undercoating solution of formulation (3) was further applied by a wire bar to have a wet coated amount of 7.7 ml/m$^2$ and dried at 180° C. for 6 minutes, thereby obtaining an undercoated support.

(Preparation of Coating Solution for Back Surface)

(Preparation of Solid Fine Particle Dispersion (a) of Base Precursor)

Base Precursor Compound 1 (1.5 kg), 225 g of surfactant (Demol N, trade name, produced by Kao Corporation), 937.5 g of diphenylsulfone and 15 g of butyl parahydroxybenzoate (Mekkins, trade name, produced by Ueno Seiyaku) were mixed and distilled water was added to make a total amount of 5.0 kg. The mixed solution was dispersed using beads in a horizontal sand mill (UVM-2, manufactured by AIMEX K. K.). More specifically, the mixed solution was fed to UVM-2 filled with zirconia beads having an average diameter of 0.5 mm by a diaphragm pump and dispersed under an internal pressure of 50 hPa or more until a desired average particle size was obtained.

The dispersion was measured on the spectral absorption and dispersed until the ratio ($D_{450}/D_{650}$) of the absorbance at 450 nm to the absorbance at 650 nm in the spectral absorption of the dispersion became 2.2 or more. The obtained dispersion was diluted with distilled water to a concentration of 20 wt % in terms of the concentration of the base precursor, filtered (through a polypropylene-made filter having an average pore size of 3 μm) to remove dust and then used in practice.

(Preparation of Solid Fine Particle Dispersion of Dye)

Cyanine Dye Compound 1 (6.0 kg), 3.0 kg of sodium p-dodecylbenzenesulfonate, 0.6 kg of a surfactant Demol SNB (produced by Kao Corporation) and 0.15 kg of a defoaming agent (Surfinol 104E, trade name, produced by Nisshin Kagaku K. K.) were mixed with distilled water to make a total liquid amount of 60 kg. The mixed solution was dispersed using zirconia beads of 0.5 mm in a horizontal sand mill (UVM-2, manufactured by AIMEX K. K.).

The dispersion was measured on the spectral absorption and dispersed until the ratio ($D_{650}/D_{750}$) of the absorbance at 650 nm to the absorbance at 750 nm in the spectral absorption of the dispersion became 5.0 or more. The obtained dispersion was diluted with distilled water to a concentration of 6 mass % in terms of the concentration of the cyanine dye, filtered (average pore size: 1 μm) to remove dust and then used in practice.

(Preparation of Coating Solution for Antihalation Layer)

Gelatin (30 g), 24.5 g of polyacrylamide, 2.2 g of 1 mol/liter caustic soda, 2.4 g of monodisperse polymethyl methacrylate fine particles (average particle size: 8 μm, standard deviation of particle size: 0.4), 0.08 g of benzoisothiazolinone, 35.9 g of the solid fine particle dispersion of dye obtained above, 74.2 g of Solid Fine Particle Dispersion (a) of base precursor obtained above, 0.6 g of sodium polyethylenesulfonate, 0.21 g of Blue Dye Compound 1, 0.15 g of Yellow Dye Compound 1 and 8.3 g of an acrylic acid/ethyl acrylate copolymer latex (copolymerization ratio: 5/95) were mixed and water was added to make a total of 8,183 ml, thereby preparing a coating solution for antihalation layer.

(Preparation of Coating Solution for Protective Layer on Back Surface)

In a container kept at 40° C., 40 g of gelatin, 1.5 g (as liquid paraffin) of liquid paraffin emulsion, 35 mg of benzoisothiazolinone, 6.8 g of 1 mol/liter caustic soda, 0.5 g of sodium tert-octylphenoxyethoxyethanesulfonate, 0.27 g of sodium polystyrenesulfonate, 37 mg of Fluorine-Containing Surfactant (F-1) (N-perfluorooctylsulfonyl-N-propylalanine potassium salt), 150 mg of Fluorine-Containing Surfactant (F-2) (polyethylene glycol mono(N-perfluorooctylsulfonyl-N-propyl-2-aminoethyl) ether [ethylene oxide average polymerization degree: 15]), 64 mg of Fluorine-Containing Surfactant (F-3), 32 mg of Fluorine-Containing Surfactant (F-4), 6.0 g of an acrylic acid/ethyl acrylate copolymer (copolymerization ratio by weight: 5/95) and 2.0 g of N,N-ethylenebis(vinylsulfonacetamide) were mixed and water was added to make 10 liter, thereby preparing a coating solution for protective layer on the back surface.

(Preparation of Silver Halide Emulsion)

<Preparation of Silver Halide Emulsion 1A>

To Solution A obtained by adding 30 g of lime-processed gelatin to 1,200 ml of distilled water, an aqueous solution containing 0.014 mol of silver nitrate and Aqueous Solution B containing 0.0147 mol of potassium iodide were simultaneously added and mixed at 50° C. while vigorously stirring. Subsequently, while stirring at 75° C., an aqueous solution containing 0.794 mol of silver nitrate was added at a constant flow rate and at the same time, Aqueous Solution C of 1.1 mol/liter potassium iodide was added by a controlled double jet method while maintaining the pAg at 6.5. The pH was adjusted to 4.0 by using a sulfuric acid with a concentration of 0.5 mol/liter, then the stirring was stopped, and precipitation/desalting/water washing were performed. Subsequently, the pH was adjusted to 5.9 using sodium hydroxide with a concentration of 1 mol/liter to prepare Silver Halide Emulsion 1A. In the obtained silver halide emulsion, the average equivalent-sphere diameter of grains was 0.16 μm and the coefficient of variation in the equivalent-sphere diameter was 20%. The tetradecahedral grain of the present invention was not observed in this emulsion. The properties of emulsion are shown in Table 5.

<Preparation of Silver Halide Emulsion 1B>

Silver Halide Emulsion 1B was prepared in the same manner as in the preparation of Silver halide Emulsion 1A except that 0.02 g of potassium iodide was added to Aqueous Gelatin Solution A, the liquid temperature at the addition of Aqueous Solution B was changed to 40° C., and Aqueous Solution C was added by a controlled double jet method while keeping the pAg at 8.1. In the silver halide emulsion obtained, the average equivalent-sphere diameter of grains was 0.16 μm and the coefficient of variation in the equivalent-sphere diameter was 15%. In this emulsion, 52% of the projected area of all grains was occupied by the tetradecahedral grain of the present invention having crystal faces of (001) {100} {101}. The properties of the emulsion are shown in Table 5.

TABLE 5

| | Percentage of Tetradecahedral Grain (%) | Percentage of β Type (%) | Grain Size (μm) | Coefficient of Variation in Average Equivalent-Sphere Diameter (%) | Average Aspect Ratio |
|---|---|---|---|---|---|
| Emulsion 1A (Comparison) | 0 | 55 | 0.16 | 20 | — |
| Emulsion 1B (Invention) | 52 | 60 | 0.16 | 15 | 1.2 |
| Emulsion 1C (Invention) | 80 | 80 | 0.16 | 12 | 0.5 |

<Preparation of Silver Halide Emulsion IC>

Silver Halide Emulsion 1C was prepared in the same manner as in the preparation of Silver halide Emulsion 1B except that Aqueous Gelatin Solution A was adjusted to a pH of 6.0 at 40° C. and the addition time of Aqueous Solution B and the aqueous silver nitrate solution simultaneously added was prolonged to 2 times. In the silver halide emulsion obtained, the average equivalent-sphere diameter of grains was 0.16 μm and the coefficient of variation in the equivalent-sphere diameter was 12%. In this emulsion, 80% of the projected area of all grains was occupied by the tetradecahedral grain of the present invention having crystal faces of (001) {100} {101}. The properties of the emulsion are shown in Table 5.

<Preparation of Emulsion 1A for Coating Solution>

To Silver Halide Emulsion 1A, a 1 mass % aqueous solution of benzothiazolium iodide was added in an amount of $7\times10^{-3}$ mol per mol of silver. Furthermore, water was added to adjust the silver halide content to 38.2 g in terms of silver per kg of the emulsion for coating solution.

<Preparation of Emulsion 1B for Coating Solution>

Emulsion 1B for Coating Solution was prepared in the same manner as Emulsion 1A for Coating Solution except for changing Silver halide Emulsion 1A to Silver Halide Emulsion 1B.

<Preparation of Emulsion IC for Coating Solution>

Emulsion 1C for Coating Solution was prepared in the same manner as Emulsion 1A for Coating Solution except for changing Silver halide Emulsion 1A to Silver Halide Emulsion 1C.

(Preparation of Fatty Acid Silver Salt Dispersion A)

Behenic acid (87.6 kg, Edenor C22–85R, product name, produced by Henkel Co.), 423 liter of distilled water, 49.2 liter of an aqueous NaOH solution in a concentration of 5 mol/liter, and 120 liter of tert-butyl alcohol were mixed. The mixture was reacted by stirring at 75° C. for one hour to obtain Sodium Behenate Solution A. Separately, 206.2 liter (pH 4.0) of an aqueous solution containing 40.4 kg of silver nitrate was prepared and kept at 10° C. A reaction vessel containing 635 liter of distilled water and 30 liter of tert-butyl alcohol was kept at 30° C. and while thoroughly stirring, the entire amount of Sodium Behenate Solution A obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution A was started, and only Sodium Behenate Solution A was added for the period of 14 minutes and 15 second after the completion of addition of the aqueous silver nitrate solution. During the addition, the temperature inside the reaction vessel was kept at 30° C. and the outer temperature was controlled to make constant the liquid temperature. The piping in the system of adding Sodium Behenate Solution A was kept warm by circulating hot water in the outer side of a double pipe, whereby the outlet liquid temperature at the distal end of the addition nozzle was adjusted to 75° C. The piping in the system of adding the aqueous silver nitrate solution was kept warm by circulating cold water in the outer side of a double pipe. The addition site of Sodium Behenate Solution A and the addition site of aqueous silver nitrate solution were symmetrically arranged with the center laid on the stirring axis. Also, these addition sites were each adjusted to a height of not causing contact with the reaction solution.

After the completion of addition of Sodium Behenate Solution A, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 $\mu$S/cm. In this manner, a fatty acid silver salt was obtained. The solid content obtained was not dried but stored as a wet cake.

The shape of the thus-obtained silver behenate grains was evaluated by electron microphotography, as a result, the grains were scaly crystals having average sizes of a=0.14 $\mu$m, b=0.4 $\mu$m and c=0.6 $\mu$m, an average aspect ratio of 5.2, an average equivalent-sphere diameter of 0.52 $\mu$m and a coefficient of variation in the equivalent-sphere diameter of 15% (a, b and c comply with the definition in this specification).

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Kogyo).

Then, the preliminarily dispersed stock solution was treated three times in a dispersing machine (Microfluidizer M-610, trade name, manufactured by Microfluidex International Corporation, using a Z-type interaction chamber) under the control of pressure to 1,260 kg/cm$^2$ to obtain a silver behenate dispersion. At the dispersion, the temperature was set to 18° C. by a cooling operation of controlling the coolant temperature using coiled heat exchangers attached to the inlet side and outlet side of the interaction chamber.

<Preparation of Fatty Acid Silver Salt Dispersion B>

(Preparation of Recrystallized Behenic Acid)

Behenic acid (100 kg, Edenor C22–85R, product name, produced by Henkel Co.) was mixed with 1,200 kg of isopropyl alcohol and the mixture was dissolved at 50° C. and filtered through a filter of 10 $\mu$m. Thereafter, the filtrate was cooled to 30° C. and recrystallized. At the recrystallization, the cooling speed was controlled to 3° C./hour. The obtained crystals were filtered by centrifugation, washed by splashing 100 kg of isopropyl alcohol thereon and then dried. The resulting crystals were esterified and analyzed by GC-FID, as a result, the silver behenate content was 96% and other than this, 2% of lignoceric acid and 2% of arachidinic acid were contained.

(Preparation of Fatty Acid Silver Salt Dispersion B)

The recrystallized behenic acid (88 kg), 422 liter of distilled water, 49.2 liter of an aqueous NaOH solution in a concentration of 5 mol/liter, and 120 liter of tert-butyl alcohol were mixed. The mixture was reacted by stirring at 75° C. for one hour to obtain Sodium Behenate Solution B. Separately, 206.2 liter (pH 4.0) of an aqueous solution containing 40.4 kg of silver nitrate was prepared and kept at 10° C. A reaction vessel containing 635 liter of distilled water and 30 liter of tert-butyl alcohol was kept at 30° C. and while thoroughly stirring, the entire amount of Sodium Behenate Solution B obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution B was started, and only Sodium Behenate Solution B was added for the period of 14 minutes and 15 second after the completion of addition of the aqueous silver nitrate solution. During the addition, the temperature inside the reaction vessel was kept at 30° C. and the outer temperature was controlled to make constant the liquid temperature. The piping in the system of adding Sodium Behenate Solution B was kept warm by circulating hot water in the outer side of a double pipe, whereby the outlet liquid temperature at the distal end of the addition nozzle was adjusted to 75° C. The piping in the system of adding the aqueous silver nitrate solution was kept warm by circulating cold water in the outer side of a double pipe. The addition site of Sodium Behenate Solution B and the addition site of aqueous silver nitrate solution were symmetrically arranged with the center laid on the stirring axis. Also, these addition sites were each adjusted to a height of not causing contact with the reaction solution.

After the completion of addition of Sodium Behenate Solution B, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was evaluated by electron microphotography, as a result, the grains were crystals having average sizes of a=0.21 μm, b=0.4 μm and c=0.4 μm, an average aspect ratio of 2.1, an average equivalent-sphere diameter of 0.51 μm and a coefficient of variation in the equivalent-sphere diameter of 11% (a, b and c comply with the definition in this specification).

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Kogyo).

Then, the preliminarily dispersed stock solution was treated three times in a dispersing machine (Microfluidizer M-610, trade name, manufactured by Microfluidex International Corporation, using a Z-type interaction chamber) under the control of pressure to 1,150 kg/cm$^2$ to obtain a silver behenate dispersion. At the dispersion, the temperature was set to 18° C. by a cooling operation of controlling the coolant temperature using coiled heat exchangers attached to the inlet side and outlet side of the interaction chamber.

(Preparation of Reducing Agent Dispersion)

<Preparation of Reducing Agent Complex 1 Dispersion>

Water (10 kg) was added to 10 kg of Reducing Agent Complex 1 (a 1:1 complex of 6,6'-di-tert-butyl-4,4'-dimethyl-2,2'-butylidenediphenol and triphenylphosphine oxide), 0.12 kg of triphenylphosphine oxide and 16 kg of a 10 mass % aqueous solution of modified polyvinyl alcohol (Poval MP203, produced by Kuraray Co., Ltd.) and thoroughly mixed to form a slurry. This slurry was transferred by a diaphragm pump to a horizontal sand mill (UVM-2, manufactured by AIMEX K. K.) filled with zirconia beads having an average diameter of 0.5 mm, and dispersed for 4 hours and 30 minutes. Thereafter, 0.2 g of benzoisothiazolinone sodium salt and water were added to adjust the reducing agent complex concentration to 22 mass %, thereby obtaining Reducing Agent Complex 1 Dispersion. The reducing agent complex particles contained in the thus-obtained reducing agent complex dispersion had a median diameter of 0.45 μm and a maximum particle size of 1.4 μm or less. The obtained reducing agent complex dispersion was filtered through a polypropylene-made filter having a pore size of 3.0 μm to remove foreign matters such as dust and then housed.

<Preparation of Reducing Agent 2 Dispersion>

Water (10 kg) was added to 10 kg of Reducing Agent 2 (6,6'-di-tert-butyl-4,4'-dimethyl-2,2'-butylidenediphenol) and 16 kg of a 10 mass % aqueous solution of modified polyvinyl alcohol (Poval MP203, produced by Kuraray Co., Ltd.) and thoroughly mixed to form a slurry. This slurry was transferred by a diaphragm pump to a horizontal sand mill (UVM-2, manufactured by AIMEX K. K.) filled with zirconia beads having an average diameter of 0.5 mm, and dispersed for 3 hours and 30 minutes. Thereafter, 0.2 g of benzoisothiazolinone sodium salt and water were added to adjust the reducing agent concentration to 25 mass %. This dispersion solution was heat-treated at 60° C. for 5 hours to obtain Reducing Agent 2 Dispersion. The reducing agent particles contained in the thus-obtained reducing agent dispersion had a median diameter of 0.40 μm and a maximum particle size of 1.5 μm or less. The obtained reducing agent dispersion was filtered through a polypropylene-made filter having a pore size of 3.0 μm to remove foreign matters such as dust and then housed.

<Preparation of Hydrogen-Bonding Compound 1 Dispersion>

Water (10 kg) was added to 10 kg of Hydrogen-Bonding Compound 1 (tri(4-tert-butylphenyl)phosphine oxide) and 16 kg of a 10 mass % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by AIMEX K.K.) filled with zirconia beads having an average diameter of 0.5 mm, and dispersed for 3 hours and 30 minutes. Thereafter, 0.2 g of benzoisothiazolinone sodium salt and water were added to adjust the hydrogen-bonding compound concentration to 25 mass %. This dispersion solution was heated at 80° C. for one hour to obtain Hydrogen-Bonding Compound 1 Dispersion. The hydrogen-bonding compound particles contained in the thus-obtained hydrogen-bonding compound dispersion had a median diameter of 0.35 μm and a maximum particle size of 1.5 μm or less. The obtained hydrogen-bonding compound dispersion was filtered through a polypropylene-made filter having a pore size of 3.0 μm to remove foreign matters such as dust and then housed.

<Preparation of Development Accelerator 1 Dispersion>

Water (10 kg) was added to 10 kg of Development Accelerator 1 and 20 kg of a 10 mass % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by AIMEX K. K.) filled with zirconia beads having an average diameter of 0.5 mm, and dispersed for 3 hours and 30 minutes. Thereafter, 0.2 g of benzoisothiazolinone sodium salt and water were added to adjust the development accelerator concentration to 20 mass %, thereby obtaining Development Accelerator 1 Dispersion. The development accelerator particles contained in the thus-obtained development accelerator dispersion had a median diameter of 0.48 μm and a maximum particle size of 1.4 μm or less. The obtained development accelerator dispersion was filtered through a polypropylene-made filter having a pore size of 3.0 μm to remove foreign matters such as dust and then housed.

Solid Dispersions of Development Accelerator 2, Development Accelerator 3 and Color Tone Adjusting Agent 1 each was obtained as a 20 mass % dispersion in the same manner as Development Accelerator 1.

(Preparation of Polyhalogen Compound)

<Preparation of Organic Polyhalogen Compound 1 Dispersion>

Organic Polyhalogen Compound 1 (tribromomethanesulfonylbenzene) (10 kg), 10 kg of a 20 mass % aqueous solution of modified polyvinyl alcohol (Poval MP203, produced by Kuraray Co., Ltd.), 0.4 kg of a 20 mass % aqueous solution of sodium triisopropylnaphthalenesulfonate and 14 kg of water were added and thoroughly mixed to form a slurry. The resulting slurry was transferred by a diaphragm pump to a horizontal sand mill (UVM-2, manufactured by AIMEX K. K.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 26 mass %, thereby obtaining Organic Polyhalogen Compound 1 Dispersion. The organic polyhalogen compound particles contained in the thus-obtained polyhalogen compound dispersion had a median diameter of 0.41 μm and a maximum particle size of 2.0 μm or less. The obtained organic polyhalogen compound dispersion was filtered through a polypropylene-made filter having a pore size of 10.0 μm to remove foreign matters such as dust and then housed.

<Preparation of Organic Polyhalogen Compound 2 Dispersion>

Organic Polyhalogen Compound 2 (N-butyl-3-tribromomethanesulfonylbenzamide) (10 kg), 20 kg of a 10 mass % aqueous solution of modified polyvinyl alcohol (Poval MP203, produced by Kuraray Co., Ltd.) and 0.4 kg of a 20 mass % aqueous solution of sodium triisopropylnaphthalenesulfonate were added and thoroughly mixed to form a slurry. The resulting slurry was transferred by a diaphragm pump to a horizontal sand mill (UVM-2, manufactured by AIMEX K.K.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 30 mass %. This dispersion solution was heated at 40° C. for 5 hours to obtain Organic Polyhalogen Compound 2 Dispersion. The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene-made filter having a pore size of 3.0 μm to remove foreign matters such as dust and then housed.

<Preparation of Phthalazine Compound 1 Solution>

In 174.57 kg of water, 8 kg of modified polyvinyl alcohol MP203 produced by Kuraray Co., Ltd. was dissolved. Thereto, 3.15 kg of a 20 mass % aqueous solution of sodium triisopropylnaphthalenesulfonate and 14.28 kg of a 70 mass % aqueous solution of Phthalazine Compound 1 (6-isopropyl-phthalazine) were added to prepare a 5 mass % solution of Phthalazine Compound 1.

(Preparation of Mercapto Compound)

<Preparation of Aqueous Mercapto Compound 1 Solution>

In 993 g of water, 7 g of Mercapto Compound 1 (1-(3-sulfophenyl)-5-mercaptotetrazole sodium salt) was dissolved to prepare a 0.7 mass % aqueous solution.

<Preparation of Aqueous Mercapto Compound 2 Solution>

In 980 g of water, 20 g of Mercapto Compound 2 (1-(3-methylureido)-5-mercaptotetrazole sodium salt) was dissolved to prepare a 2.0 mass % aqueous solution.

<Preparation of Pigment 1 Dispersion>

Water (250 g) was added to 64 g of C.I. Pigment Blue 60 and 6.4 g of Demol N (produced by Kao Corporation) and thoroughly mixed to form a slurry. The resulting slurry and 800 g of zirconia beads having an average diameter of 0.5 mm were charged together into a vessel and dispersed for 25 hours in a dispersing machine (1/4G Sand Grinder Mill, manufactured by AIMEX K. K.) to obtain Pigment 1 Dispersion. The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 mass of styrene, 27.0 mass of butadiene and 3.0 mass of acrylic acid were emulsion-polymerized. After aging at 80° C. for 8 hours, the resulting polymer was cooled to 40° C. and adjusted to a pH of 7.0 with aqueous ammonia. Thereto, SANDET BL (produced by Sanyo Kasei K. K.) was added to have a concentration of 0.22%. Thereafter, the pH was adjusted to 8.3 by adding an aqueous 5% sodium hydroxide solution and further adjusted to 8.4 with aqueous ammonia. The molar ratio of $Na^+$ ion and $NH_4^+$ ion used here was 1:2.3. To 1 kg of the resulting solution, 0.15 ml of a 7% aqueous solution of benzoisothiazolinone sodium salt was added to prepare an SBR latex solution.

(SBR Latex: latex of -St(70.0)-Bu(27.0)-AA(3.0)-):

Tg: 22° C.

Average particle size: 0.1 μm, concentration: 43 mass %, equilibrium moisture content at 25° C. and 60% RH: 0.6 mass %, ion conductivity: 4.2 mS/cm (in the measurement of ion conductivity, the latex stock solution (43 mass %) was measured at 25° C. using a conductivity meter CM-30S manufactured by Toa Denpa Kogyo K. K.), pH: 8.4.

SBR latexes different in the Tg can be prepared in the same manner by appropriately changing the ratio of styrene and butadiene.

<Preparation of Coating Solution 1A for Emulsion Layer (Light-Sensitive Layer)>

Fatty Acid Silver Salt Dispersion A prepared above (1,000 g), 276 ml of water, 33.2 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 22° C.) solution, 299 g of Reducing Agent Complex 1 Dispersion, 6 g of Development Accelerator 1 Dispersion, 9 ml of Aqueous Mercapto Compound 1 Solution and 27 ml of Aqueous Mercapto Compound 2 Solution were sequentially added. Immediately before the coating, 117 g of Emulsion 1A for Coating Solution was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 25 [mPa·s] at 40° C. (No. 1 rotor, 60 rpm).

The viscosity of the coating solution measured at 25° C. using RFS Fluid Spectrometer (manufactured by Rheometrics Far East K. K.) was 230, 60, 46, 24 and 18 [mPa·s] at a shear rate of 0.1, 1, 10, 100 and 1,000 [1/sec], respectively.

The amount of zirconium in the coating solution was 0.38 mg per g of silver.

<Preparation of Coating Solution 1B for Emulsion Layer (Light-Sensitive Layer)>

This coating solution was produced in the same manner as Coating Solution 1A for Emulsion Layer (Light-Sensitive Layer) except for changing Emulsion 1A for Coating Solution to Emulsion 1B for Coating Solution.

<Preparation of Coating Solution 1C for Emulsion Layer (Light-Sensitive Layer)>

This coating solution was produced in the same manner as Coating Solution 1A for Emulsion Layer (Light-Sensitive Layer) except for changing Emulsion 1A for Coating Solution to Emulsion 1C for Coating Solution.

<Preparation of Coating Solution for Interlayer on Emulsion Surface>

A 5 mass % aqueous solution (27 ml) of Aerosol OT (produced by American Cyanamide), 135 ml of a 20 mass % aqueous solution of diammonium phthalate and water for making a total amount of 10,000 g were added to 1,000 g of polyvinyl alcohol PVA-205 (produced by Kuraray Co., Ltd.), 272 g of a 5 mass % dispersion of pigment and 4,200 ml of a 19 mass % solution of methyl methacrylate/styrene/butyl acrylate/hydroxyethyl methacrylate/acrylic acid copolymer (copolymerization ratio by weight: 64/9/20/5/2) latex. The pH was adjusted to 7.5 with NaOH to prepare a coating solution for interlayer and then this coating solution was transferred to a coating die to give a coverage of 9.1 ml/m$^2$.

The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Surface>

In water, 64 g of inert gelatin was dissolved. Thereto, 80 g of a 27.5 mass % solution of methyl methacrylate/styrene/butyl acrylate/hydroxyethyl meth-acrylate/acrylic acid copolymer (copolymerization ratio by weight: 64/9/20/5/2) latex, 23 ml of a 10 mass % methanol solution of phthalic acid, 23 ml of a 10 mass % aqueous solution of 4-methylphthalic acid, 28 ml of sulfuric acid in a concentration of 0.5 mol/liter, 5 ml of a 5 mass % aqueous solution of Aerosol OT (produced by American Cyanamide), 0.5 g of phenoxyethanol, 0.1 g of benzoisothiazolinone and water for making a total amount of 750 g were added to prepare a coating solution. Immediately before the coating, 26 ml of a 4 mass % chrome alum was mixed using a static mixer. Then, the coating solution was transferred to a coating die to give a coverage of 18.6 ml/m$^2$.

The viscosity of the coating solution was measured at 40° C. by a Brookfield viscometer (No. 1 rotor, 60 rpm) and found to be 20 [mPa·s].

<Preparation of Coating Solution for Second Protective Layer on Emulsion Surface>

In water, 80 g of inert gelatin was dissolved. Thereto, 102 g of a 27.5 mass % solution of methyl methacrylate/styrene/butyl acrylate/hydroxyethyl meth-acrylate/acrylic acid copolymer (copolymerization ratio by weight: 64/9/20/5/2) latex, 3.2 ml of a 5 mass % solution of Fluorine-Containing Surfactant (F-1) (N-perfluorooctyl-sulfonyl-N-propylalanine potassium salt), 32 ml of a 2 mass % aqueous solution of Fluorine-Containing Surfactant (F-2) (polyethylene glycol mono(N-perfluorooctylsulfonyl-N-propyl-2-aminoethyl)ether [ethylene oxide average polymerization degree: 15]), 23 ml of a 5 mass % solution of Aerosol OT (produced by American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid in a concentration of 0.5 mol/liter, 10 mg of benzoisothiazolinone and water for making a total amount of 650 g were added. Immediately before the coating, 445 ml of an aqueous solution containing 4 mass % of chrome alum and 0.67 mass % of phthalic acid was mixed using a static mixer to obtain a coating solution for surface protective layer and then this coating solution was transferred to a coating die to give a coverage of 8.3 ml/m$^2$.

The viscosity of the coating solution was measured at 40° C. by a Brookfield viscometer (No. 1 rotor, 60 rpm) and found to be 19 [mPa·s].

<Preparation of Heat-Developable Light-Sensitive Material 1A>

In the back surface side of the undercoated support prepared above, the coating solution for antihalation layer and the coating solution for protective layer on back surface were simultaneously coated one on another to give a coated gelatin amount of 0.44 g/m$^2$ and 1.7 g/m$^2$, respectively, and then dried to form a back layer.

Using Coating Solution 1A for Emulsion Layer (Light-Sensitive Layer), a heat-developable light-sensitive material sample was prepared by simultaneously coating on the surface opposite the back surface, an emulsion layer, an interlayer, a first protective layer and a second protective layer one on another in this order from the undercoated surface according to the slide bead coating method. At this time, the temperature was adjusted such that the emulsion layer and the interlayer were 31° C., the first protective layer was 36° C. and the second protective layer was 37° C.

The coated amount (g/m$^2$) of each compound in the emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.97 |
| Reducing Agent Complex 1 | 1.41 |
| Development Accelerator 1 | 0.024 |
| Mercapto Compound 1 | 0.002 |
| Mercapto Compound 2 | 0.012 |
| Silver halide (as Ag) | 0.091 |

The coating and drying conditions were as follows.

The coating was performed at a speed of 160 m/min, the distance between the tip of coating die and the support was set to from 0.10 to 0.30 mm, and the pressure in the vacuum chamber was set lower by 196 to 882 Pa than the atmospheric pressure. The support was destaticized by ionized wind before the coating.

In the subsequent chilling zone, the coating solution was cooled with air at a dry bulb temperature of 10 to 20° C. Thereafter, the sample was transported by contact-free transportation and in a helical floating-type dryer, dried with drying air at a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The heat-developable light-sensitive material thus prepared had a matting degree of, in terms of the Bekk smoothness, 550 seconds on the light-sensitive layer surface and 130 seconds on the back surface. Furthermore, the pH on the layer surface in the light-sensitive layer side was measured and found to be 6.0.

<Preparation of Heat-Developable Light-Sensitive Material 1B>

This heat-developable light-sensitive material was prepared in the same manner as Heat-Developable Light-sensitive Material 1A except for changing Coating Solution 1A for Emulsion Layer (Light-Sensitive Layer) to Coating Solution 1B for Emulsion Layer (Light-Sensitive Layer).

<Preparation of Heat-Developable Light-Sensitive Material 1C>

This heat-developable light-sensitive material was prepared in the same manner as Heat-Developable Light-sensitive Material 1A except for changing Coating Solution 1A for Emulsion Layer (Light-Sensitive Layer) to Coating Solution 1C for Emulsion Layer (Light-Sensitive Layer).

(Evaluation of Photographic Performance)

The samples obtained each was cut into a size of 356×432 mm, wrapped with the following packaging material in the environment of 25° C. and 50%, stored at an ordinary temperature for 2 weeks and then evaluated as follows.

(Packaging Material)

Polyethylene (50 μm) containing PET (10 μm)/PE (12 μm)/aluminum foil (9 μm)/Ny (15 μm)/carbon (3%):

oxygen permeability: 0.02 ml/atm·$m^2$·25° C.·day water permeability: 0.10 g/atm·$m^2$·25° C.·day (Exposure of Light-Sensitive Material)

The light-sensitive material was exposed as follows. In the exposure part of Fuji Medical Dry Laser Imager FM-DPL, a semiconductor laser NLHV3000E manufactured by Nichia Kagaku Kogyo was mounted as a semiconductor laser light source and the laser beam was diaphragmed to about 100 μm. By varying the illuminance of laser light on the light-sensitive material surface to 0 and between 1 mW/$mm^2$ and 1,000 mW/$mm^2$, the light-sensitive material was exposed for $10^{-6}$ seconds. The light emission wavelength of the laser light was 405 nm.

The samples each was heat-developed by Fuji Medical Dry Laser Imager FM-DP L (with four sheets of panel heater set at 112° C.–119° C.–121° C.–121° C., for 24 seconds in total) and the obtained image was evaluated by a densitometer. The sensitivity was prescribed by the reciprocal of the exposure amount of giving a density higher than the minimum density by 1.5 and shown by a relative value to Heat-Developable Light-Sensitive Material 1A of which sensitivity was taken as 100. The results are shown in Table 6. As apparent from Table 6, the heat-developable light-sensitive material using the emulsion of the present invention was verified to have remarkably high sensitivity.

TABLE 6

| | Emulsion | Sensitivity |
|---|---|---|
| Heat-Developable Light-Sensitive Material 1A | Emulsion 1A (comparison) | 100 |
| Heat-Developable Light-Sensitive Material 1B | Emulsion 1B (invention) | 126 |
| Heat-Developable Light-Sensitive Material 1C | Emulsion 1C (invention) | 178 |

EXAMPLE 13

<Preparation of Silver Halide Emulsion 2A>

Silver Halide Emulsion 2A was prepared in the same manner as in the preparation of Silver Halide Emulsion 1A except that the liquid temperature at the addition of Aqueous Solution B was changed to 30° C. and Aqueous Solution C was added at 50° C. by the controlled double jet method while maintaining the pAg at 7.4. In the silver halide emulsion obtained, the average equivalent-sphere diameter of grains was 0.06 μm and the coefficient of variation in the equivalent-sphere diameter was 30%. In this emulsion, the tetradecahedral grain of the present invention was not observed. The properties of the emulsion are shown in Table 7.

TABLE 7

| | Percentage of Tetradecahedral Grain (%) | Percentage of β Type (%) | Grain Size (μm) | Coefficient of Variation in Average Equivalent-Sphere Diameter (%) | Average Aspect Ratio |
|---|---|---|---|---|---|
| Emulsion 2A (Comparison) | 0 | 55 | 0.06 | 30 | — |
| Emulsion 2B (Invention) | 58 | 61 | 0.06 | 20 | 1 |
| Emulsion 2C (Invention) | 78 | 80 | 0.06 | 16 | 1.2 |

<Preparation of Silver Halide Emulsion 2B>

Silver Halide Emulsion 2B was prepared in the same manner as in the preparation of Silver halide Emulsion 2A except that 0.02 g of potassium iodide was added to Aqueous Gelatin Solution A, the liquid temperature at the addition of Aqueous Solution B was changed to 30° C. and Aqueous Solution C was added at 45° C. by the controlled double jet method while maintaining the pAg at 9.3. In the silver halide emulsion obtained, the average equivalent-sphere diameter of grains was 0.06 μm and the coefficient of variation in the equivalent-sphere diameter was 20%. In this emulsion, 58% of the projected area of all grains was occupied by the tetradecahedral grain of the present invention having crystal faces of (001) {100} {101}. The properties of the emulsion are shown in Table 7.

<Preparation of Silver Halide Emulsion 2C>

Silver Halide Emulsion 2C was prepared in the same manner as in the preparation of Silver halide Emulsion 2B except that Aqueous Gelatin Solution A was adjusted to a pH of 6.0 at 30° C. and the addition time of Aqueous Solution B and the aqueous silver nitrate solution simultaneously added was prolonged to 2 times. In the silver halide emulsion obtained, the average equivalent-sphere diameter of grains was 0.06 μm and the coefficient of variation in the equivalent-sphere diameter was 16%. In this emulsion, 78% of the projected area of all grains was occupied by the tetradecahedral grain of the present invention having crystal faces of (001) {100} {101}. The properties of the emulsion are shown in Table 7.

<Preparation of Emulsion 2A for Coating Solution>

To Silver Halide Emulsion 2A, a 1 mass % aqueous solution of benzothiazolium iodide was added in an amount of $7\times10^{-3}$ mol per mol of silver. Furthermore, water was added to adjust the silver halide content to 38.2 g in terms of silver per kg of the emulsion for coating solution.

<Preparation of Emulsion 2B for Coating Solution>

Emulsion 2B for Coating Solution was prepared in the same manner as Emulsion 2A for Coating Solution except for changing Silver halide Emulsion 2A to Silver Halide Emulsion 2B.

<Preparation of Emulsion 2C for Coating Solution>

Emulsion 2C for Coating Solution was prepared in the same manner as Emulsion 2A for Coating Solution except for changing Silver halide Emulsion 2A to Silver Halide Emulsion 2C.

<Preparation of Coating Solution 2A for Emulsion Layer (Light-Sensitive Layer)>

Fatty Acid Silver Salt Dispersion B prepared above (1,000 g), 276 ml of water, 32.8 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 20° C.) solution, 155 g of Reducing Agent 2 Dispersion, 55 g of Hydrogen-Bonding Compound 1 Dispersion, 6 g of Development Accelerator 1 Dispersion, 2 g of Development Accelerator 2 Dispersion, 3 g of Development Accelerator 3 Dispersion, 2 g of Color Tone Adjusting Agent 1 Dispersion and 6 ml of Aqueous Mercapto Compound 2 Solution were sequentially added. Immediately before the coating, 117 g of Emulsion 2A for Coating Solution was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 40 [mPa·s] at 40° C. (No. 1 rotor, 60 rpm).

The viscosity of the coating solution measured at 25° C. using RFS Fluid Spectrometer (manufactured by Rheometrics Far East K. K.) was 530, 144, 96, 51 and 28 [mPa·s] at a shear rate of 0.1, 1, 10, 100 and 1,000 [1/sec], respectively.

The amount of zirconium in the coating solution was 0.25 mg per g of silver.

<Preparation of Coating Solution 2B for Emulsion Layer (Light-Sensitive Layer)>

This coating solution was produced in the same manner as Coating Solution 2A for Emulsion Layer (Light-Sensitive Layer) except for changing Emulsion 2A for Coating Solution to Emulsion 2B for Coating Solution.

<Preparation of Coating Solution 2C for Emulsion Layer (Light-Sensitive Layer)>

This coating solution was produced in the same manner as Coating Solution 2A for Emulsion Layer (Light-Sensitive Layer) except for changing Emulsion 2A for Coating Solution to Emulsion 2C for Coating Solution.

<Preparation of Heat-Developable Light-Sensitive Material 2A>

Heat-Developable Light-sensitive Material 2A was prepared in the same manner as Heat-Developable Light-sensitive Material 1A except that in the preparation of Heat-Developable Light-sensitive Material 1A, Coating Solution 1A for Emulsion Layer was changed to Coating Solution 2A for Emulsion Layer, Yellow Dye Compound 1 was eliminated from the antihalation layer, and Fluorine-Containing Surfactants F-1, F-2, F-3 and F-4 in the back surface protective layer and emulsion surface protective layer were changed to F-5, F-6, F-7 and F-8, respectively. The coated amount (g/m$^2$) of each compound in this emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.67 |
| Reducing Agent 2 | 0.81 |
| Hydrogen-Bonding Compound 1 | 0.30 |
| Development Accelerator 1 | 0.024 |
| Development Accelerator 2 | 0.010 |

-continued

| | |
|---|---|
| Development Accelerator 3 | 0.015 |
| Color Tone Adjusting Agent 1 | 0.010 |
| Mercapto Compound 2 | 0.002 |
| Silver halide (as Ag) | 0.091 |

<Preparation of Heat-Developable Light-Sensitive Material 2B>

This heat-developable light-sensitive material was prepared in the same manner as Heat-Developable Light-Sensitive Material 2A except for changing Coating Solution 2A for Emulsion Layer (Light-Sensitive Layer) to Coating Solution 2B for Emulsion Layer (Light-Sensitive Layer).

<Preparation of Heat-Developable Light-Sensitive Material 2C>

This heat-developable light-sensitive material was prepared in the same manner as Heat-Developable Light-Sensitive Material 2A except for changing Coating Solution 2A for Emulsion Layer (Light-Sensitive Layer) to Coating Solution 2C for Emulsion Layer (Light-Sensitive Layer).

Chemical structures of the compounds used in Examples 12 and 13 of the present invention are shown below.

Spectral Sensitizing Dye A:

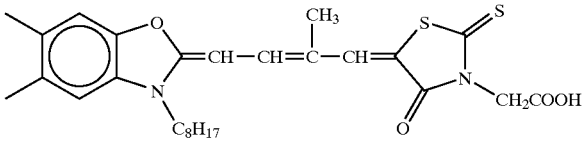

Spectral Sensitizing Dye B:

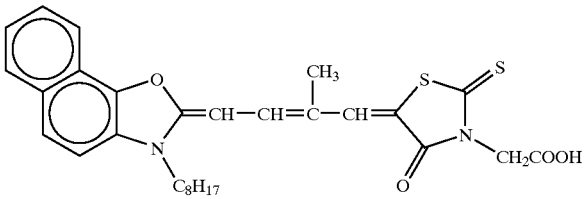

Tellurium Sensitizer C:

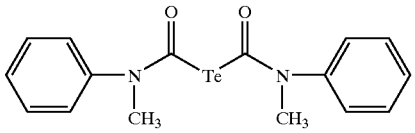

Base Precursor Compound 1:

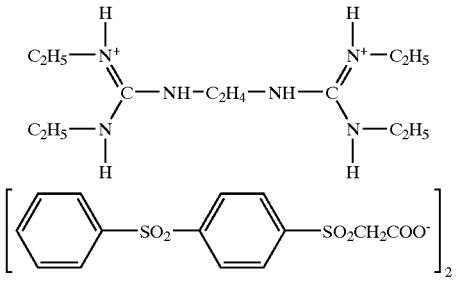

-continued
Cyanine Dye Compound 1:
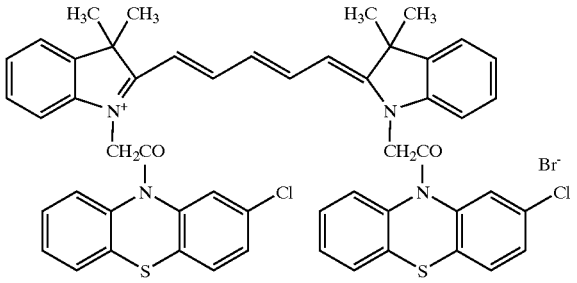
Blue Dye Compound 1:
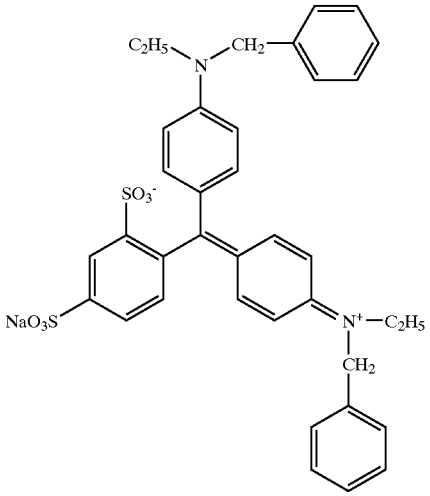
Yellow Dye Compound 1:
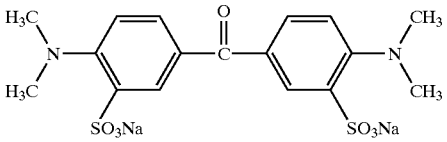
Reducing Agent Complex 1:
A 1:1 complex of
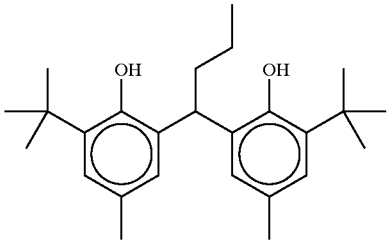
and
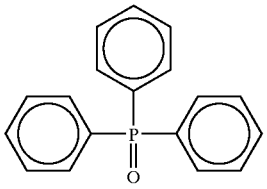
-continued
Reducing Agent 2:
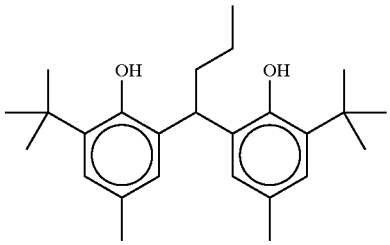
Hydrogen-Bonding Compound 1:
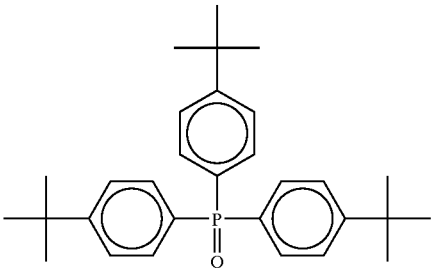
Polyhalogen Compound 1:
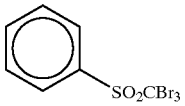
Polyhalogen Compound 2:
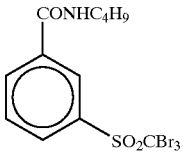
Mercapto Compound 1:
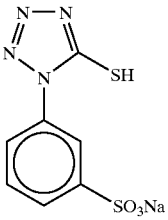
Mercapto Compound 2:
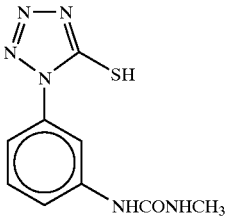
Phthalazine Compound 1:
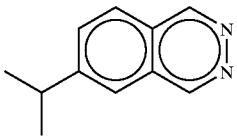

-continued

Development Accelerator 1:

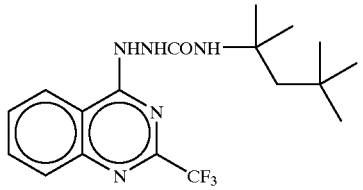

Development Accelerator 2:

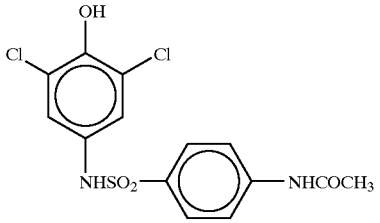

Development Accelerator 3:

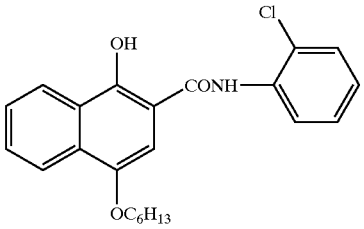

Color Tone Adjusting Agent 1:

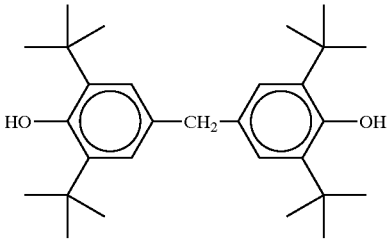

(F-1)

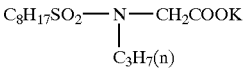

(F-2)

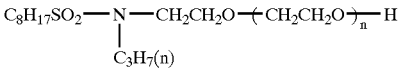

n = 15 (average)

(F-3)

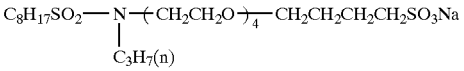

(F-4)

$C_8F_{17}SO_3K$ (F-5)

$CF_3(CF_2)_nCH_2CH_2SCH_2CH_2COOLi$ a mixture of n = 5 to 11

(F-6)

$CF_3(CF_2)_nCH_2CH_2O(CH_2CH_2O)_mH$ a mixture of n = 5 to 11, m = 5 to 15

-continued (F-7)

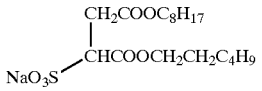

(F-8)

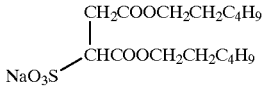

(Evaluation of Photographic Performance)

The samples obtained each was cut into a size of 356×432 mm, wrapped with the following packaging material in the environment of 25° C. and 50%, stored at an ordinary temperature for 2 weeks and then evaluated as follows.

(Packaging Material)

Polyethylene (50 μm) containing PET (10 μm)/PE (12 μm)/aluminum foil (9 μm)/Ny (15 μm)/carbon (3%):

oxygen permeability: 0.02 ml/atm·$m^2$·25° C.·day water permeability: 0.10 g/atm·$m^2$·25° C.·day (Exposure of Light-Sensitive Material)

The light-sensitive material was exposed as follows. In the exposure part of Fuji Medical Dry Laser Imager FM-DPL, a semiconductor laser NLHV3000E manufactured by Nichia Kagaku Kogyo was mounted as a semiconductor laser light source and the laser beam was diaphragmed to about 100 μm. By varying the illuminance of laser light on the light-sensitive material surface to 0 and between 1 mW/$mm^2$ and 1,000 mW/$mm^2$, the light-sensitive material was exposed for $10^{-6}$ seconds. The light emission wavelength of the laser light was 405 nm.

The samples each was heat-developed by Fuji Medical Dry Laser Imager FM-DP L (with four sheets of panel heater set at 112° C.–119° C.–121° C.–121° C., for 14 seconds in total) and the obtained image was evaluated by a densitometer. The sensitivity was prescribed by the reciprocal of the exposure amount of giving a density higher than the minimum density by 3.0 and shown by a relative value to Heat-Developable Light-Sensitive Material 2A of which sensitivity was taken as 100. The results are shown in Table 8. As apparent from Table 8, the heat-developable light-sensitive material using the emulsion of the present invention was verified to have remarkably high sensitivity.

TABLE 8

| | Emulsion | Sensitivity |
|---|---|---|
| Heat-Developable Light-Sensitive Material 2A | Emulsion 2A (comparison) | 100 |
| Heat-Developable Light-Sensitive Material 2B | Emulsion 2B (invention) | 126 |
| Heat-Developable Light-Sensitive Material 2C | Emulsion 2C (invention) | 158 |

According to the present invention, a silver halide fine grain emulsion having high sensitivity, a small size and a narrow size distribution, and a heat-developable light-sensitive material using the emulsion are obtained.

EXAMPLE 14

<Preparation of Silver Halide Emulsion 3B>

Silver Halide Emulsion 3B was prepared in the same manner as in the preparation of Silver halide Emulsion 2A of Example 13 except that 0.04 g of potassium iodide was added to Aqueous Gelatin Solution A, the liquid temperature at the addition of Aqueous Solution B was changed to 30° C. and Aqueous Solution C was added at 45° C. by the controlled double jet method while maintaining the pAg at 9.3. In the silver halide emulsion obtained, the average equivalent-sphere diameter of grains was 0.04 μm and the coefficient of variation in the equivalent-sphere diameter was 20%. In this emulsion, 53% of the projected area of all grains was occupied by the octahedral grain of the present invention having crystal faces of (001) {100}.

<Preparation of Coating Solution 3B for Emulsion Layer (Light-Sensitive Layer)>

This coating solution was produced in the same manner as Coating Solution 2A for Emulsion Layer (Light-Sensitive Layer) of Example 13 except for changing Emulsion 2A for Coating Solution to Emulsion 3B for Coating Solution.

<Preparation and Evaluation of Heat-Developable Light-Sensitive Material 3B>

Heat-Developable Light-Sensitive Material 3B was prepared in the same manner as Heat-Developable Light-sensitive Material 2A of Example 13 except for changing Coating Solution 2A for Emulsion Layer (Light-Sensitive Layer) to Coating Solution 3B for Emulsion Layer (Light-Sensitive Layer).

Heat-Developable Light-Sensitive Material 3B was evaluated in the same manner as in Example 13 and verified to have high sensitivity.

EXAMPLE 15

A heat-developable light-sensitive material was prepared in the same manner as Heat-Developable Light-sensitive Material 1A in Example 12 except for changing the silver halide emulsion used in Heat-Developable Light-sensitive Material 1A to the dodecahedral AgI grain emulsion used in Example 3.

The thus obtained heat-developable light-sensitive material was evaluated in the same manner as in Example 12. The heat-developable light-sensitive material containing the dodecahedral AgI grain emulsion also was verified to have high sensitivity and high image quality.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising at least a dispersion medium, water and a silver halide grain, wherein silver halide grains occupying from 40 to 100% of the total projected area of said silver halide grains have an AgI content of 85 to 100 mol %, have a single kind of outer grain shape, except for size, have at least one surface in a shape of a parallelogram or a parallelogram with the edges being rounded, and have an equivalent-circle projected diameter of from 0.002 to 20 μm.

2. The silver halide emulsion as claimed in claim 1, wherein two pairs of apex angles of said parallelogram or a parallelogram formed by extending linear parts of the edges are about 60° and about 120°.

3. A silver halide emulsion comprising at least a dispersion medium, water and a silver halide grains, wherein silver halide grains occupying from 40 to 100% of the total projected area of said silver halide grains have an AgI content of 85 to 100 mol %, a single kind of outer grain shape, except for size, have at least one surface in a shape of a parallelogram or a parallelogram with the edges being rounded, and have an equivalent-circle projected diameter of from 0.002 to 20 μm.

4. A silver halide emulsion comprising at least a dispersion medium, water and a silver halide grains, wherein silver halide grains occupying from 40 to 100% of the total projected area of said grains have an AgI content of 85 to 100 mol %, a single kind of outer grain shape except for size, which is a dodecahedral composed of twelve parallelogrammic faces or is a dodecahedral grain with the edges being rounded, and have an equivalent-circle projected diameter of from 0.002 to 20 μm.

5. The silver halide emulsion as claimed in claim 1, wherein said silver halide grains occupying from 40 to 100% of the purported area have a hexagonal wurtzite crystal structure and said parallelogrammic face is the {001} face of said structure.

6. A silver halide emulsion comprising at least a dispersion medium, water and a silver halide grains, wherein silver halide grains occupying from 40 to 100% of the total projected area of said silver halide grains have an AgI content of 85 to 100 mol %, a single kind of outer grain shape, except for size, which is an octahedron having two parallel hexagonal faces and on the side surface, six right-angled parallelogrammic faces, or an octahedron with the corners, edges or both of corners and edges being rounded, and have an equivalent-circle projected diameter of from 0.002 to 20 μm.

7. A silver halide emulsion comprising at least a dispersion medium, water and a silver halide grains, wherein silver halide grains occupying from 40 to 100% of the total projected area of said silver halide grains have an AgI content of 85 to 100 mol %, a single kind of outer grain shape, except for size, which is a tetradecahedron having two parallel hexagonal faces and on the side surface, twelve trapezoidal faces, or the tetradecahedron with the corners, edges or both of corners and edges being rounded, and equivalent-circle projected diameter of from 0.002 to 20 μm, which said two parallel hexagonal faces are different in size within one grain, and a ratio $A_6$ of (area of smaller hexagon)/(area of larger hexagon) is from 0.1 to 0.92.

8. A silver halide emulsion comprising at least a dispersion medium, water and a silver halide grains, wherein silver halide grains occupying from 40 to 100% of the total projected area of said silver halide grains have an AgI content of 85 to 100 mol %, a single kind of outer grain shape except for size, which is an elliptic sphere having no flat crystal face, a ratio $A_5$ of (length of longest axis)/(length of shortest axis) is from 1.02 to 1.6, and an equivalent-circle projected diameter of from 0.002 to 20 μm.

9. The silver halide emulsion as claimed in claim 7, wherein said silver halide grains occupying from 40 to 100% of the total projected area have a shape of a tetradecahedral having a hexagonal wurtzite crystal structure and having a crystal surface of {10*n*} represented by plane indexes {001} and {100} of said crystal structure and a positive integer n.

10. The silver halide emulsion as claimed in claim 9, wherein the positive integer n representing said plane index {10n} is 1 or 2.

11. A silver halide photographic light-sensitive material comprising the emulsion claimed in claim 1.

12. A heat-developable light-sensitive material comprising a support having on the same surface thereof a light-sensitive silver halide emulsion, a light-insensitive organic silver salt, a heat developer and a binder, wherein said light-sensitive silver halide emulsion comprises at least a dispersion medium, water and a silver halide grains, wherein silver halide grains occupying from 40 to 100% of the total projected area of said silver halide grains have an AgI content of 85 to 100 mol %, have a single kind of outer grain shape, except for size, have at least one surface in a shape of a parallelogram or a parallelogram with the edges being rounded, and have an equivalent-circle projected diameter of from 0.002 to 20 $\mu$m.

13. A process for producing a silver halide emulsion, comprising simultaneously mixing and adding an aqueous solution containing $Ag^+$ and an aqueous solution containing $X^-$ to an aqueous solution containing a hydrophilic dispersion medium while keeping constant the silver potential of said solution to form the silver halide emulsion comprising at least a dispersion medium, water and a silver halide grains, wherein silver halide grains occupying from 40 to 100% of the total projected area of said silver halide grains have an AgI content of 85 to 100 mol %, have a single kind of outer grain shape, except for size, and an equivalent-circle projected diameter of from 0.002 to 20 $\mu$m, and wherein the amplitude (mV) of said silver potential is from −50 to +50 based on the designated value for a period of 30 to 100% of said formation time.

* * * * *